US008196649B2

(12) United States Patent
Allen et al.

(10) Patent No.: US 8,196,649 B2
(45) Date of Patent: Jun. 12, 2012

(54) THRU DIVERTER WELLHEAD WITH DIRECT CONNECTING DOWNHOLE CONTROL

(75) Inventors: Robert Steven Allen, Bossier City, LA (US); David Earl Cain, New Braunfels, TX (US); Bashir M. Koleilat, Houston, TX (US)

(73) Assignee: T-3 Property Holdings, Inc., Houston, TX (US)

( * ) Notice: Subject to any disclaimer, the term of this patent is extended or adjusted under 35 U.S.C. 154(b) by 355 days.

(21) Appl. No.: 12/286,840

(22) Filed: Oct. 2, 2008

(65) Prior Publication Data

US 2009/0032241 A1 Feb. 5, 2009

Related U.S. Application Data

(63) Continuation-in-part of application No. 11/941,179, filed on Nov. 16, 2007, now Pat. No. 7,845,415.

(60) Provisional application No. 60/867,476, filed on Nov. 28, 2006.

(51) Int. Cl.
*E21B 34/10* (2006.01)
*E21B 19/00* (2006.01)

(52) U.S. Cl. ..... 166/72; 166/375; 166/379

(58) Field of Classification Search ..... 285/123.1, 285/123.2, 123.5, 123.12; 166/90.1, 305, 166/88.4, 75.13, 75.14, 375, 379
See application file for complete search history.

(56) References Cited

U.S. PATENT DOCUMENTS 1,944,481 A 1/1934 Wells
3,431,965 A * 3/1969 Tillman ..... 166/89.1
3,884,298 A 5/1975 Watkins
3,885,629 A 5/1975 Erb
3,950,021 A 4/1976 Goldschild et al.
4,023,620 A 5/1977 Gazda et al.
4,067,388 A 1/1978 Mouret et al.
4,121,660 A 10/1978 Koleilat
4,143,712 A 3/1979 James et al.
4,247,135 A 1/1981 Weirich et al.
4,299,118 A 11/1981 Gau et al.
4,321,829 A 3/1982 Cain
4,374,474 A 2/1983 Cain
4,397,177 A 8/1983 Cain
4,406,303 A 9/1983 Kilmoyer
4,458,903 A 7/1984 Tohill
4,471,965 A 9/1984 Jennings et al.

(Continued)

FOREIGN PATENT DOCUMENTS

CA 2121178 10/1994

(Continued)

OTHER PUBLICATIONS

Weatherford, DDV™: From Emerging to Established, Weatherford magazine, Feb. 2007, pp. 12-14, vol. 9 No. 1 (4 pages).

(Continued)

*Primary Examiner* — Kenneth L Thompson
*Assistant Examiner* — James Sayre
(74) *Attorney, Agent, or Firm* — Strasburger & Price, LLP

(57) ABSTRACT

A single or multi-bowl wellhead may be positioned in a diverter housing over the wellbore. Protrusions on the wellhead may be installed after the diverter housing is removed. The wellhead accommodates the direct connection of hydraulic lines to a hanger seated therein. An overshot running tool protects the wellhead during placement and certain operations.

46 Claims, 30 Drawing Sheets

U.S. PATENT DOCUMENTS

| | | | | |
|---|---|---|---|---|
| 4,552,213 | A | 11/1985 | Boyd et al. | |
| 4,568,062 | A | 2/1986 | Regitz et al. | |
| 4,623,020 | A | 11/1986 | Nichols | |
| 4,659,530 | A | 4/1987 | Boyers et al. | |
| 4,819,967 | A | 4/1989 | Calder et al. | |
| 4,848,457 | A | 7/1989 | Lilley | |
| 4,848,777 | A | 7/1989 | Zollo et al. | |
| 4,896,722 | A | 1/1990 | Upchurch | |
| 4,928,769 | A | 5/1990 | Milberger et al. | |
| 5,031,695 | A | 7/1991 | Cain et al. | |
| 5,044,442 | A | 9/1991 | Nobileau | |
| 5,109,923 | A | 5/1992 | Koleilat | |
| 5,339,912 | A | 8/1994 | Hosie et al. | |
| 5,456,321 | A | 10/1995 | Shiach et al. | |
| 5,465,794 | A | 11/1995 | McConaughy et al. | |
| 5,474,124 | A | 12/1995 | Samuels et al. | |
| 5,503,230 | A | 4/1996 | Osborne et al. | |
| 5,555,935 | A | 9/1996 | Brammer et al. | |
| 5,662,181 | A | 9/1997 | Williams et al. | |
| 5,730,218 | A | 3/1998 | Swagerty et al. | |
| 5,732,772 | A | 3/1998 | Borak, Jr. et al. | |
| 5,755,287 | A | 5/1998 | Cain et al. | |
| 5,775,422 | A | 7/1998 | Wong et al. | |
| 5,775,427 | A | 7/1998 | Skeels et al. | |
| 5,782,297 | A | 7/1998 | Samuels et al. | |
| 5,791,657 | A | 8/1998 | Cain et al. | |
| 5,865,250 | A | 2/1999 | Gariepy | |
| 5,896,925 | A | 4/1999 | Swagerty et al. | |
| 5,988,282 | A | 11/1999 | Jennings et al. | |
| 5,996,695 | A | 12/1999 | Koleilat et al. | |
| 6,015,009 | A | 1/2000 | Allen | |
| 6,050,339 | A | 4/2000 | Milberger | |
| 6,062,314 | A | 5/2000 | Nobileau | |
| 6,065,536 | A | 5/2000 | Gudmestad et al. | |
| 6,076,605 | A | 6/2000 | Lilley et al. | |
| 6,112,810 | A | 9/2000 | Bailey et al. | |
| 6,119,773 | A | 9/2000 | Gariepy et al. | |
| 6,152,232 | A | 11/2000 | Webb et al. | |
| 6,186,239 | B1 | 2/2001 | Monjure et al. | |
| D440,283 | S | 4/2001 | Cain et al. | |
| 6,209,663 | B1 | 4/2001 | Hosie | |
| 6,244,348 | B1 | 6/2001 | Gariepy et al. | |
| 6,253,854 | B1 | 7/2001 | Fenton | |
| 6,263,982 | B1 | 7/2001 | Hannegan et al. | |
| 6,302,212 | B1 | 10/2001 | Nobileau | |
| 6,343,658 | B2 | 2/2002 | Webb | |
| 6,401,747 | B1 | 6/2002 | Cain et al. | |
| 6,401,827 | B1 | 6/2002 | Ferguson et al. | |
| 6,408,945 | B1 | 6/2002 | Telfer | |
| 6,457,529 | B2 | 10/2002 | Calder et al. | |
| 6,470,965 | B1 | 10/2002 | Winzer | |
| 6,470,971 | B1 * | 10/2002 | Bridges | 166/379 |
| 6,470,975 | B1 | 10/2002 | Bourgoyne et al. | |
| 6,474,412 | B2 | 11/2002 | Hamilton et al. | |
| 6,484,807 | B2 | 11/2002 | Allen | |
| 6,510,895 | B1 | 1/2003 | Koleilat et al. | |
| 6,516,876 | B1 | 2/2003 | Jennings | |
| 6,520,207 | B2 | 2/2003 | Bartlett et al. | |
| 6,581,691 | B1 | 6/2003 | Jennings et al. | |
| 6,615,915 | B2 | 9/2003 | Koleilat | |
| 6,719,044 | B2 | 4/2004 | Ford et al. | |
| 6,719,059 | B2 | 4/2004 | Dezen et al. | |
| 6,732,804 | B2 | 5/2004 | Hosie et al. | |
| 6,763,891 | B2 | 7/2004 | Humphrey et al. | |
| 6,840,323 | B2 | 1/2005 | Fenton et al. | |
| 6,918,574 | B2 | 7/2005 | Hallden et al. | |
| 6,923,423 | B2 | 8/2005 | Jones et al. | |
| 6,942,028 | B2 | 9/2005 | Hosie | |
| 6,968,902 | B2 | 11/2005 | Fenton et al. | |
| 6,974,341 | B2 | 12/2005 | Jennings | |
| 6,978,839 | B2 | 12/2005 | Fenton et al. | |
| 7,032,673 | B2 | 4/2006 | Dezen et al. | |
| 7,086,481 | B2 | 8/2006 | Hosie et al. | |
| 7,121,344 | B2 | 10/2006 | Fenton et al. | |
| 7,121,349 | B2 | 10/2006 | Jennings | |
| 7,178,600 | B2 | 2/2007 | Luke et al. | |
| 7,204,315 | B2 | 4/2007 | Pia et al. | |
| 7,219,729 | B2 | 5/2007 | Bostick et al. | |
| 7,219,741 | B2 | 5/2007 | Fenton et al. | |
| 7,237,623 | B2 | 7/2007 | Hannegan | |
| 7,240,736 | B2 | 7/2007 | Fenton et al. | |
| 7,255,173 | B2 | 8/2007 | Hosie et al. | |
| 7,318,480 | B2 | 1/2008 | Hosie et al. | |
| 7,350,590 | B2 | 4/2008 | Hosie et al. | |
| 7,413,018 | B2 | 8/2008 | Hosie et al. | |
| 7,445,046 | B2 | 11/2008 | Borak, Jr. | |
| 7,451,809 | B2 | 11/2008 | Noske et al. | |
| 7,475,732 | B2 | 1/2009 | Hosie et al. | |
| 2004/0079532 | A1 | 4/2004 | Allen et al. | |
| 2005/0242519 | A1 | 11/2005 | Koleilat et al. | |
| 2006/0157254 | A1 | 7/2006 | Baggs | |
| 2007/0144743 | A1 | 6/2007 | White et al. | |
| 2007/0152441 | A1 | 7/2007 | Jennings et al. | |
| 2007/0246220 | A1 | 10/2007 | Fenton | |
| 2007/0284113 | A1 | 12/2007 | Haheim | |
| 2008/0017383 | A1 | 1/2008 | Minassian et al. | |
| 2008/0060846 | A1 | 3/2008 | Belcher et al. | |
| 2008/0121400 | A1 | 5/2008 | Allen | |
| 2008/0245531 | A1 | 10/2008 | Noske et al. | |
| 2009/0000781 | A1 | 1/2009 | Bolding | |
| 2009/0032241 | A1 | 2/2009 | Allen et al. | |
| 2009/0095934 | A1 | 4/2009 | Cain et al. | |
| 2010/0051261 | A1 | 3/2010 | Koleilat et al. | |

FOREIGN PATENT DOCUMENTS

| | | | |
|---|---|---|---|
| CA | 2207662 | | 1/1998 |
| EP | 0 378 040 | A1 | 7/1990 |
| EP | 1 322 833 | B1 | 7/2003 |
| GB | 2291449 | A | 1/1996 |
| GB | 2314867 | A | 1/1998 |
| IN | 179293 | A1 | 9/1997 |
| SG | 24107 | A1 | 2/1996 |
| WO | WO-00/73687 | A1 | 12/2000 |
| WO | WO 03/067017 | A2 | 8/2003 |
| WO | WO 2004/044367 | A2 | 5/2004 |
| WO | WO 2004/044368 | A2 | 5/2004 |
| WO | WO 2005/040545 | A2 | 5/2005 |
| WO | WO 2005/056980 | A1 | 6/2005 |
| WO | WO 2006/059223 | A2 | 6/2006 |
| WO | WO 2007/116264 | A1 | 10/2007 |

OTHER PUBLICATIONS

Wood Group Pressure Control website, Control Line Exit Block, Down Hole Control Valve (DHCV) Exit Assembly, printed Feb. 26, 2008, Technical Bulletin #05-0097, corresponding website http://portal.woodgroup.com (3 pages).

Wood Group Pressure Control website, Time-Saving Wellhead, SH3 Speedhead System, printed Feb. 26, 2008, Technical Bulletin #04-0395, corresponding website http://portal.woodgroup.com (4 pages).

Wood Group Pressure Control website, Time-Saving Wellhead, LSH Land Speedhead System, printed Feb. 26, 2008, Technical Bulletin #05-0143, corresponding website http://portal.woodgroup.com (4 pages).

Wood Group Pressure Control website, Tubing Head, MTH2 Mini Tubing Head, printed Feb. 26, 2008, Technical Bulletin #04-0397, corresponding website http://portal.woodgroup.com (3 pages).

Wood Group Pressure Control website, Time-Saving Wellhead, Multi-Well Completion, MWC System, printed Feb. 26, 2008, Technical Bulletin #05-0177, corresponding website http://portal.woodgroup.com (3 pages).

Wood Group Pressure Control website, Time-Saving Wellhead, SH2 Split Speedhead System, printed Feb. 26, 2008, Technical Bulletin #04-0394, corresponding website http://portal.woodgroup.com (4 pages).

Wood Group Pressure Control website, Time-Saving Wellhead, OSH Offshore Speedhead System, printed Feb. 26, 2008, Technical Bulletin #04-0396, corresponding website http://portal.woodgroup.com (4 pages).

Vetco Gray website, Close Proximity Wellhead Systems, printed Feb. 27, 2008, corresponding website http://www.vetcogray.com/products/surfacewellhead/Pages/CloseProximityWellhead.aspx, © General Electric Company 1997-2007 (1 page).

Vetco Gray website, Conventional Tubing Hanger Systems, printed Feb. 27, 2008, corresponding website http://www.vetcogray.com/products/surfacewellhead/Pages/ Conventional Tubing Hangars.aspx, © General Electric Company 1997-2007 (2 pages).
Vetco Gray website, Multibowl Wellhead Systems, printed Feb. 27, 2008, corresponding website http://www.vetcogray.com/products/surfacewellhead/Pages/MultibowlWellhead.aspx, © General Electric Company 1997-2007 (1 page).
Vetco Gray website, Non-Welded Casing Seal Wellhead Connector, printed Feb. 27, 2008, corresponding website http://www.vetcogray.com/products/surfacewellhead/Pages/Non-WeldedCasingSealWellheadConnector.aspx, © General Electric Company 1997-2007 (1 page).
Vetco Gray website, NT-2 Connectors, printed Feb. 27, 2008, corresponding website http://www.vetcogray.com/products/surfacewellhead/Pages/NT-2Connectors.aspx, © General Electric Company 1997-2007 (2 pages).
Vetco Gray website, Casing Seal Systems, printed Feb. 27, 2008, corresponding website http://www.vetcogray.com/products/surfacewellhead/Pages/CasingSealSystems.aspx, © General Electric Company 1997-2007 (2 pages).
T3® Energy Services website, TimeSaver Wellhead system™, printed Feb. 20, 2008, corresponding website http://www.t3energy.com/well/ (1 page).
Weatherford, DDV™ Downhole Deployment Valve, Brochure 335.05, © 2005-2007 Weatherford (4 pages).
Weatherford, Real Results, Successful Trial of Downhole Deployment Valve (DDV™) Proves the Validity of DDV Technology, © 2003-2007 Weatherford (1 page).
U.S. Patent and Trademark Office, Interview Summary, U.S. Appl. No. 10/281,055, see previously cited US2004/0079532 A1, Applicant(s) Allen et al., Jan. 7, 2005 (1 Page).
U.S. Patent and Trademark Office, Notice of Abandonment, U.S. Appl. No. 10/281,055, Thompson, see previously cited US2004/0079532 A1, Applicant(s) Allen et al., Jan. 11, 2005 (2 pages).
U.S. Patent and Trademark Office, Office Action Summary, U.S. Appl. No. 10/281,055, see previously cited US2004/0079532 A1, Applicant(s) Allen et al., Jun. 7, 2004 (11 pages).
T3® Energy Services, 2007 Management Presentation, T3® Energy Services Products, see Through-Bore Diverter System (TDS), Dec. 2007 (10 pages).
Weatherford, Liner Hanger Selection, A Guide for Drilling and Completion Engineers, 1st ed. May 2006, © 2006 Weatherford (24 pages).
Nodeco, A Weatherford Company, Liner Hanger Systems, Brochure No. 95.00, 1997, Weatherford/Lamb, Inc. (24 pages).
United Wellhead Services, Inc., UWS Products and Services Catalog, 2001 (24 pages).
Joy Petroleum Equipment, Larkin Well Heads, Catalog No. 60-77, ©1977 Joy Manufacturing Company (12 pages).
Weatherford®, Multilaterals No Longer Impossible From Floating Rigs, ©1999 Weatherford (1 page).
Williams Tool Company Inc., Riser Cap, 1999 (1 page).
Weatherford, Underbalanced Drilling Downhole Deployment Valve, Weatherford Underbalanced Systems, Jun. 21, 2002, © Weatherford International, Inc. (28 page).
Weatherford, Accessory Equipment, Weatherford Underbalanced Systems, Jun. 21, 2002, © Weatherford International, Inc. (also appears in "BB" above) (1 page).
GE Oil & Gas website, Multibowl Systems, printed May 7, 2008, corresponding website http://www.gepower.com/business/ge_oilandgas/en/prod_serv/systems/surface_drilling/m..., © General Electric Company 1997-2007, see reference "K" above (1 page).
Email dated Oct. 26, 2007; Title: DDV Wellhead System (3 pages).
T3 Energy Services website, T-3 Thru Diverter System (TDS-1) Wellhead, printed May 5, 2009 (2 pages).

* cited by examiner

FIG. 23
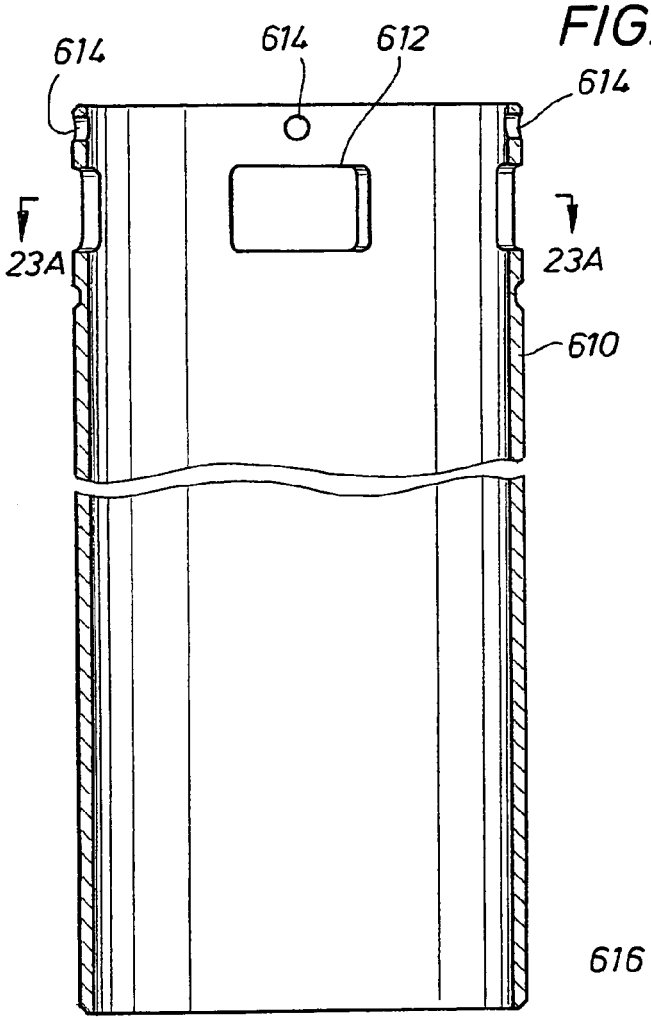
FIG. 24
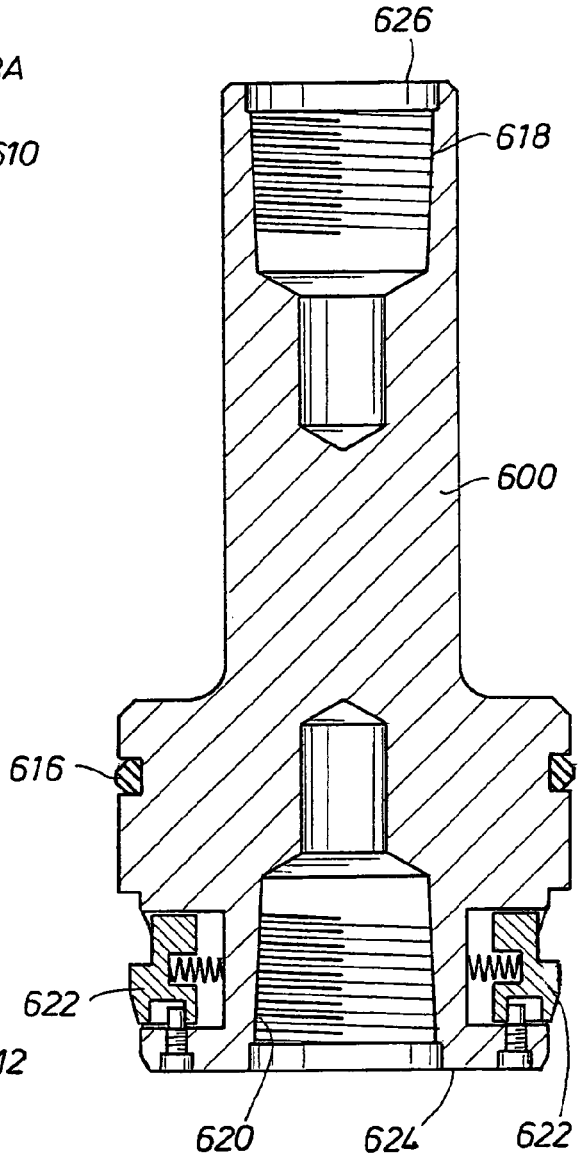
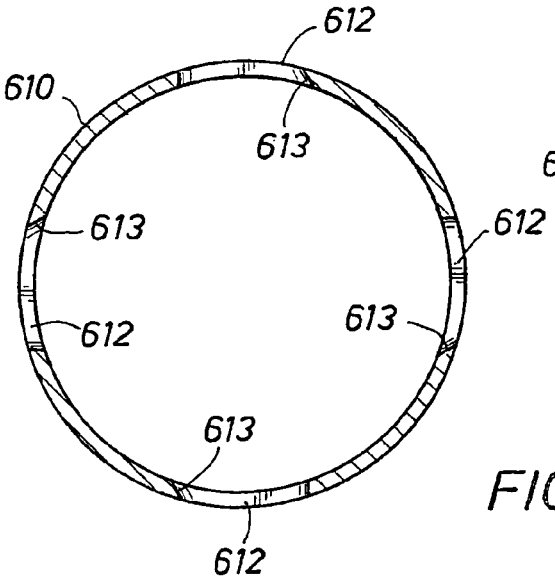
FIG. 23A

THRU DIVERTER WELLHEAD WITH DIRECT CONNECTING DOWNHOLE CONTROL

CROSS-REFERENCE TO RELATED APPLICATIONS

This application is a continuation-in-part of co-pending U.S. application Ser. No. 11/941,179 filed on Nov. 16, 2007, which claims the benefit of U.S. Provisional Application No. 60/867,476 filed on Nov. 28, 2006, both of which applications are hereby incorporated by reference for all purposes in their entirety.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

The present invention relates to oil field downhole tools and wellhead equipment.

2. Description of the Related Art

Oil field wells are typically controlled by a "stack" of equipment for supporting downhole "strings" of tubulars, such as casing and tubing, valves, and other equipment to manage the drilling and production pressurized fluids in a well. A "conductor" pipe or casing is generally the first string of casing placed in the open hole to prevent the soil formations near the surface from caving in. An initial "surface" casing is the first string of casing that is placed in a well after the conductor. A wellhead typically sits on top of a base plate mounted on the conductor and provides controlled access to the wellbore during drilling and production. Various spools, a tubing head, and valves can be assembled thereto. As the wellbore depth increases, additional smaller casings can be placed inside the surface casing to extend to the deeper portions of the well. The additional casings are supported in the stack by supporting surfaces in the wellhead, a casing hanger held in the wellhead, and/or a casing spool mounted to the wellhead.

When the well is completed at a certain depth and cement is placed around the outer surface of the casing, production tubing is installed to the desired production depth in a similar arrangement by supporting the tubing from a tubing hanger in the wellhead. A blowout preventer ("BOP") is usually installed in the stack to control the well if an overpressure condition occurs. In the past, the stack and particularly the BOP were disassembled for access to the wellbore to place another size casing or tubing. The system needed to be pressure tested after each reassembly, costing significant expense and time. Also, because the wellbore could have significant pressure during the interim access without the blowout preventer, the disassembly and reassembly was hazardous.

Over the last 100 years, the improvements in the drilling and production systems typically have been small, incremental adjustments to satisfy specific needs as deeper wells were drilled and produced sometimes with higher pressures, faster drilling, less disassembly and assembly, and other improvements. One improvement in recent years is a "unitized" wellhead. The unitized wellhead facilitates using different sizes of casing and tubing without having to disassemble major portions of the stack or remove the blowout preventer. One such unitized wellhead is available from T3 Energy Services, Inc. of Houston, Tex., USA. The assembled unitized wellhead includes a lower casing head and an upper casing spool that are coupled together and installed as a single unit. As smaller sizes of casing strings are needed, different casing hangers can be progressively cascaded and installed within the bore of the unitized wellhead for supporting the casing stings without removing the BOP. When a casing is set and cemented in place, a support pack-off bushing can be installed above the casing hanger to both seal the annulus below the casing hanger and the wellhead flanges, and create a landing shoulder for the tubing hanger. A tubing head can be installed above the unitized wellhead casing spool to house the tubing hanger.

Another improvement in recent years is the "thru diverter" type wellhead. Such a wellhead allows for lower cost drilling on smaller or marginal formations. A thru diverter wellhead is particularly useful in "batch drilling," which makes efficient use of a larger more expensive drilling rig to drill a number of wells. In batch drilling, after the drilling of a well is completed, the well may be capped, and the rig moved to another well location. The wells can be completed later by smaller more economical rigs.

There are several limitations with the existing thru diverter type wellheads. Although the wellheads may be placed in some larger diverters, there is minimal clearance since there are numerous housings and other protrusions typically welded to the wellhead's exterior surface. Further, the exterior surfaces of the wellheads are uneven and non-uniform. Thus, the size of the wellhead that will move thru the diverter is limited. The wellheads will not fit at all in some smaller diverter housings. Further, such limited size wellheads only allow for the positioning of a single casing hanger with a single casing string.

There are also challenges to placement and operation of existing thru diverter type wellheads. There may be external threads on the exterior surface of the wellhead for attachment of the wellhead with other components of the stack. Further, there may be a groove on the exterior surface of the wellhead and a seal for sealing with other components of the stack. The seal, thread and/or the groove may be damaged either during placement of the wellhead or during an operation. An undamaged seal, thread and groove are necessary for the wellhead to maintain its maximum rated pressure after assembly of the stack. Damage to the seal, thread and/or groove will likely not be discovered until after the wellhead is permanently cemented in place with the wellbore, making replacement of the wellhead, at best, difficult. Time consuming and expensive field work may be needed to repair the damaged seal, thread and/or groove, with resulting lost time. The maximum pressure that the wellhead system may maintain may be compromised if a complete repair cannot be made. For example, if the groove cannot be completely repaired, then a lower pressure rated annular seal may be need to be used, which may lower the maximum rated pressure for the wellhead. The result may be a compromised plan for the well.

To protect the interior surface of the existing thru diverter wellhead during cementing and drilling operations, a removable protective sleeve has been positioned within the wellhead, which results in the loss of valuable rig time. Otherwise, cement or drilling fluid contaminants such as sand, rock and/or debris may damage the wellhead. Further, in some operations, there is an unmet need to bring tubulars, such as 4½ inch (11.4 cm) diameter casing or liners, completely back to the surface without disassembling the BOP stack. This would help solve some geological based drilling problems, as well as minimize rig time and mitigate a safety issue, as discussed above.

Another recent improvement in drilling involves the method of counteracting downhole pressures. In the past, drilling has been accomplished by providing a drilling fluid "mud" to weigh down and counteract fluids in the wellbore sometimes with large upward pressures. The weighted mud is pumped downhole while drilling occurs, so that the wellbore pressure is controlled. By controlling the well fluids from rising to the surface, difficult and hazardous conditions are mitigated. However, using such mud increases costs and drilling time, and can counterproductively damage the hydrocarbon formation that is to be produced. Improvements have been made in drilling by reducing use of the mud through techniques sometimes referred to as "underbalanced drilling" and "managed pressure drilling." The drilling can proceed with less heavy mud and the drilling is typically faster with less down time.

A "downhole deployment valve" has been inserted down the wellbore in the past as a type of one-way check valve attached to the casing to block the downhole well fluids under pressure from escaping up through the casing. The downhole deployment valve is typically set at a certain depth and remains at that depth while drilling continues to greater depths. The drill pipe, bit, and other drill assembly devices are sized to be inserted through the downhole deployment valve to drill the wellbore. When the drill string is removed back through the downhole deployment valve, the downhole deployment valve can be closed to seal the downhole fluids. Therefore, when the drill bit is changed or the drill string is otherwise "tripped," the operation can be done easier and generally safer because the casing above the downhole deployment valve can be vented to atmosphere while the pressurized fluids are controlled by the downhole deployment valve. Hydraulic control lines from the surface wellhead allow the pressurization of hydraulic fluid downhole to open and close the downhole deployment valve. Therefore, the control lines are used to remotely and selectively control the operation of the downhole deployment valve.

While the downhole deployment valve has been deemed an improvement, there have been challenges with protecting the integrity of the flow of the hydraulic fluid in the control lines for controlling the downhole deployment valve. Typically, the hydraulic fluid must move through the wellhead in fluid passageways from ports at the exterior surface of the wellhead to corresponding ports at the wellhead's interior surface. In past installations, the downhole deployment valve is typically coupled or strapped to a section of casing and a casing hanger is installed on the opposite end of the casing. Control lines are run from the downhole deployment valve up to hydraulic ports on the bottom of the casing hanger. Fluid passageways in the casing hanger allow fluid communication between respective ports on the bottom of the hanger and ports on the side of the hanger.

The downhole deployment valve, casing, and casing hanger are lowered into the wellhead, until the casing hanger sits on an internal shoulder of the wellhead. U.S. Pat. No. 6,244,348 proposes a tubing hanger with an internal passageway for conveying fluids with a port on a mating surface for sealing with the internal wellhead seal surface, with a check valve positioned within the hanger port to interface with the internal wellhead seal surface. The hydraulic fluid is transported through the wellhead in a passageway for conveying fluids. U.S. Pat. No. 4,623,020 proposes a tubular body with a passageway for conveying fluids with a port on an exterior sealing surface to form a slidable fluid seal with the interior surface of a wellhead adapter member that also has a fluid passageway, which member is provided with a number of elastomeric seals spaced annularly around its interior surface. In practice, the seals, which are located near where the hanger side port interfaces with the port on the interior surface of the wellhead, leak due to the sand, rock, and other debris and contaminants in the drilling fluid passing through the wellhead and wellbore from the drilling operations. The ports and hydraulic fluid can be contaminated and cause control issues with the downhole deployment valve. The control lines can also be compromised from external forces. In addition, equipment can impact the control lines, operators may unintentionally step on the control lines, and other physical damage can occur to the control lines that can render the system inoperative and potentially hazardous to operators nearby.

Pub. No. U.S. 2004/0079532 proposes a single bowl casing head that has one or more access openings or side bores through its sidewall for placement of a single hydraulic line in each opening. The casing head proposed in the '532 publication only allows for the positioning of one casing hanger.

The above discussed U.S. Pat. Nos. 4,623,020 and 6,244,348; and Pub. No. U.S. 2004/0079532 are hereby incorporated by reference for all purposes in their entirety.

There remains a need for a thru diverter type wellhead that allows for the direct coupling of hydraulic control lines and related system to operate a downhole deployment valve and other downhole tools. It would be desirable to run the wellhead thru the diverter without housings and other protrusions extending from the exterior surface of the wellhead during installation so as to increase the size of the wellhead that may be moved relative to the diverter. It would further be desirable for such a wellhead to accommodate more than one casing hanger and casing string, and allow for tubulars to be brought back to the surface without disassembling the BOP stack. It would also be desirable to eliminate the need for a tubing head in certain circumstances. It would also be desirable to have a system and method that would protect the wellhead during its placement and operation. It would further be desirable to eliminate the need to install a temporary protective sleeve in wellhead during certain cementing and drilling operations.

BRIEF SUMMARY OF THE INVENTION

A method and system are provided for positioning a wellhead in a diverter housing over the wellbore. Protrusions on the exterior surface of the wellhead are not initially installed or are removed before moving the wellhead thru the diverter. An overshot running tool may be used to place the wellhead while protecting the wellhead exterior and interior surfaces, grooves, threads, and seals. The overshot running tool allows for operations, such as drilling and cementing, after the wellhead is positioned with the wellbore, but before the running tool is removed. After the diverter is removed, an alignment pin housing may be attached with the wellhead, and an alignment pin used during the positioning or seating of the hanger to align the hanger side ports with the access openings in the wellhead for coupling of hydraulic control lines to the hanger. Hydraulic control lines may extend from the hanger to outside the wellhead and between the hanger and hydraulically operated tools. Other housings, such as those containing retainer pins, may also be attached with the wellhead after the diverter is removed. In one embodiment, the wellhead may be a single bowl that allows for the positioning of one hanger therein. In another embodiment, the wellhead may be an assembled "unitized" multi-bowl that allows for the positioning of two hangers therein. The hangers and tubulars may be positioned either from above or below the wellhead without removal of the BOP stack. Alternatively, the multi-bowl wellhead may be monolithic. The multi-bowl wellhead eliminates the need for a tubing head in certain circumstances.

BRIEF DESCRIPTION OF THE DRAWINGS

While the concepts provided herein are susceptible to various modifications and alternative forms, only a few specific embodiments have been shown by way of example in the drawings and are described in detail below. The figures and detailed descriptions of these specific embodiments are not intended to limit the breadth or scope of the concepts or the appended claims in any manner. Rather, the figures and detailed written descriptions are provided to illustrate the concepts to a person of ordinary skill in the art as required by 35 U.S.C. §112. A better understanding of the present invention can be obtained with the following detailed descriptions of the various disclosed embodiments in the drawings:

FIG. 23 is a broken section elevational view of the protective sleeve as shown in FIG. 22.

FIG. 23A is a section view taken along line 23A-23A of FIG. 23 to better illustrate the angled surface of the rectangular openings in the protective sleeve.

FIG. 24 is a section elevational view of the combination running tool as shown in FIGS. 21 and 22.

DETAILED DESCRIPTION OF THE INVENTION

Figure 1:
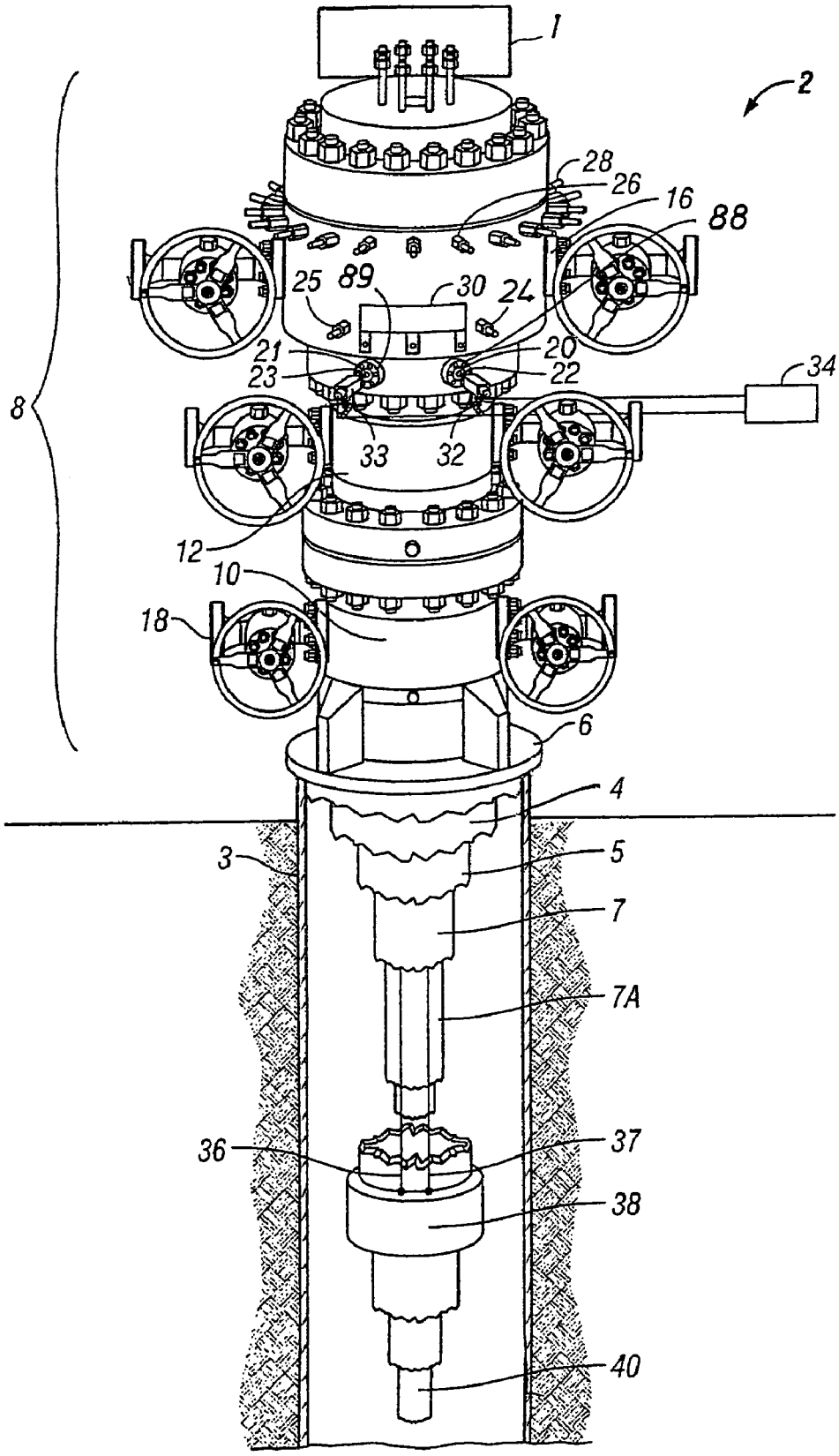
FIG. 1 is an elevational view of a wellhead system located above a wellbore having direct coupling hydraulic lines for coupling with a hanger thru a drilling wellhead.

FIG. 1 is a schematic diagram of a wellhead system located above a wellbore 3 having a direct coupling hydraulic line through a drilling wellhead to a hanger. The wellhead system 2 generally includes a drilling wellhead, a hanger, and other equipment as may be generally used in such systems, and further includes various openings and ports for directly coupling the hydraulic lines through the wellhead into the hanger, as discussed in detail below. In at least one embodiment, the wellhead system 2 will generally be mounted above a wellbore 3. The wellbore has a surface casing 4 installed from the surface of the wellbore down to a certain depth. A base plate 6 is mounted to the surface casing and forms the foundation to which the other components are mounted that form a "stack" of wellhead equipment. The wellbore is drilled in successive steps with each step generally being a smaller diameter as the depth progresses. Thus, a casing 5 can be inserted inside the surface casing 4 with a smaller diameter to a given depth. Progressively smaller casings, such as casing 7 and casing 7A, can be further provided at still greater depths. The wellhead 8 contains support structures, generally hangers, to suspend the casing or casings. The wellhead 8 can include in at least one embodiment a casing head 10 and a casing spool 12. Such an arrangement is advantageous when using an assembled unitized wellhead, such as commercially available from T3 Energy Services, Inc. of Houston, Tex., as mentioned above. A blowout preventer (BOP) 1, shown schematically, is mounted above the wellhead 8. A tubing head 16 is mounted above the wellhead 8. The tubing head can support or at least surround a tubing hanger. The tubing hanger can support a suspended string of production tubing inside the one or more casings. Various valves, such as valve 18, pressure gauges, sensors, and other devices can be used in conjunction with the wellhead to provide onsite or remote control of the wellhead system.

More specific to the present invention, the wellhead can include at least one access opening 20 and in some embodiments a second access opening 21. A sealing member, such as sealing flange 88 can be coupled to the opening 20 and a corresponding sealing member, such as flange 89, can be coupled to the opening 21. The flanges, preferably bolted to the wellhead 8, can provide a pressure-type seal against internal pressures in the wellhead that may exceed 10,000 PSI. A hydraulic line 22 can pass through the opening 20 and generally through the sealing flange 88 to connect with the hanger. Similarly, a hydraulic line 23 can pass through its respective access opening 21 through the flange 89 to be coupled with the hanger. To facilitate alignment between the openings (20, 21) and the appropriate position of the internal hanger, an alignment pin 27, described in detail below, can be disposed through the side wall of the wellhead to align the internal members, such as the hanger. Various leads, such as threaded pins, known as "leads" can support internal members as is customary in the industry. For example, support pack-off bushing leads (24, 25) can support a support pack-off bushing internal to the assembly that assists in isolating pressure from downhole fluids. Similarly, tubing hanger leads 26 can support the tubing hanger internal to the tubing head 16.

The wellhead system 2 can further include one or more test ports 28. The operator may wish to know prior to unsealing the openings (20, 21) whether the system is presently under pressure, or whether there is leakage in the system that would unintentionally place generally unpressurized portions of the system in pressurized conditions. For further safety, one or more protector steps 30 can be disposed at least partially over or around the openings (20, 21) and the associated hydraulic lines to provide a support surface for personnel.

One or more hydraulic valves (32, 33) can be mounted to the respective hydraulic lines (22, 23). The hydraulic valves can control the flow of the hydraulic fluid between the subsurface downhole hydraulic tool and surface control equipment. A surface control unit 34 is generally coupled to the hydraulic control lines to either manually or automatically control a downhole hydraulic tool 38. The downhole hydraulic tool is hydraulically coupled with the hydraulic lines (22, 23) in the wellhead using hydraulic lines (36, 37) disposed downhole to the downhole hydraulic tool 38. An exemplary downhole hydraulic tool 38 can be a downhole deployment valve. The downhole deployment valve provides a check valve to uphole flow of wellbore fluids and enhances the safety of the downhole operations. As described herein, the hydraulic lines (36, 37) can be coupled to a hanger in the wellhead 8 and then coupled to the hydraulic lines (22, 23) without requiring the hydraulic annular seals to maintain hydraulic pressure, referenced above.

Once the drilling is accomplished, a string of production tubing 40 can be placed inside the wellbore through the wellhead system. It is generally supported by a tubing hanger, described below. The tubing hanger is generally disposed in a tubing head, but can be disposed in the casing head 10, the casing spool 12, and similar members coupled thereto.

Figure 2:
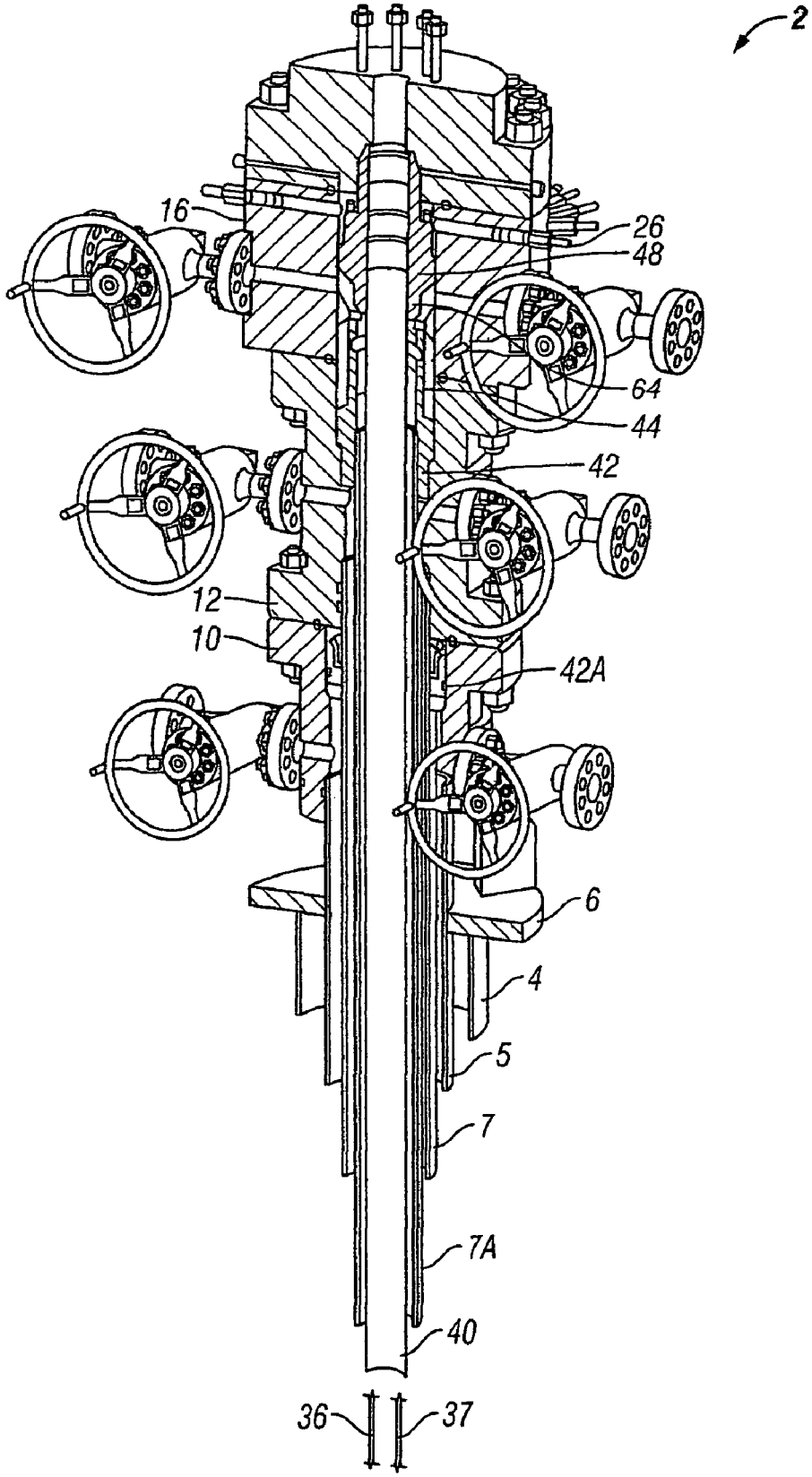
FIG. 2 is a section view of the wellhead system of FIG. 1 illustrating various hangers and tubular members.

FIG. 2 is a cross-sectional schematic diagram of the wellhead system illustrating various hangers and tubular members. The elements in FIG. 2 are similarly numbered as in FIG. 1 and have been described in reference thereto. More particularly, the casing head 10 can be coupled to the base plate 6, sometimes through an intermediate structure, and supports various tubular members therein. For example, the casing head 10 can support a casing 5 coupled to a lower surface of the casing head and one or more smaller casings (7, 7A) coupled to one or more types of casing hangers (42, 42A). When the casings reach the desired depth, a support pack-off bushing 44 can be installed on top of the casing hanger 42 to seal wellbore pressures in the wellhead below the support pack-off bushing. A tubing hanger 48 can be disposed in the tubing head 16, or alternatively in the casing head 10 or the casing spool 12. The tubing hanger 48 can support the production tubing 40 through which the hydrocarbons of the wellbore can be produced into facilities external to the wellhead system 2. The hydraulic lines (36, 37) can be disposed downhole from the wellhead system 2 to connect to the hydraulic tool described in FIG. 1.

Figure 3:
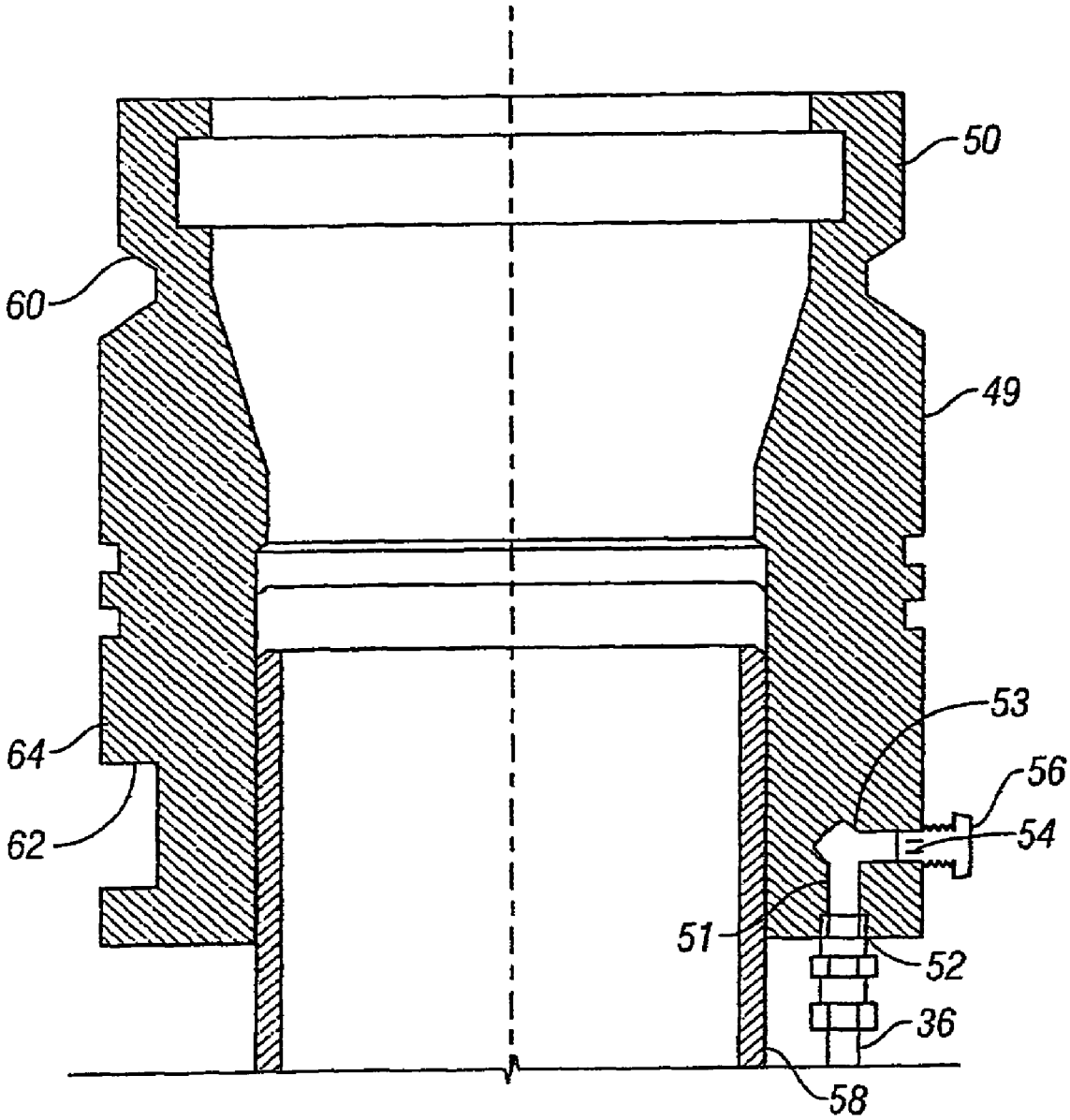
FIG. 3 is an elevational view of a hanger shown in section to better illustrate a hydraulic tool port communicating with a hydraulic side port.
Figure 3A:
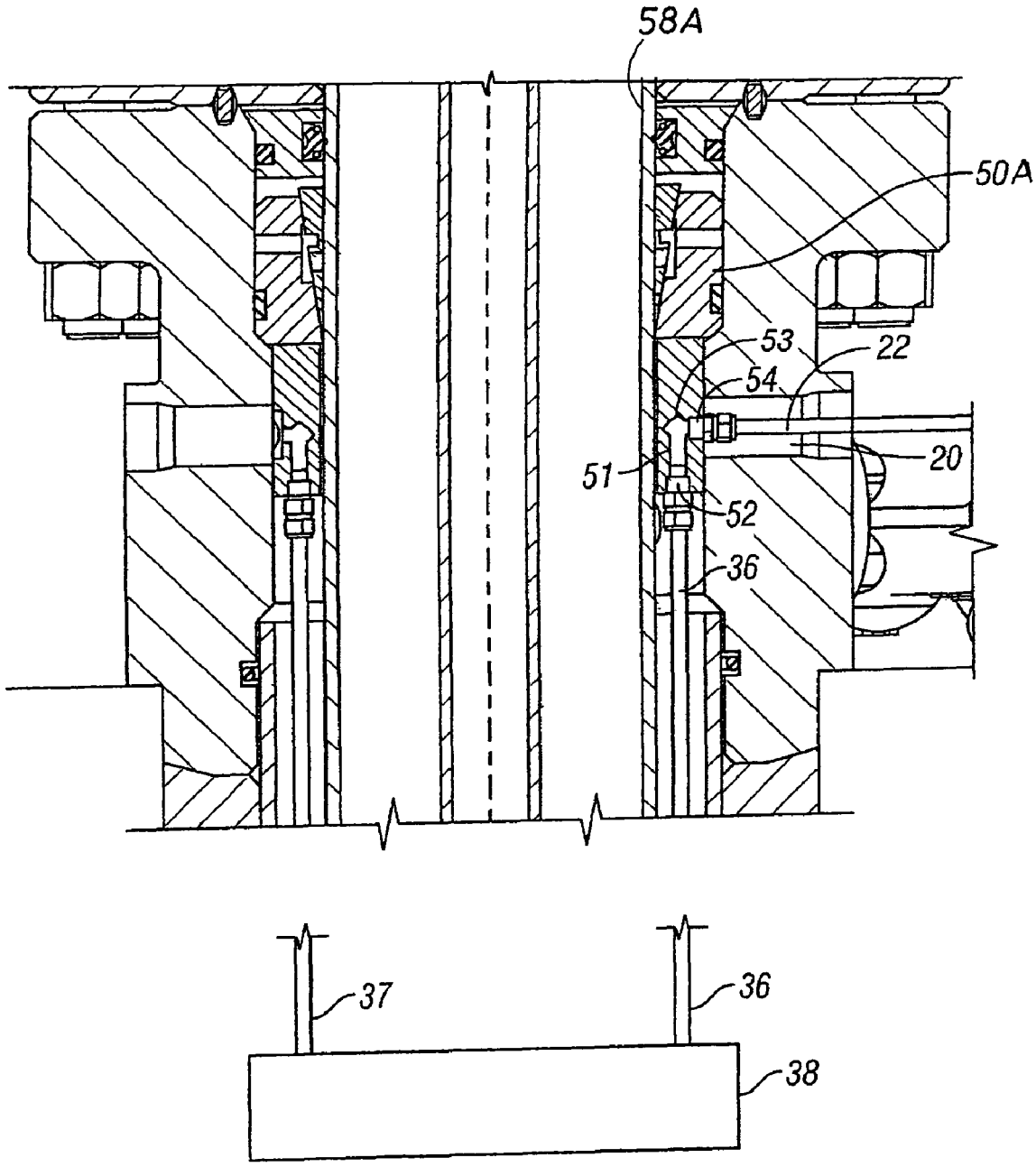
FIG. 3A is an elevational view of a hanger shown in section to better illustrate a hydraulic tool port for coupling a hydraulic line to a downhole hydraulic tool and a hydraulic side port for coupling with a hydraulic line extending outward from the hanger through the wellhead.

FIG. 3 is a cross-sectional schematic diagram of a mandrel hanger 50 with a hydraulic tool port and a hydraulic side port. FIG. 3A is a cross-sectional schematic diagram of a slip hanger 50A with a hydraulic tool port 52 coupled to a hydraulic line 36 to a downhole hydraulic tool 38, and a hydraulic side port 54 coupled to a hydraulic line 22 extending outward from the hanger 50A through the wellhead. The figures will be described in conjunction with each other. A hanger can be any number of styles of hangers commonly used in the oilfield, including casing hanger, tubing hanger, slip hanger 50A (shown in FIG. 3A), fluted hanger, and other hangers as would be familiar to those with ordinary skill in the art. As shown in FIGS. 3 and 3A, tubulars (58, 58A) may be coupled between hangers (50, 50A), respectively, and tool 38. The hanger includes at least one passageway 51 through which hydraulic fluid can flow through the hanger between the hydraulic lines 22 (shown in FIGS. 1, 3A, 5A, 6, 7), 23 (shown in FIGS. 1, 6, 7) at the wellhead and the hydraulic lines (36, 37) (see FIGS. 1, 2, 3, 3A, 5A) extending to the downhole hydraulic tool 38. The passageway 51 provides a conduit to a side 49 (shown in FIG. 3) of the hanger 50. Because of the relative positions of the hydraulic lines mounted to the hanger and the hydraulic lines (22, 23) mounted to the hanger side 49, in at least some embodiments, it is possible that the passageway 51 can extend in a different direction to create a second passageway 53 in the side of the hanger 50 or hanger 50A. In other embodiments, the passageway (51, 53) could represent a single passageway, such as drilled at an angle to the hanger bottom and side so that both surfaces are intersected and the hydraulic lines can be mounted thereto. Where passageways (51, 53) exit the respective surfaces, ports are formed that can be coupled to fittings and other members of the hydraulic system. For example, a hydraulic tool port 52 can be formed on the passageway 51 and can be coupled to one or more couplings, or other fittings to support the connection of the hydraulic line 36 directly to the port 52.

Similarly, a hydraulic side port 54 is formed at the exit of passageway 53 in the side 49. Generally, the hydraulic tool port 52 will be located on the bottom surface of the hanger and the hydraulic side port 54 will be located on the side 49 of the hanger. Thus, generally, the ports will be disposed at an angle to each other. The one or more access openings to the hydraulic side ports are formed to the side of the wellhead and aligned with the hydraulic side ports on the hanger when the hanger is seated in the wellhead. The port 54 as described herein can be coupled directly to a hydraulic line, such as the hydraulic line 22. By "direct," it is intended to include a fluid connection or coupling between a hydraulic line and a port that does not require the annular seals that are used to seal annular zones between the hanger and the internal surfaces of a wellhead.

Advantageously, the system described herein allows the integrity of the hydraulic system to be protected during installation of the hanger 50 into the wellhead 8. For example, as best shown in FIG. 3 a plug 56 can be inserted into an open port, such as side port 54 to protect the hydraulic system from contaminants in the wellhead system caused by the wellbore fluids as the hanger is installed in the wellhead. The lower tool port 52 is protected by being sealingly coupled to the hydraulic line 36 which is in turn sealingly coupled to the downhole hydraulic tool 38, so that the wellbore fluids cannot enter therein. The plug 56 can be removed after the hanger 50 is set in place and aligned with the one or more openings, as described below.

In some embodiments, the side port 54 can be disposed in a skirt 64 of the hanger 50. As best shown in FIG. 3A, the skirt 64 is generally a reduced concentric portion of a hanger as is known to those with ordinary skill in the art. In some hangers, the skirt is situated below a shoulder of the hanger where the shoulder is sized to engage a corresponding landing on the drilling wellhead. An example of such a hanger and skirt is further shown in FIG. 2 of the hanger 42 but is also applicable on other hangers, such as slip hangers, tubing hangers, fluted hangers, and other types of hangers.

The hanger 50 can further include one or more recesses (60, 62) as would be known to those with ordinary skill in the art. The recesses can be used for supporting the hanger in the head with different leads, such as leads (24, 25, 26) as shown together in FIG. 1, leads (24, 25) as shown in FIG. 4, and lead 26 as shown in FIG. 2.

Figure 4:
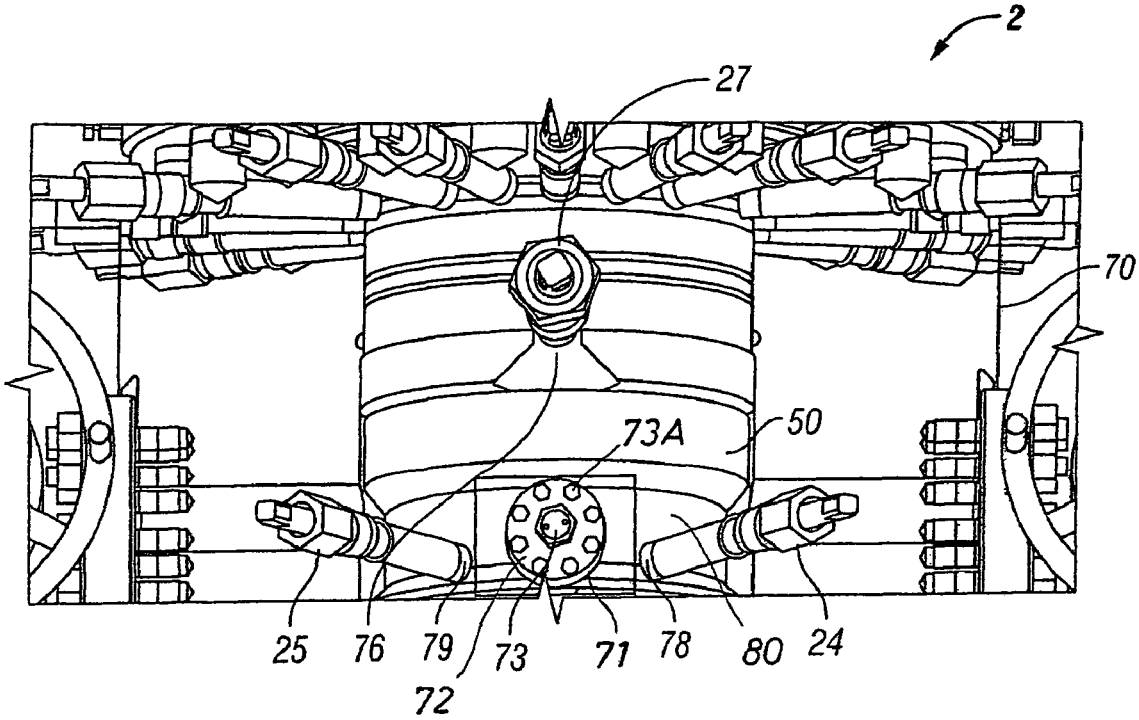
FIG. 4 is a partial sectional schematic view of the wellhead system showing one aligning or locating pin for aligning the hanger and several lockdown screws for locking the hanger with the wellhead and a flange for covering a wellhead access opening.

FIG. 4 is a partial cross-sectional schematic diagram of the wellhead system showing internal details, including one or more alignment or locating pins for aligning the hanger with the wellhead and access openings in the wellhead. The wellhead system 2, as described above, generally includes the hanger 50 over support pack-off bushing 80 disposed internal to the drilling wellhead 70. As discussed above, the hanger 50 can be a number of different and various hangers adapted for the purposes described herein. Thus, the hanger can be used at various locations in the wellhead. Without limitation, therefore, the drilling wellhead 70 is broadly intended to include the various supporting portions of the wellhead described above, including the casing head, casing spool, tubing head and other similar structures as may be useful in supporting the hanger 50 in the wellhead system 2.

One feature of the present invention is the alignment of a hydraulic side port, such as the side port 54 in the hanger 50 shown in FIG. 3, with a respective access opening, such as the access opening 20 shown in FIG. 3A. The alignment allows the external hydraulic line 22, shown in FIG. 3A, to be directly coupled through the wellhead and its opening to the respective side port.

To facilitate such alignment, an alignment pin 27 can be provided in the drilling wellhead 70 to correspondingly mate with an alignment recess 76 (shown in FIGS. 4, 5A) formed in the hanger 50. Thus, as the hanger 50 is seated in its proper position longitudinally in the drilling wellhead 70, the alignment pin 27 can further insure that the hanger is seated rotationally as well. Furthermore, as best shown in FIG. 4, one or more leads (24, 25) can be disposed through the drilling wellhead 70 to engage recesses (78, 79), respectively, if provided.

Staying with FIG. 4, a flange 72 having a fitting 73 is generally coupled to an access opening 71. The access opening 71 can be used as a view port to visually determine the condition of members internal to the wellhead upon removal of flange 72. The flange 72 can be removably coupled, through various fasteners, such as a plurality of bolts similar to bolt 73A, to maintain the integrity of the system during pressurized operations.

Figure 5:
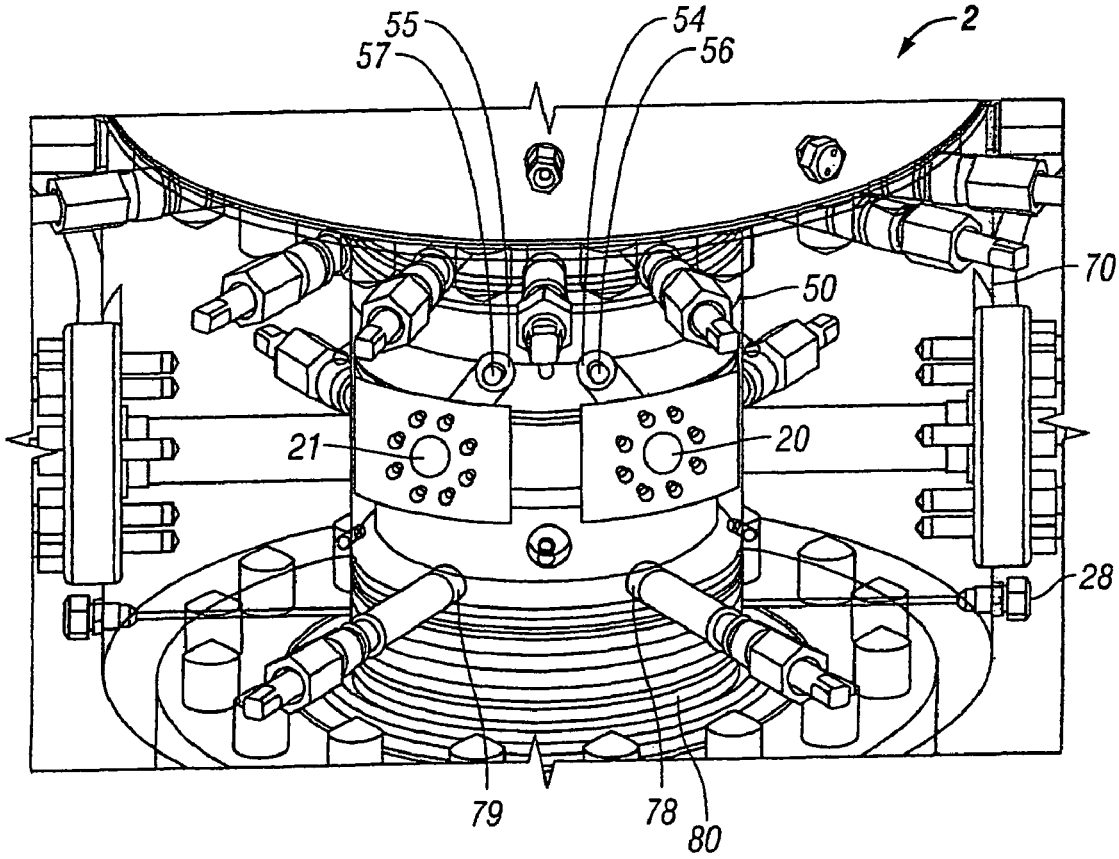
FIG. 5 is a partial sectional view of the wellhead system showing the hanger in the wellhead and two hydraulic side ports aligned with additional access openings in the wellhead.
Figure 5A:
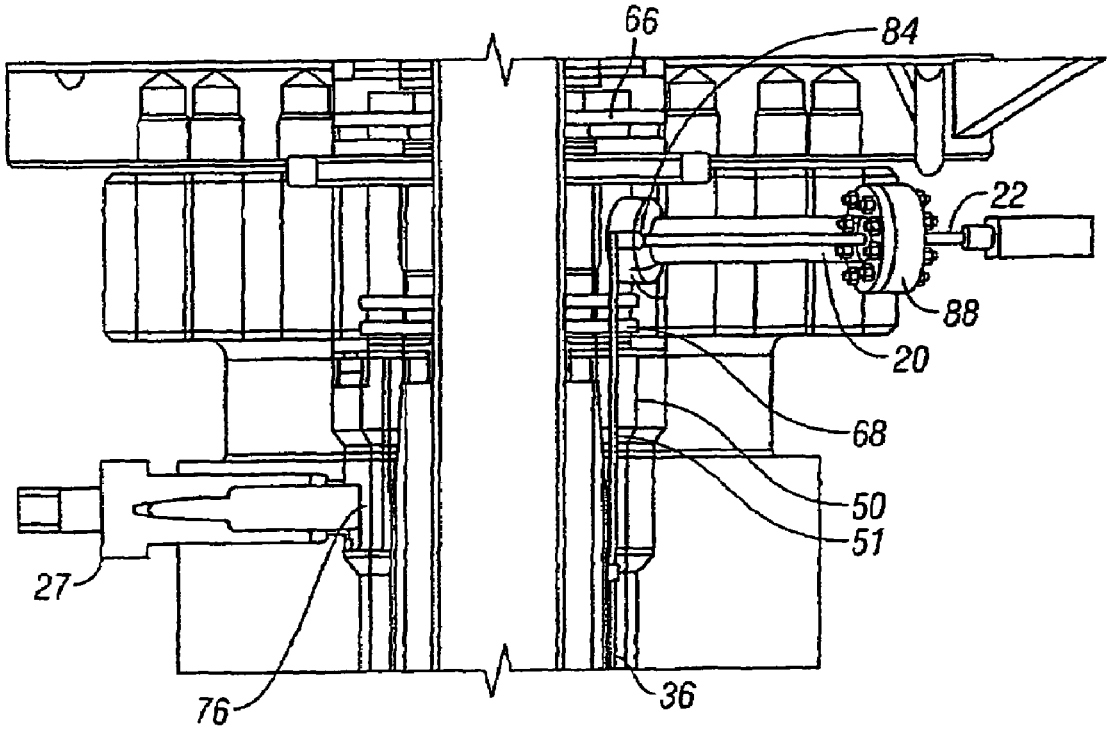
FIG. 5A is a sectional view illustrating annular isolation seals above and below a hydraulic side port.

FIG. 5 is a partial cross-sectional schematic diagram of the wellhead system showing the hanger internal to the wellhead and the hydraulic side ports aligned with the access openings in the wellhead. FIG. 5A is a cross-sectional schematic diagram illustrating isolation seals above and below the hydraulic side ports. The figures will be described in conjunction with each other and illustrate the access openings without a flange, described below, that provide access to one or more side ports of the hanger 50. The wellhead system 2 generally includes the hanger 50 set into position in the drilling wellhead 70. The hanger 50 is aligned with the drilling wellhead 70, so that the ports (54, 55) are aligned with the respective openings (20, 21). This embodiment illustrates two openings (20, 21) that can be aligned with two side ports (54, 55). The number of openings can vary. For example, the system can include one side port and one access opening, one access opening and multiple side ports that are accessed through the one access opening, or a plurality of access openings aligned with a plurality of side ports, such as shown.

As described herein, during the initial phase where the hanger 50 is installed over the support pack-off bushing 80 in the drilling wellhead 70, the ports (54, 55) can be protected with respective plugs (56, 57) inserted therein to keep contaminants from entering the hydraulic passageways. When aligned with the openings (20, 21), the protective plugs (56, 57) can be manually removed from the side ports (54, 55) to open the hydraulic passageways and prepare for inserting and coupling the hydraulic lines thereto. One or more isolation seals (66, 68), shown in FIG. 5A, can seal the annulus region of the wellhead above and below the hydraulic side ports. The isolation can allow the access openings to be accessed even when the bore is under pressure.

A further safety feature can include a test port 28 that can be disposed on the downstream portion of the support pack-off bushing from the wellbore. Thus, if there is a leak above the support pack-off bushing, an operator can be warned prior to opening the access openings (20, 21).

Figure 6:
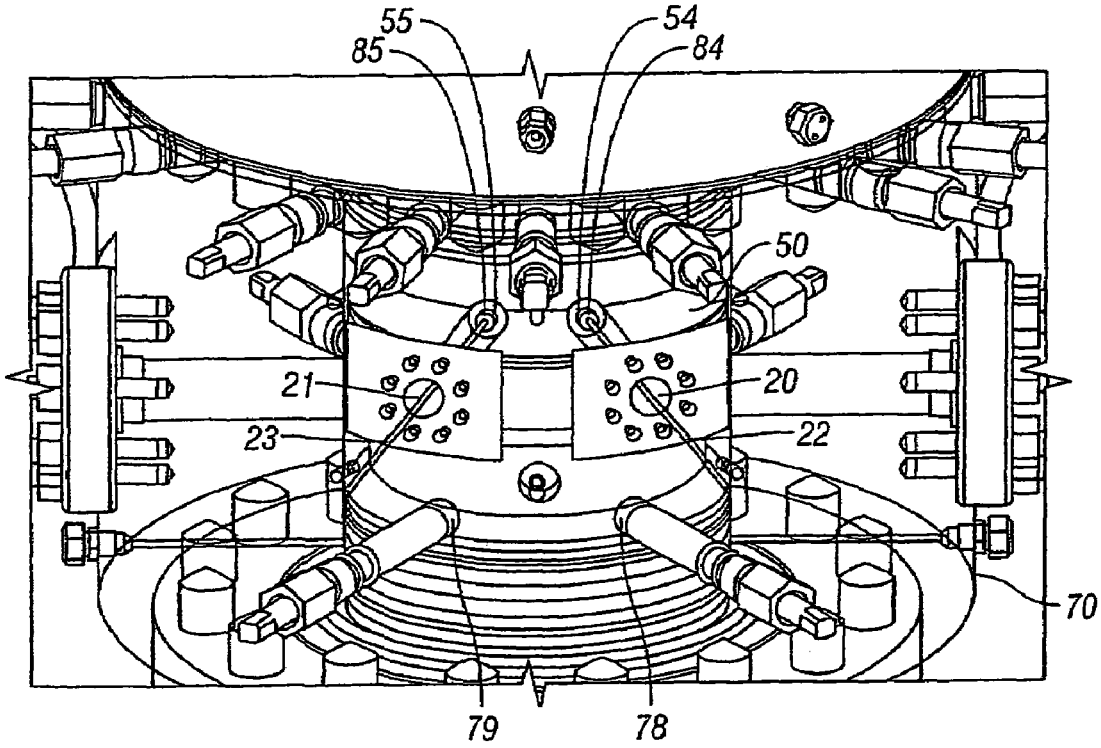
FIG. 6 is a partial sectional view of the wellhead system showing the hydraulic lines directly coupled through their respective access openings to their respective hanger hydraulic side ports.

FIG. 6 is a partial cross-sectional schematic diagram of the wellhead system showing the hydraulic lines directly coupled through the access openings to the hydraulic side ports of the hanger. With the side ports (54, 55) aligned with the respective openings (20, 21), the one or more respective hydraulic lines (22, 23) can be inserted through the openings (20, 21) and be directly coupled with the side ports (54, 55). The coupling of the hydraulic lines (22, 23) can be made with the connectors (84, 85), respectively. The connectors (84, 85) can include suitable hydraulic line connectors such as flared couplings and other connectors, fittings, or even valves for the pressurized hydraulic applications.

Thus, the integrity of the hydraulic system is maintained during the installation of the hanger 50 in the drilling wellhead 70. The hydraulic side ports are only exposed to ambient conditions when the hanger is seated in position and a direct coupling to the hydraulic port can be made.

Figure 7:
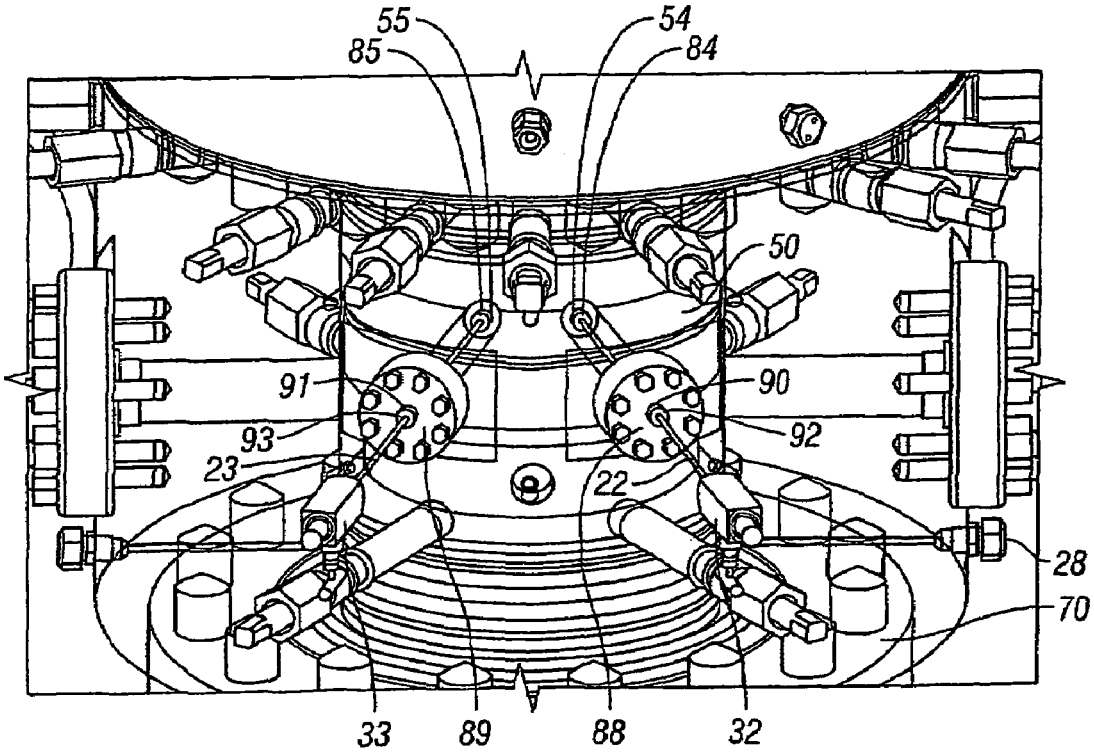
FIG. 7 is a partial sectional view of the wellhead system showing the hydraulic lines directly coupled to their respective hanger side ports and sealed with their respective flanges.

FIG. 7 is a partial cross-sectional schematic diagram of the wellhead system showing the hydraulic lines directly coupled to the side ports through sealed connectors. The openings (20, 21) are generally sealed with flanges (88, 89), respectively. The flanges, preferably bolted to the wellhead 70, can provide the strength and integrity to the system for the large pressures and conditions that can be encountered in drilling the wellbore. The flanges (88, 89) can be machined, so that a metallic seal is formed between the openings (20, 21) of the wellhead 70 and the flanges. The flanges (88, 89) can have one or more flange openings (90, 91) formed therethrough. The openings (90, 91) allow the hydraulic lines (22, 23) to protrude through the flanges. In some embodiments, the hydraulic line passing through the openings (90, 91) can be continuous without break for connections. In other embodiments, there can be an intermediate connection, such as at the flange. Generally, the openings (90, 91) would be sealed, so that pressure within the wellhead does not escape through the flanges (88, 89). Thus, flange connectors (92, 93) can be inserted over the hydraulic lines (22, 23) and engage the openings (90, 91) to form a seal between the openings and the hydraulic lines.

Further assembly of the hydraulic system can be performed. For example, one or more control valves (32, 33) can be coupled to the respective hydraulic lines (22, 23). The control valves can then be coupled to additional hydraulic lines that can couple to various control mechanisms, such as the surface control unit 34 described in reference to FIG. 1.

Advantageously, an additional safety feature can be an indicator on the head indicating an open and close control of the downhole hydraulic tool. For example, a green colored flange 88 could indicate that the hydraulic line 22 is used to open the downhole hydraulic tool. A red colored flange 89 could indicate that the hydraulic line 23 is used to close the downhole hydraulic tool.

Figure 8:
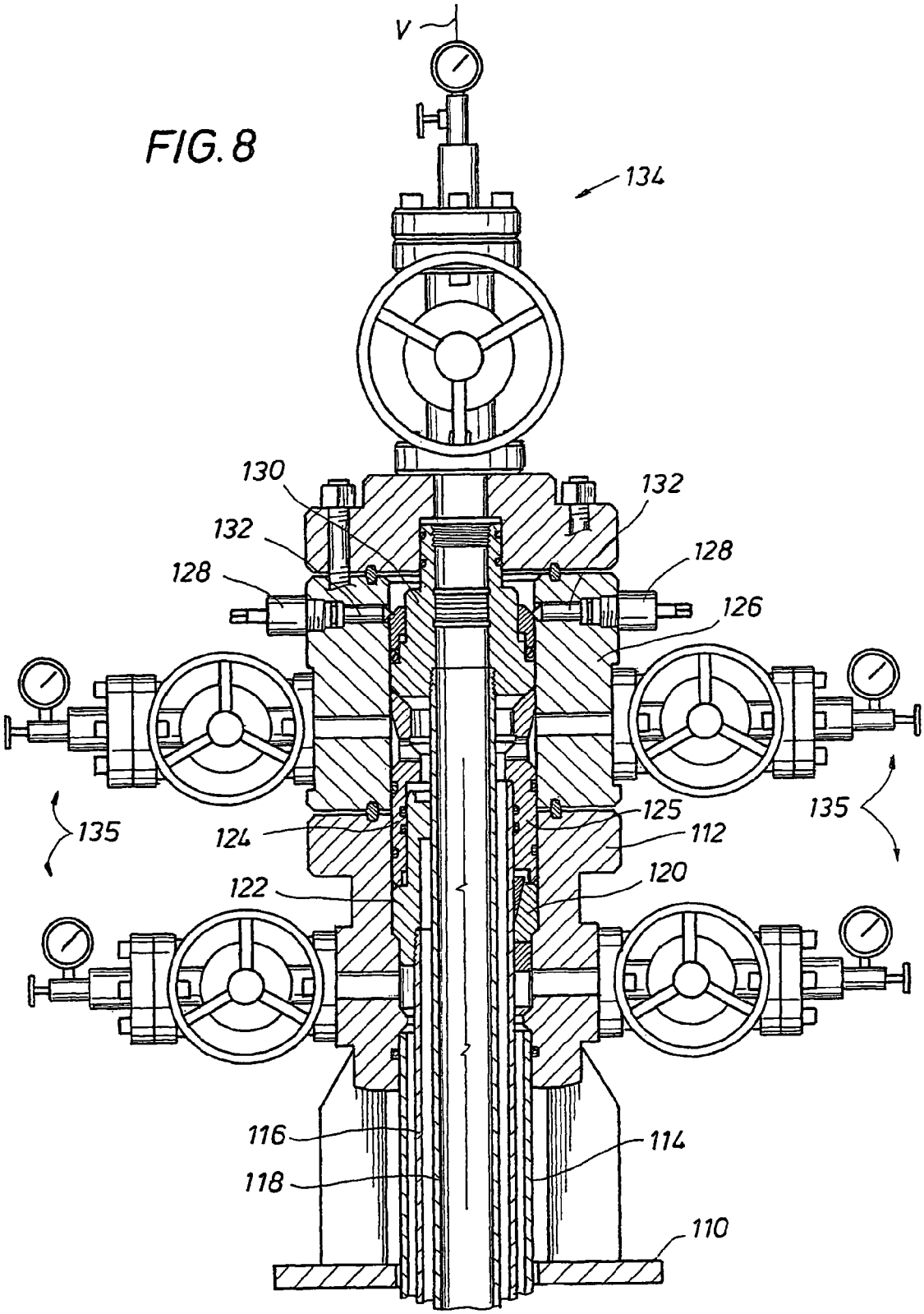
FIG. 8 is a partial section elevational view of a wellhead mounted over a base plate and a wellhead tubular, a split view illustrates a lower mandrel hanger on the left side and a slip hanger on the right side for suspending a lower hanger tubular, a casing spool over the wellhead having an upper mandrel hanger above a support pack-off bushing for suspending an upper mandrel hanger tubular therefrom.

Turning to FIG. 8, casing head 112 is mounted over wellhead tubular 114 and base plate 110. Wellhead tubular 114 may be a surface casing. Casing spool 126 is mounted over casing head 112. Casing head 112 is a single bowl in that only one casing hanger may be positioned within it. Lower mandrel hanger 122 is illustrated on the left side of the vertical axis V, and slip hanger 120 is illustrated on the right side. Lower hanger tubular 116 is suspended in each hanger. Support pack-off bushing 124 is illustrated positioned on lower mandrel hanger 122 on the left side of the vertical axis V, and support pack-off bushing 125 is illustrated positioned on slip hanger 120 on the right side. Upper mandrel hanger 130 in casing spool 126 is supported on support pack-off bushing (124, 125). Upper hanger tubular 118 is suspended from upper mandrel hanger 130.

Packing nuts 128 with retainer pins 132 are attached to casing spool 126 using V-type threads. Such V-type threads are not fabricated for sealing against high internal pressures. Retainer pins 132 are inserted into casing spool 126 to prevent upward movement of upper mandrel hanger 130. As can now be understood, casing head 112 and casing spool 126 assembled together form a "unitized" wellhead. Valves, gauges and tubulars, shown generally as 134, are attached to the top of the wellhead. Valves, gauges and conduits, shown generally as 135, are attached to the side of the wellhead. As used herein throughout, the terms "wellhead" or "drilling wellhead" may be used interchangeably with "casing head," "casing spool," "tubing head," or any assembled combination thereof, or any other structure used to support hangers. Further, the term "tubular" may be used interchangeably with "tubular string."

Figure 9:
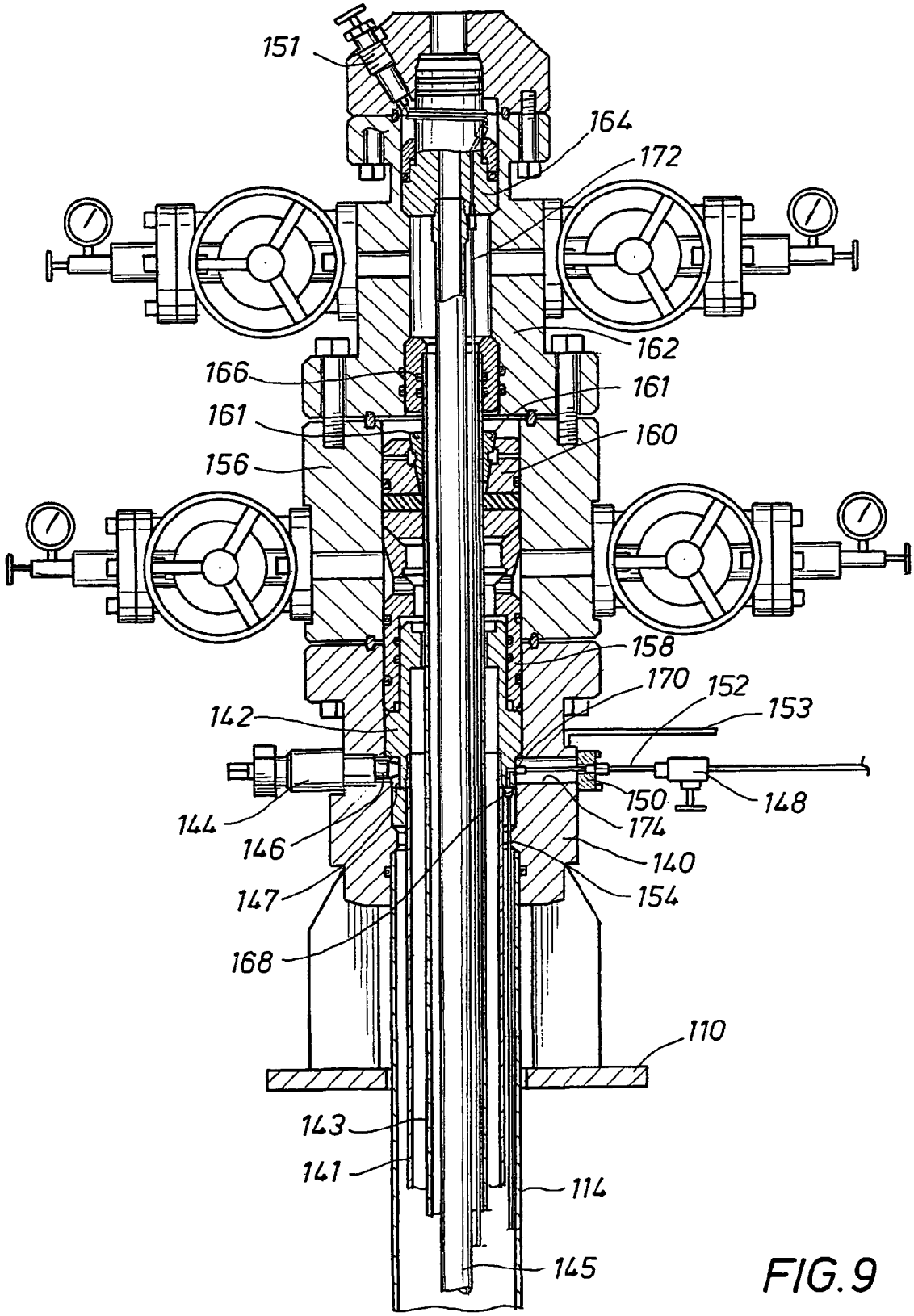
FIG. 9 is a partial section elevational view of a wellhead mounted over a base plate and a wellhead tubular with a mandrel casing hanger with a tool tubular suspended therefrom and an alignment pin on the left side and a side hydraulic line on the right side extending through a flange and connected to a hanger side port, a tool hydraulic line coupled to the hanger tool port, a casing spool over the wellhead, with a slip hanger above a support pack-off bushing and a slip hanger tubular suspended in the slip hanger, a tubing head over the casing spool, with a mandrel tubing hanger cutaway section view with a tubing hanger tubular.
Figure 15:
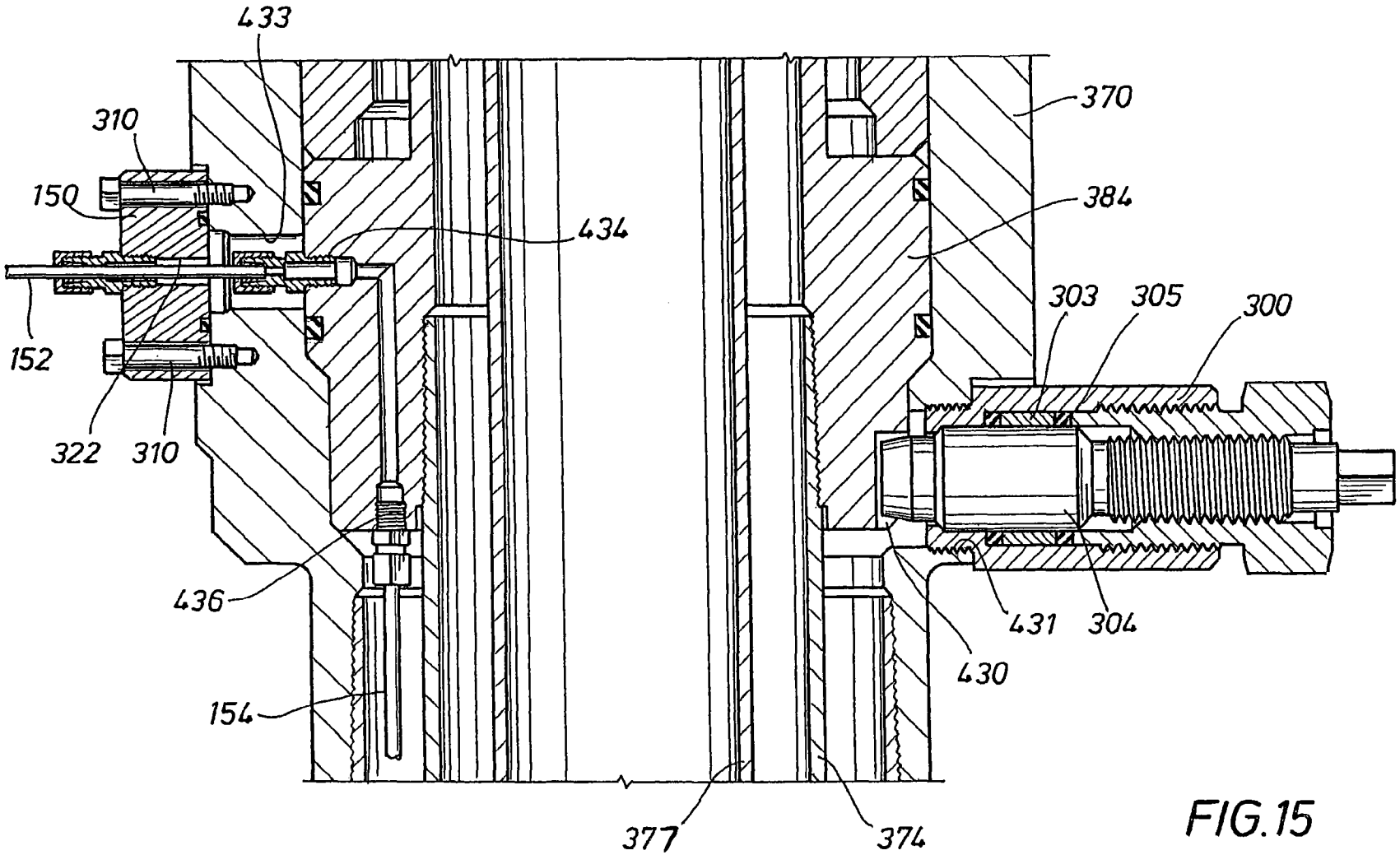
FIG. 15 is an enlarged section elevational view taken along line 15-15 of FIG. 12 showing a flange bolted to the wellhead, a side hydraulic line extending through the flange and the access opening in the wellhead and coupled with the side port of the mandrel hanger, and a tool hydraulic line connected with the bottom tool port of the hanger, and an alignment pin housing threadably coupled with the wellhead, and an alignment pin in the extended position with the pin's end in an alignment slot in the hanger.

FIG. 9 shows casing head 140 mounted over wellhead tubular 114 and base plate 110. Casing spool 156 is mounted over casing head 140, and tubing head 162 is mounted over casing spool 156. Casing head 140 is a single bowl. Lower or mandrel casing hanger 142 is positioned on an internal shoulder in casing head 140 and supports tool tubular 141. Alignment pin housing 144 is welded to casing head 140. Alignment slot 147 in mandrel casing hanger 142 is positioned to receive one end of alignment pin 146. Alignment pin 146 insures that hanger side port 170 is properly aligned with access opening or side bore 174 when mandrel hanger 142 is positioned within casing head 140. Side hydraulic line 152 extends through needle valve 148 and an opening in sealing flange or flange 150 and is coupled with hanger side port 170. An enlarged detail of similar components is shown in FIG. 15, as will be discussed below. It is contemplated that a bull plug housing, such as disclosed in Pub. No. US 2004/0079532, may be used instead of flange 150. Returning to FIG. 9, protector step 153, similar to protector step 30 as shown in FIG. 1, is disposed over side bore 174 and side hydraulic line 152 to provide a support surface for personnel.

One end of tool hydraulic line 154 is coupled with hanger tool port 168. The other end of tool hydraulic line 154 may be coupled with a downhole deployment valve or other downhole tool (not shown). Support pack-off bushing 158 is positioned on mandrel casing hanger 142, and supports slip hanger 160 in casing spool 156 with slips 161 gripping slip hanger tubular 143. Reducer bushing 166 in tubing head 162 is positioned on one end of slip hanger tubular 143. Upper mandrel hanger or mandrel tubing hanger 164 in tubing head 162 supports tubing hanger tubular 145. Tubular 145 may be production tubing. Hydraulic line 172 with one end extending above tubing head 162 to valve 151 may be coupled at the other end with a downhole safety valve (not shown), such as proposed in U.S. Pat. No. 5,465,794, which is hereby incorporated by reference for all purposes in its entirety. As can now be understood, casing head 140 and casing spool 156 assembled together form a "unitized" wellhead.

Figure 10:
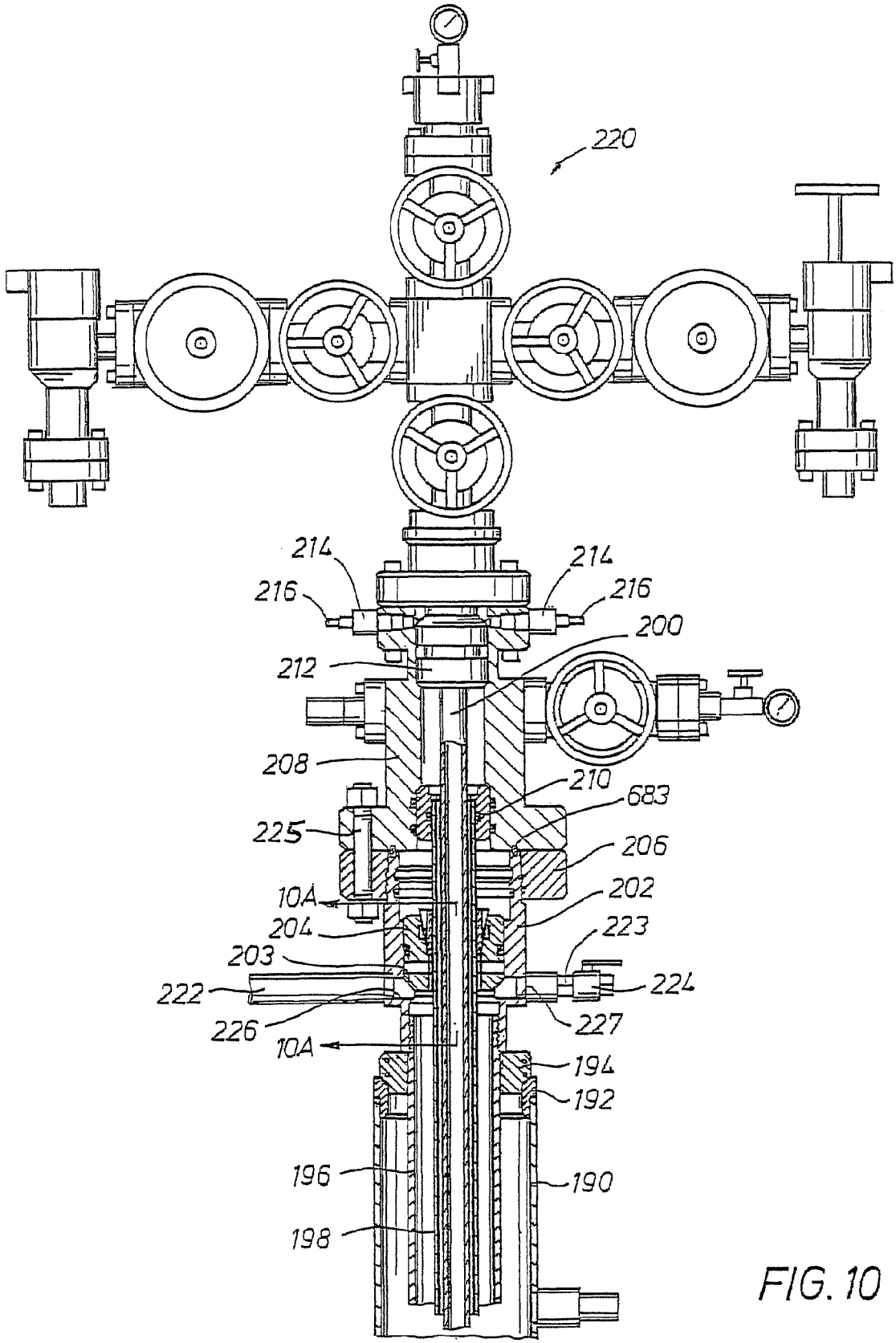
FIG. 10 is a partial section elevational view of a landing ring mounted on a wellbore tubular, a support ring on the landing ring, a wellhead on the support ring having a wellhead tubular suspended from it and slip hanger and a tool tubular suspended therefrom, a rim illustrating a removable protrusion attached with the wellhead, a tubing head over the wellhead having a tubing hanger tubular suspended from a mandrel tubing hanger therein, and control valves, pressure gauges, and chokes assembled over the tubing head.
Figure 13:
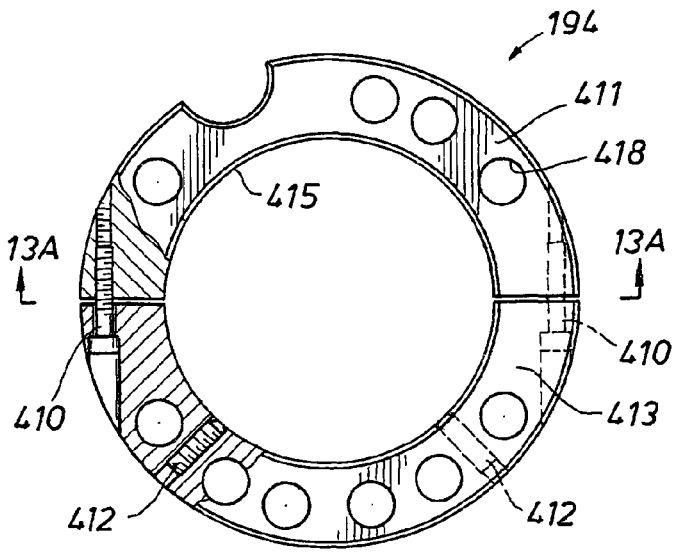
FIG. 13 is a section view taken along line 13-13 of FIG. 12 illustrating a concentric split support ring having ports, and two connection bolts and scrub screws, one of each of which is shown in phantom and the others shown in plan view with ring being partially broken away.
Figure 13A:
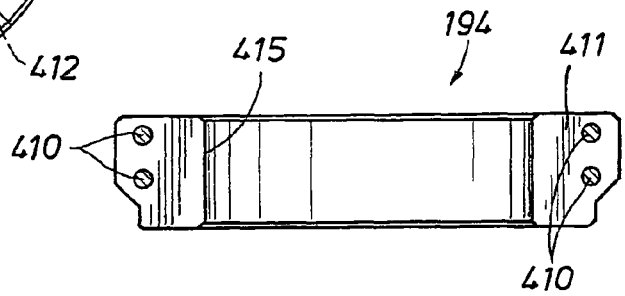
FIG. 13A is a section view taken along line 13A-13A of FIG. 13 illustrating the concentric split support ring with four connection bolts.

FIG. 10 shows landing ring 192 positioned on wellbore tubular 190. Wellbore tubular 190 may be a 16 inch (40.6 cm) diameter conductor casing. However, other tubulars and sizes are contemplated. Concentric support ring 194 is positioned around wellhead tubular 196 and rests on landing ring 192. Wellhead tubular 196 may be a 9⅝ inch (24.4 cm) diameter surface casing. However, other tubulars and sizes are contemplated. FIGS. 13, 13A show enlarged views of concentric support ring 194. Returning to FIG. 10, casing head 202 is threadably attached with wellhead tubular 196. Casing head 202 rests on support ring 194. Slip hanger 204 rests on internal shoulder 203 in casing head 202 and supports tool tubular 198. Tubular 198 may be a 7 inch (17.8 cm) diameter casing. However, other tubulars and sizes are contemplated.

Casing head 202 is single bowl. Conduits (222, 223) are threadably attached to respective bores (226, 227) in casing head 202. Ball valve 224 is in conduit 223. Other valves are contemplated. Rim 206 is threadably attached with one or more threads on the exterior surface of casing head 202, and bolted with bolts 225 to tubing head 208. As can now be understood, the exterior surface of casing head 202 comprises one or more threads. Annular seal 683 between casing head 202 and tubing head 208 may provide fine finishes for metallic sealing. Reducer bushing 210 is positioned in tubing head 208 on one end of tool tubular 198. Mandrel tubing hanger 212 in tubing head 208 supports tubing hanger tubular 200. Tubing hanger tubular 200 may be a 4½ inch (11.4 cm) diameter casing or tubing, such as a liner. However, other tubulars and sizes are contemplated. Packing nuts 214 with retainer pins 216 are attached to tubing head 208 with V-type threads. Retainer pins 216 extend into tubing head 208 to resist upward movement of tubing mandrel hanger 212. Various valves, gauges and chokes, shown generally as 220, are positioned over the wellhead. It is contemplated that a BOP may also be positioned over the wellhead.

Figure 10A:
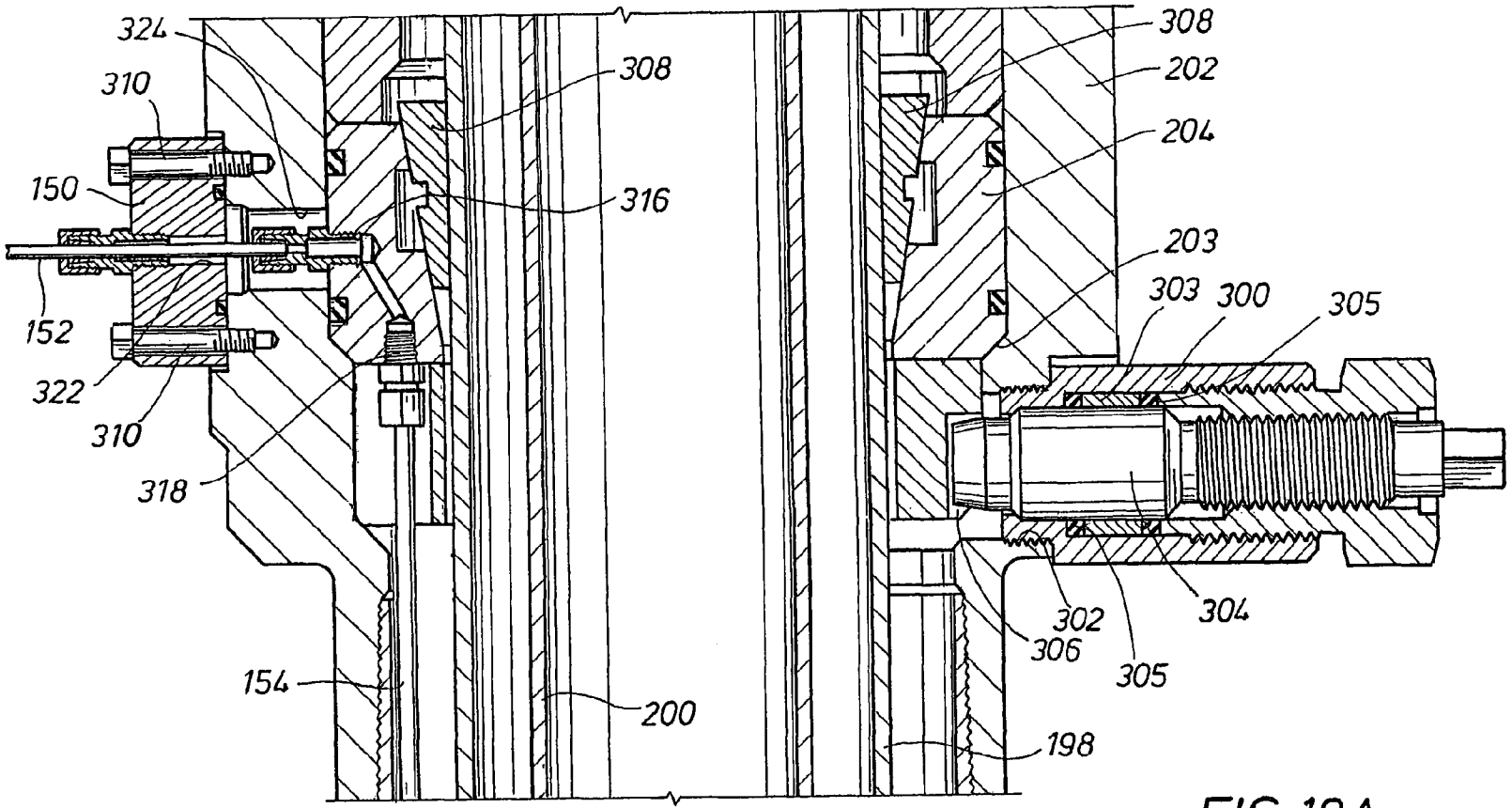
FIG. 10A is an enlarged section elevational view taken along line 10A-10A of FIG. 10 showing a flange bolted to the wellhead, a side hydraulic line extending through the flange and the access opening in the wellhead and coupled with the side port of the slip hanger, and a tool hydraulic line connected with the bottom tool port of the hanger, and an alignment pin housing threadably coupled with the wellhead, and an alignment pin in the extended position with the pin's end in an alignment slot in the hanger.

In FIG. 10A, slip hanger 204 is supported on internal shoulder 203 of casing head 202. Slip hanger 204 supports slips 308, which grip and hold tool tubular 198. Flange or sealing flange 150 is bolted with bolts 310 to casing head 202.

Figure 26:
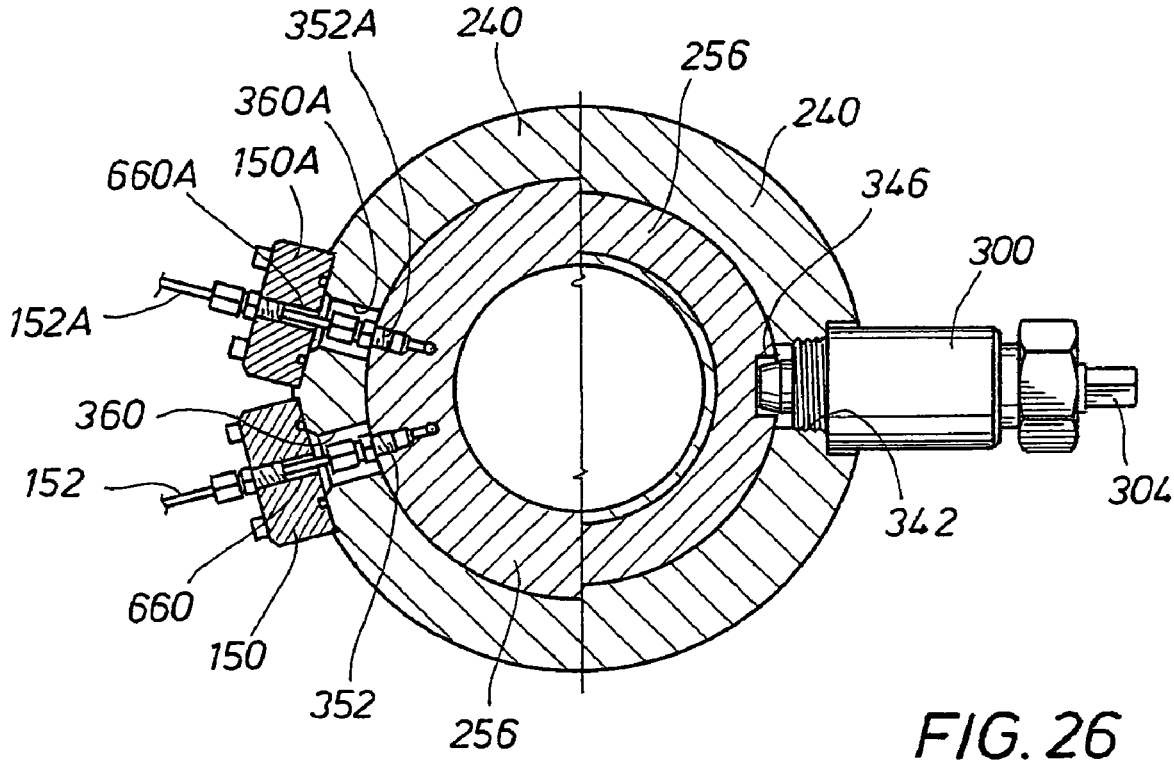
FIG. 26 is plan section view taken along staggered line 26-26 of FIG. 11A illustrating removable protrusions, such as two flanges bolted on the wellhead, hydraulic lines through the flanges and corresponding access openings in the wellhead and coupled with side ports of the mandrel hanger, and an alignment pin housing threadably coupled with a threaded bore in the wellhead, and an alignment pin in the extended position with the pin's end in an alignment slot in the hanger.

It is contemplated that a plurality of bolts 310 may be used. Side hydraulic line 152 extends through flange opening 322 in sealing flange 150 and access opening or side bore 324 in casing head 202 and is coupled with hanger side port 316 of slip hanger 204. It is contemplated that more than one sealing flange 150 may be used as shown in FIG. 26 and discussed in detail therewith. Returning to FIG. 10A, tool hydraulic line 154 is attached with hanger tool port 318. Bull plug or alignment pin housing 300 is threadably attached with threaded bore 302 in casing head 202. Housing 300 may be coupled with threaded bore 302 using line pipe threads, which allow for sealing against high internal pressures. Alignment pin 304 is supported by housing 300 and one end of pin 304 is inserted into threaded bore 302 of casing head 202. Seal 303 and spacer rings 305 are within housing 300. Alignment slot 306 in slip hanger 204 is positioned around the inserted end of alignment pin 304. Alignment pin 304 insures that hanger side port 316 is aligned with side bore 324 in casing head 202.

Figure 11:
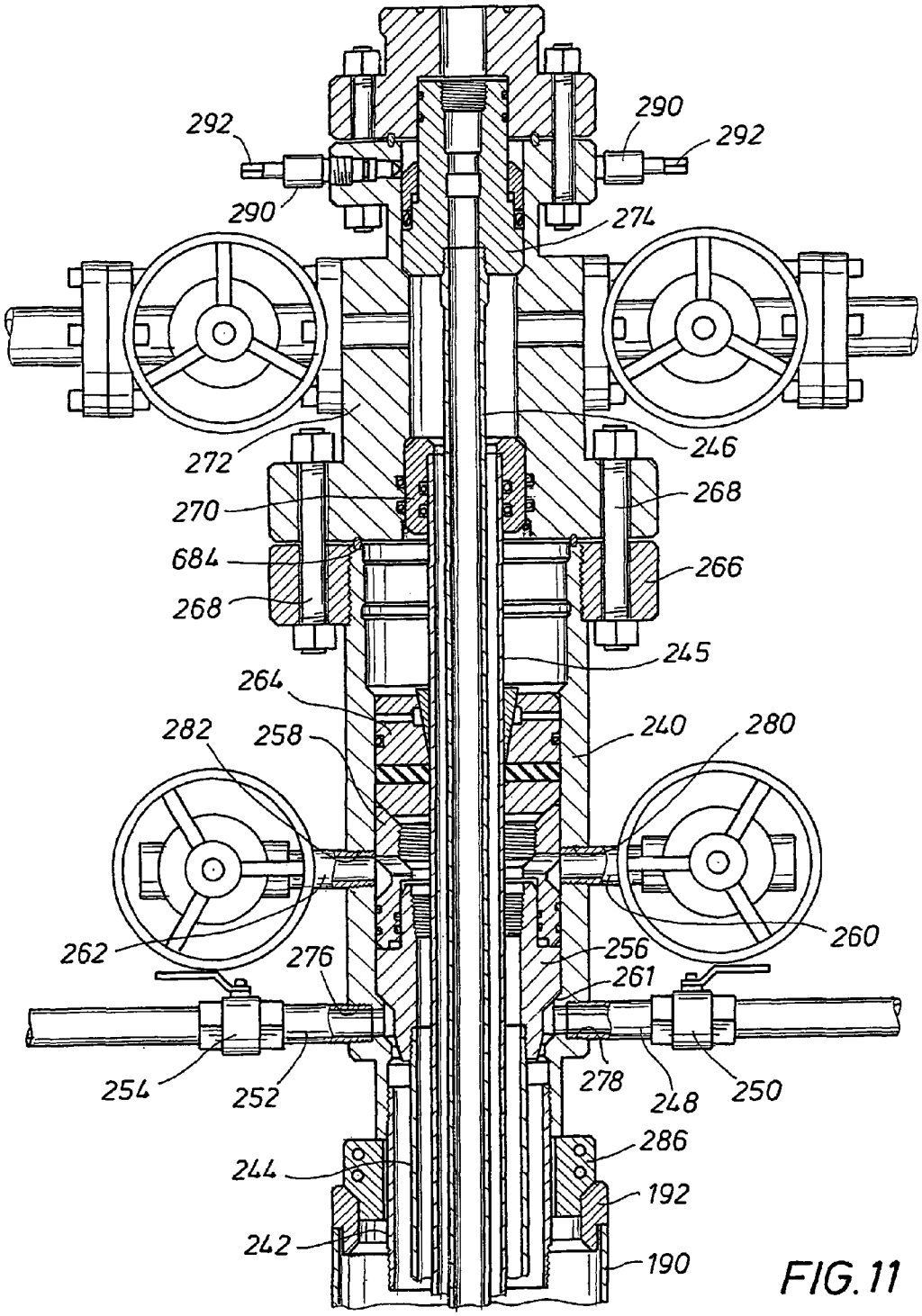
FIG. 11 is a partial cut away section elevational view of a landing ring mounted on a wellbore tubular, a support ring on the landing ring, a monolithic multi-bowl wellhead mounted on the support ring and a wellhead tubular extending therefrom, a mandrel casing hanger and a tool tubular suspended therefrom, and a slip hanger above a support pack-off bushing, with a slip hanger tubular suspended from the slip hanger, a rim attached with the wellhead, a tubing head over the wellhead, with a mandrel tubing hanger suspending a tubing hanger tubular.
Figure 11A:
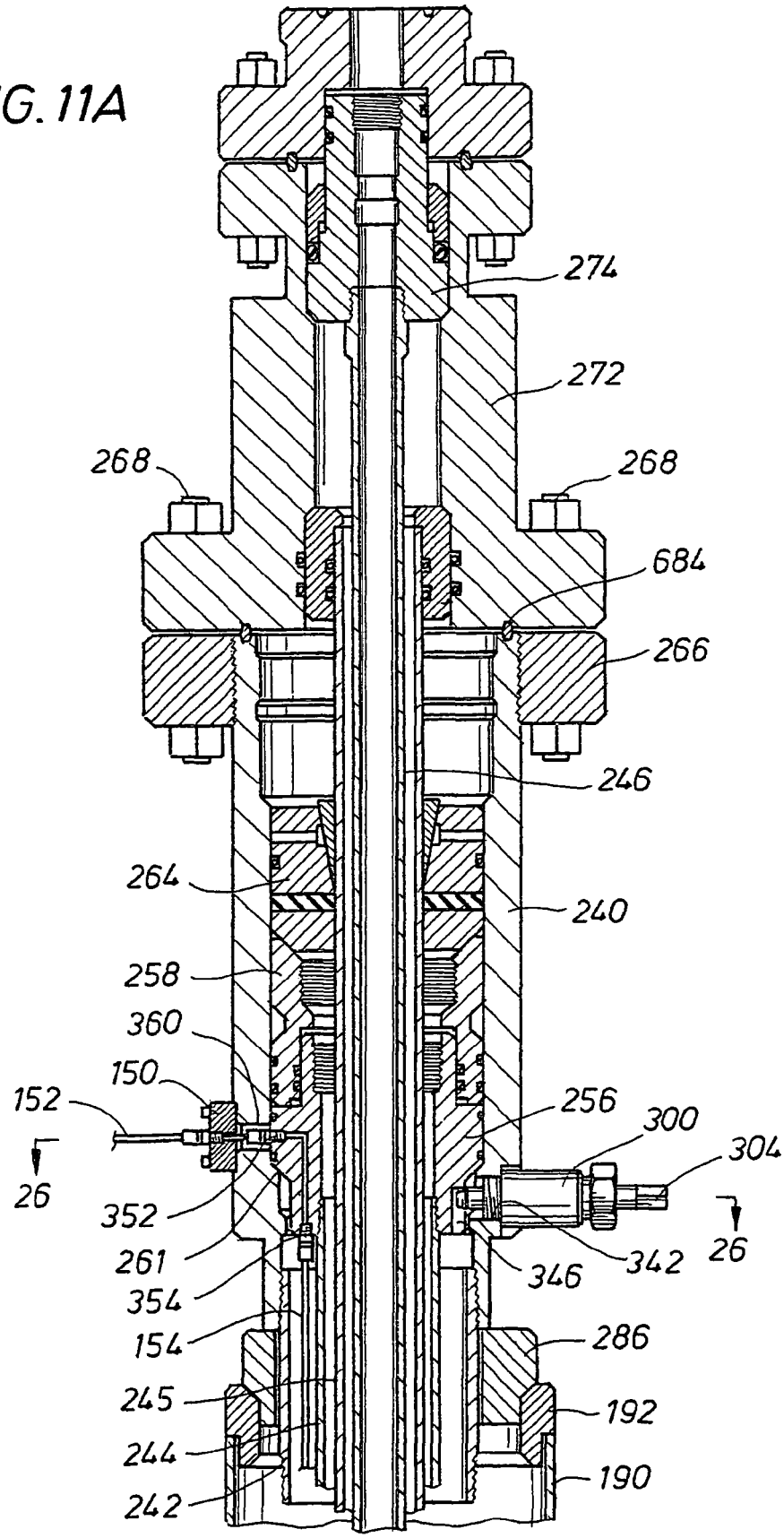
FIG. 11A is similar view to FIG. 11 but rotated 90° clockwise about its longitudinal axis to illustrate a flange bolted on the left side of the monolithic multi-bowl wellhead, a side hydraulic line extending through both the flange and an access opening of the wellhead for coupling with the side port of the mandrel casing hanger, and a tool hydraulic line coupled with the bottom tool port of the hanger, and an alignment pin housing on the right side threadably attached with a threaded bore in the wellhead, and an alignment pin in the extended position with the pin's end in an alignment slot in the hanger.
Figure 14:
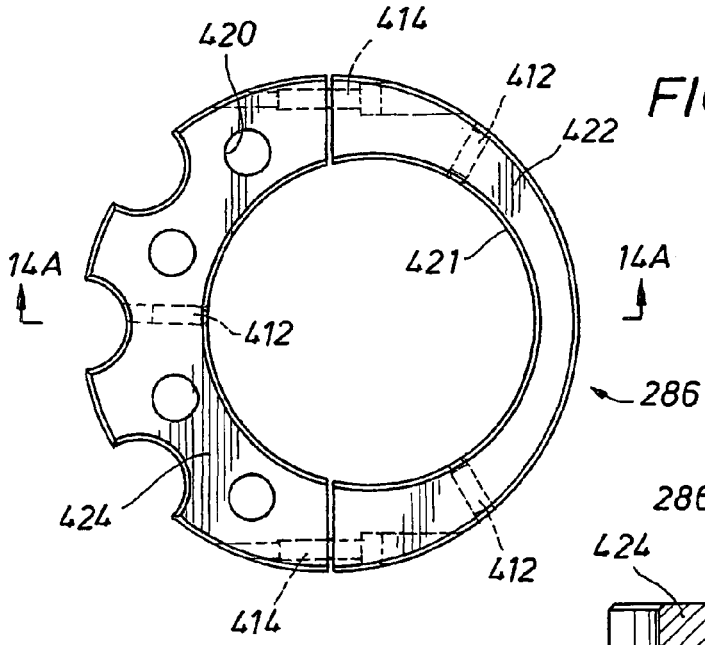
FIG. 14 is a plan view of an alternative eccentric split support ring having ports, and two connection bolts and three scrub screws shown in phantom.
Figure 14A:
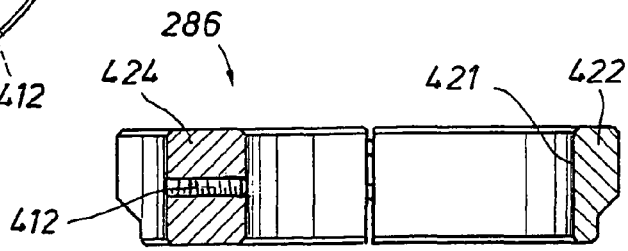
FIG. 14A is an enlarged section view taken along line 14A-14A of FIG. 14 showing the eccentric split support ring with two connection bolts.
Figure 25:
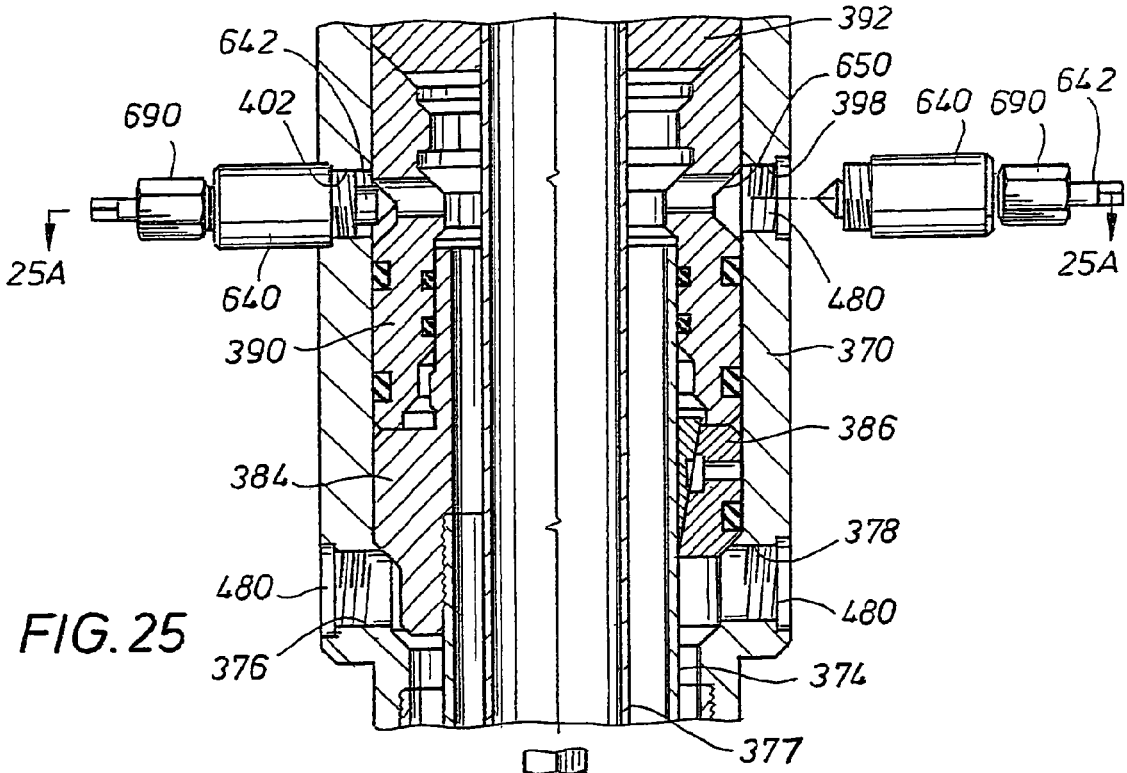
FIG. 25 is a partial section elevational view of a multi-bowl wellhead, similar to the wellhead shown in FIG. 12, a split view illustrates a mandrel hanger on the left, and a slip hanger on the right to suspend a tubular, a support pack-off bushing above both hangers, two threaded side bores in the wellhead are aligned with the support pack-off bushing, one bore threadably coupled with a first retainer pin housing with a retainer pin in an extended position in a bushing groove in the support pack-off bushing, and a second retainer pin housing with a retainer pin aligned for coupling with the wellhead with a flush plug therein.

Turning to FIG. 11, landing ring 192 is positioned on wellbore tubular 190, and eccentric support ring 286 is positioned around wellhead tubular 242 and rests on landing ring 192. FIGS. 14, 14A show enlarged views of eccentric support ring 286. FIG. 11A shows another section view of eccentric support ring 286. Returning to FIG. 11, wellhead or casing head 240 is threadably attached with wellhead tubular 242, which may be a surface casing. Casing head 240 rests on support ring 286. Lower or mandrel casing hanger 256 rests on internal shoulder 261 in casing head 240 and supports tool tubular 244. Support pack-off bushing 258 rests on mandrel casing hanger 256, and supports slip hanger 264. Slip hanger 264 supports slip hanger tubular 245. Casing head 240 is a monolithic multi-bowl casing head. Conduits (248, 252) are threadably attached to respective threaded bores (278, 276) in casing head 240. Ball valves (250, 254) are in respective conduits (248, 252). Other valves are contemplated. Similarly, conduits (260, 262) are threadably attached to respective threaded bores (280, 282) in casing head 240. It is contemplated that threaded bores (280, 282) may also be used to threadably attach retainer pin housings 640 such as shown in FIG. 25 and discussed in detail therewith.

Returning to FIG. 11, rim 266 is threadably attached with one or more threads on the exterior surface of casing head 240, and bolted with bolts 268 to tubing head 272. Annular seal 684 between casing head 240 and tubing head 272 may provide fine finishes for metallic sealing. Bushing 270 is positioned in tubing head 272 on slip hanger tubular 245. Upper or mandrel tubing hanger 274 in tubing head 272 supports tubing hanger tubular 246. Tubing hanger tubular may be 2⅞ inch (7.3 cm) diameter production tubing. However, other tubulars and sizes are contemplated. Packing nuts 290 with retainer pins 292 are attached to tubing head 272 with V-type threads. Retainer pins 292 may be used to extend into tubing head 272 to resist upward movement of mandrel tubing hanger 274. Various valves, gauges and chokes may be positioned over the wellhead. It is contemplated that a BOP may also be positioned over the wellhead. Various valves and conduits are shown attached with the sides of the wellhead system. It is contemplated that while tubing head 272 is shown, it may not be needed, such as for example if slip hanger tubular 245 is not necessary, and a hanger supporting tubular 246 is positioned in casing head 240, such as shown in FIG. 12A for a different embodiment of casing head 240, and discussed in detail below. As can now be understood, tubing head 272 may be eliminated in some circumstances.

Turning to FIG. 11A, sealing flange 150 is bolted to casing head 240. Side hydraulic line 152 extends through a flange opening in flange 150 and access opening or side bore 360 in casing head 240 and is coupled with hanger side port 352 of mandrel casing hanger 256 seated on shoulder 261. It is contemplated that more than one flange 150 may be used as shown in FIG. 26 and discussed in detail therewith. Returning to FIG. 11A, tool hydraulic line 154 is attached with hanger tool port 354. Alignment pin housing 300 is threadably attached with threaded bore 342 in casing head 240. Alignment pin 304 is inserted through housing 300 and threaded bore 342 of casing head 240. Alignment slot 346 in hanger 256 is positioned around the inserted end of alignment pin 304. Alignment pin 304 insures that hanger side port 352 is aligned with side bore 360 in casing head 240.

Figure 12:
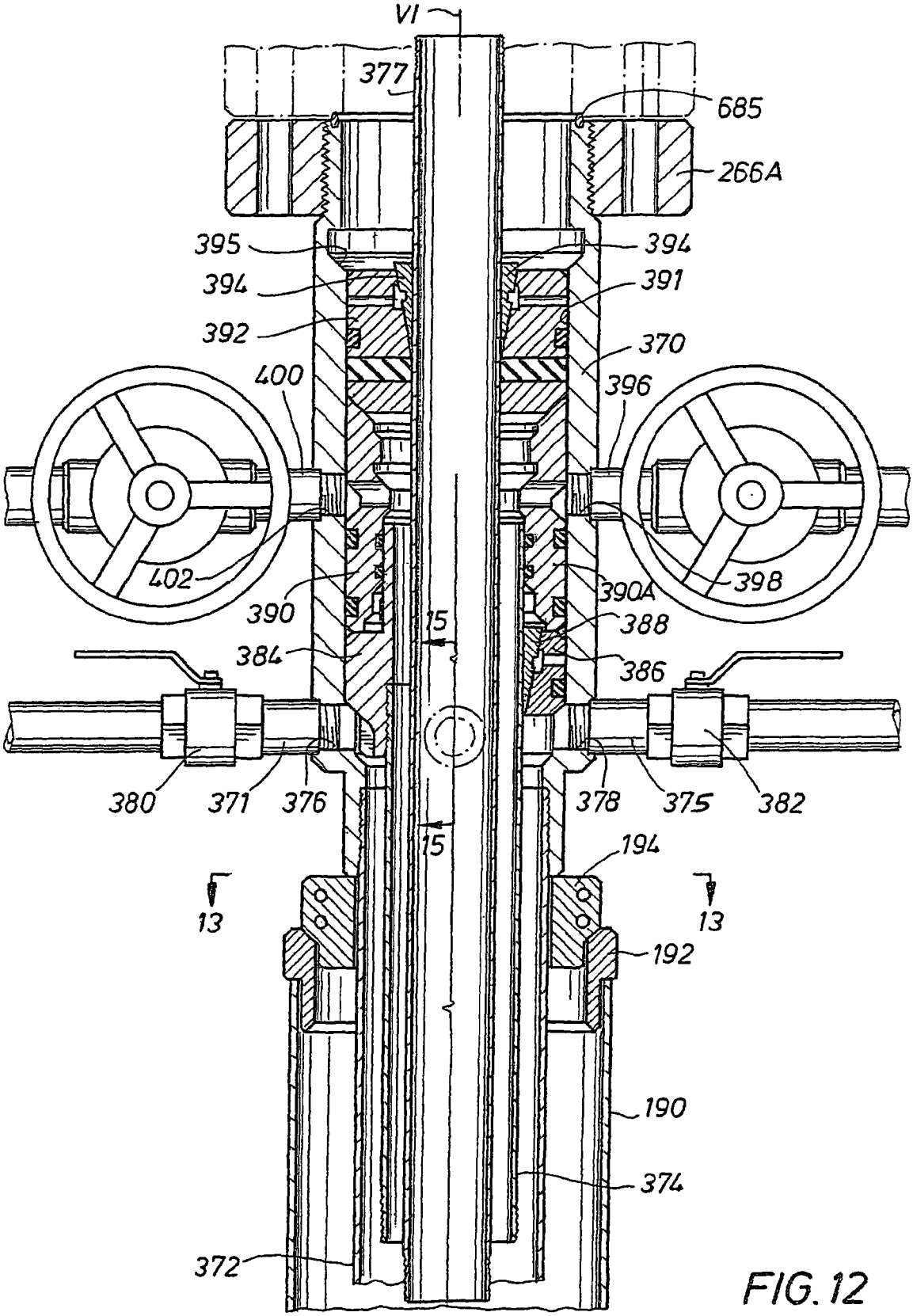
FIG. 12 is a section elevational view of a landing ring mounted on a wellbore tubular, a support ring on the landing ring, an alternative monolithic multi-bowl wellhead mounted on the support ring and a wellhead tubular extending therefrom, a split view illustrates a mandrel hanger on the left side and a lower slip hanger shown on the right side to suspend a tool tubular, an upper slip hanger suspends a slip hanger tubular through a support pack-off bushing.
Figure 12A:
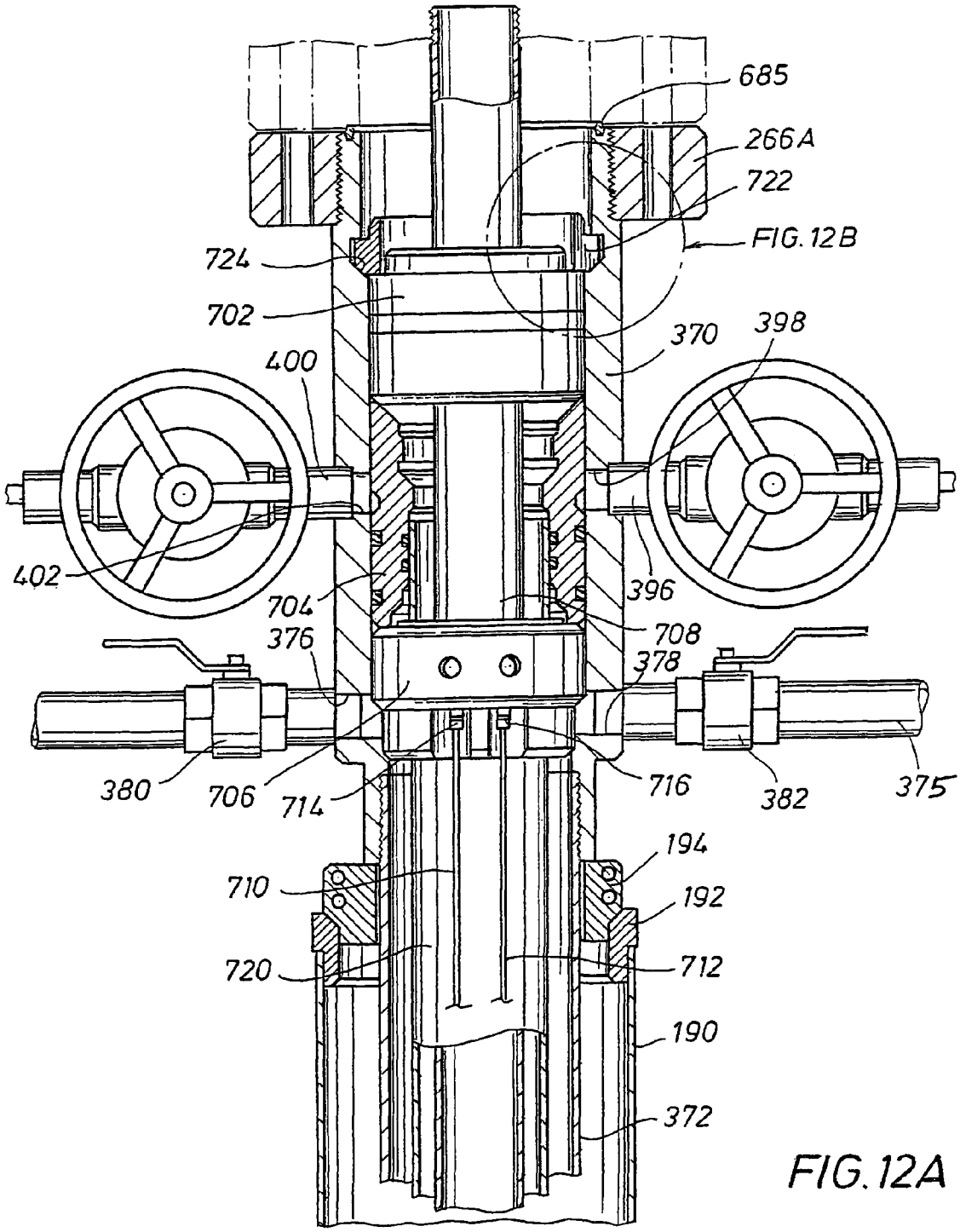
FIG. 12A is a partial section elevational view of a landing ring mounted on a wellbore tubular, a support ring on the landing ring, an alternative monolithic multi-bowl wellhead mounted on the support ring with a wellhead tubular extending therefrom, a mandrel casing hanger suspending a tool tubular, shown in partial cut away section view, with two tool hydraulic lines extending from two tool ports, a mandrel tubing hanger suspending a tubing hanger tubular through a support pack-off bushing, and a partial section view of the mandrel tubing hanger split ring extending outwardly into an annular groove in the wellhead.

Turning to FIG. 12, landing ring 192 is positioned on wellbore tubular 190, and concentric support ring 194 is positioned around wellhead tubular 372 and rests on landing ring 192. FIGS. 13, 13A show enlarged views of concentric support ring 194. Returning to FIG. 12, casing head 370 is threadably attached with wellhead tubular 372, which may be a surface casing. Casing head 370 rests on concentric support ring 194. Casing head 370 is an alternative embodiment monolithic multi-bowl casing head. On the left side of vertical axis V1, mandrel casing hanger 384 in casing head 370 is illustrated supporting tool tubular 374. On the right side of vertical axis V1, first or lower slip hanger 386 with slips 388 is illustrated supporting tool tubular 374. Support pack-off bushing 390 rests on casing mandrel hanger 384 on the left, and support pack-off bushing 390A rests on first slip hanger 386 on the right, and supports second or upper slip hanger 392 above. Second slip hanger 392 with slips 394 supports slip hanger tubular 377. Annular grove 395 allows for support of a tubing hanger if it is desired instead of second slip hanger 392, as shown in FIG. 12A and discussed below. As can now be understood, a tubing head may not be needed if only two hangers with supported tubulars are required for production, since two hangers may be positioned in wellhead 370.

Wellhead or casing head 370 with longitudinal bore interior surface 391 is a monolithic multi-bowl casing head. Conduits (371, 375) are threadably attached to respective threaded bores (376, 378) in casing head 370. Ball valves (380, 382) are in respective conduits (371, 375). Other valves are contemplated. Similarly, conduits (400, 396) are threadably attached to respective threaded bores (402, 398) in casing head 370. It is contemplated that threaded bores (402, 398) may also be used to threadably attach retainer pin housings 640, such as shown in FIG. 25. The retainer pins 642 may be inserted to prevent upward movement of support pack-off bushing 390. Returning to FIG. 12, rim 266A is threadably attached with casing head 370. Annular seal 685 between casing head 370 and the adjoining wellhead member may provide fine finishes for metallic sealing.

Figure 12B:
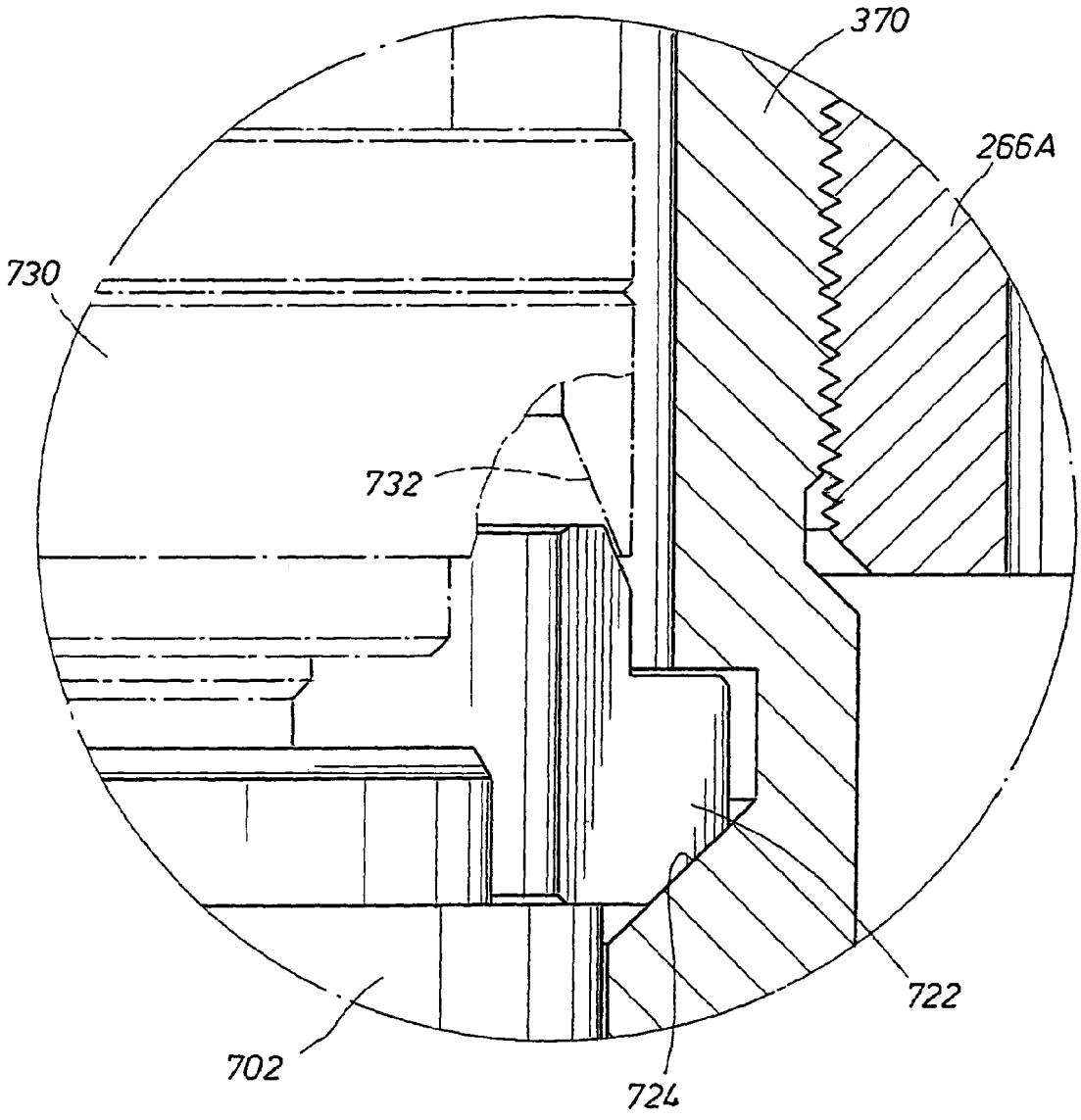
FIG. 12B is an enlarged detail view of a partial area of FIG. 12A illustrating a mandrel tubing hanger split ring extending outwardly into an annular groove in the wellhead, and a tubing hanger removal tool shown in phantom, which is not illustrated in FIG. 12A.

FIG. 12A shows the same casing head 370 as in FIG. 12. However, in FIG. 12A mandrel tubing hanger 702 is supported over support pack-off bushing 704, which is positioned over mandrel casing hanger 706. Mandrel tubing hanger 702 supports tubing hanger tubular 708. Tubing hanger tubular 708 may be 4½ inch (11.4 cm) casing or production tubing, although other sizes are contemplated. Mandrel casing hanger 706 supports tool tubular 720. As can now be understood, a tubing head is not needed if only two hangers, such as (702, 706), with supported tubulars, such as (708, 720), are required for production. Tool hydraulic lines (710, 712) extend downward from respective tool ports (714, 716) on mandrel casing hanger 706 to a downhole deployment valve or other hydraulic tool (not shown). Mandrel tubing hanger split ring 722 extends outwardly from mandrel tubing hanger 702 and into annular groove 724 in casing head 370. Split ring 722 has a spring loaded outward bias, so that after mandrel tubing hanger 702 is coupled with tubular 708 and moved downward into casing head 370, the split ring 722 expands outwardly into groove 724, locking tubing mandrel hanger 702 with the suspended tubular 708 in place. This eliminates the need for retainer pins, such as pins 132 shown in FIG. 8. A removal tool 730, shown in phantom in FIG. 12B, may be used to remove mandrel tubing hanger 702. Beveled edge 732 in removal tool 730 moves split ring 722 away from groove 724, allowing hanger 702 to be removed.

Turning to FIGS. 13 and 13A, they show concentric support ring 194, which is a split ring assembled with two partial rings (411, 413) bolted together with a plurality of bolts 410. Partial rings (411, 413) may be positioned around a wellhead tubular, such as wellhead tubular 372 in FIG. 12, and then bolted together with bolts 410. One end of scrub screws 412 may be moved through the interior surface 415 of the support ring 194 to engage the inserted tubular. Bores 418 provide access to the annular space surrounding the inserted tubular, such as for fluid or cement. Similarly, FIGS. 14 and 14A show eccentric support ring 286, which is a split ring assembled with two partial rings (422, 424) bolted together with a plurality of bolts 414. Partial rings (422, 424) may be positioned around a wellhead tubular, such as wellhead tubular 242 in FIG. 11A, and then bolted together with bolts 414. One end of scrub screws 412 may be moved through the interior surface 421 of the support ring 286 to engage the inserted tubular. Bores 420 provide access to the annular space surrounding the inserted tubular, such as for fluid or cement. The horizontal alignment of the longitudinal axis of the inserted tubular with the wellbore axis dictates which support ring is appropriate (194, 286).

In FIG. 15, sealing flange 150 is bolted with bolts 310 to casing head 370. Side hydraulic line 152 extends through flange opening 322 in sealing flange 150 and access opening or side bore 433 in casing head 370 and is coupled with hanger side port 434 of mandrel hanger 384. Tool hydraulic line 154 is coupled with hanger tool port 436. Bull plug or alignment pin housing 300 is threadably attached with threaded bore 431 in casing head 370. Alignment pin 304 is inserted through housing 300 and threaded bore 431 of casing head 370. Alignment slot 430 in mandrel hanger 384 is positioned around the inserted end of alignment pin 304. Alignment pin 304 insures that hanger side port 434 is aligned with bore 433 in casing head 370.

Figure 15A:
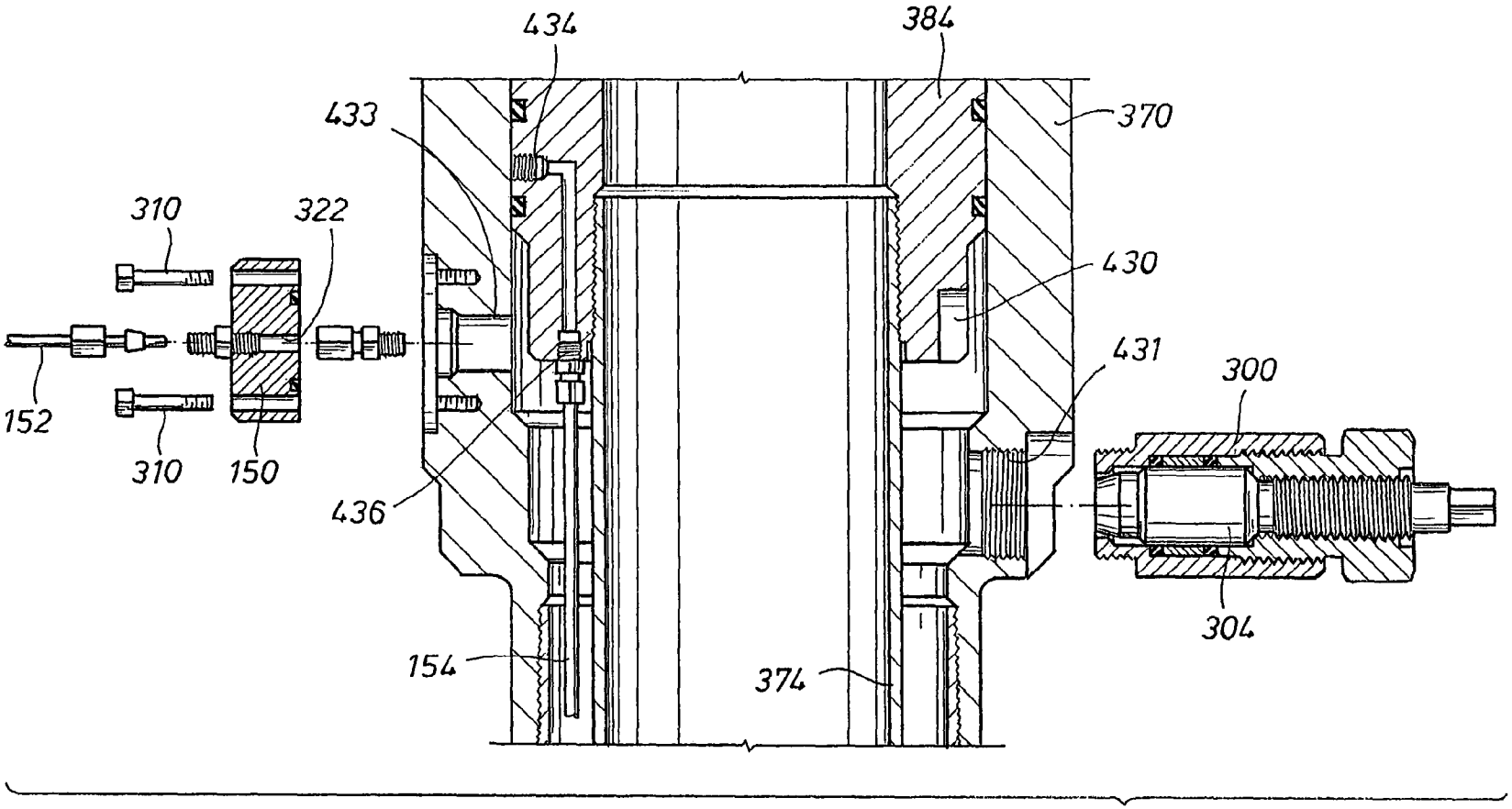
FIG. 15A is similar to FIG. 15, except the mandrel hanger has not been completely lowered into the wellhead, and protrusions, such as a flange and a first hydraulic line on the left and an alignment pin housing on the right, that have not been coupled with or installed on the wellhead.

FIG. 15A shows the components in FIG. 15 disassembled, except that tool hydraulic line 154 is coupled with hanger tool port 436. Mandrel hanger 384 is not seated in casing head 370. It is contemplated that mandrel hanger 384 may not be moved into casing head 370 until alignment pin housing 300 is threadably attached with threaded bore 431, and retainer pin 304 inserted through bore 431 to be in position to penetrate alignment slot 430 when hanger 384 is lowered.

Figure 16:
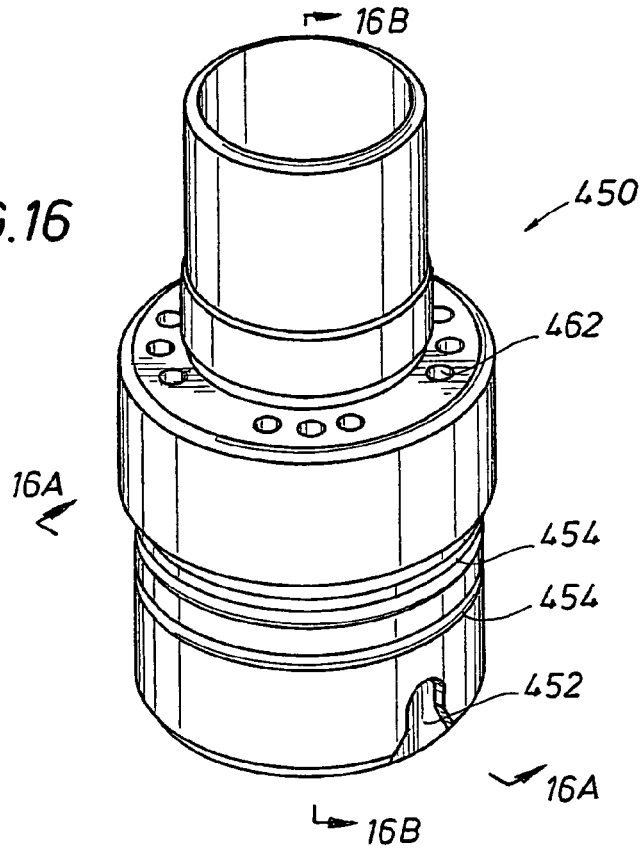
FIG. 16 is an isometric view of a mandrel hanger with an alignment slot at the bottom, two annular isolation seals, and a plurality of longitudinal channels in the hanger.
Figure 16A:
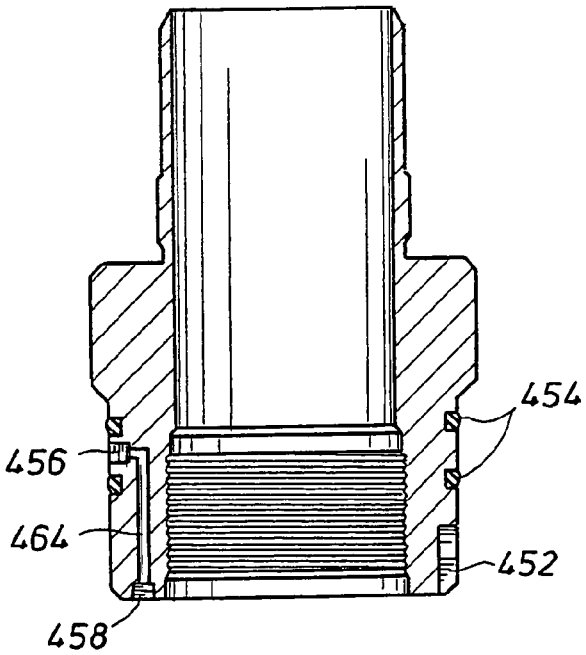
FIG. 16A is a section view taken along line 16A-16A of FIG. 16 illustrating the alignment slot, a passage communicating the mandrel side port with mandrel bottom tool port, and the two annular isolation seals.
Figure 16B:
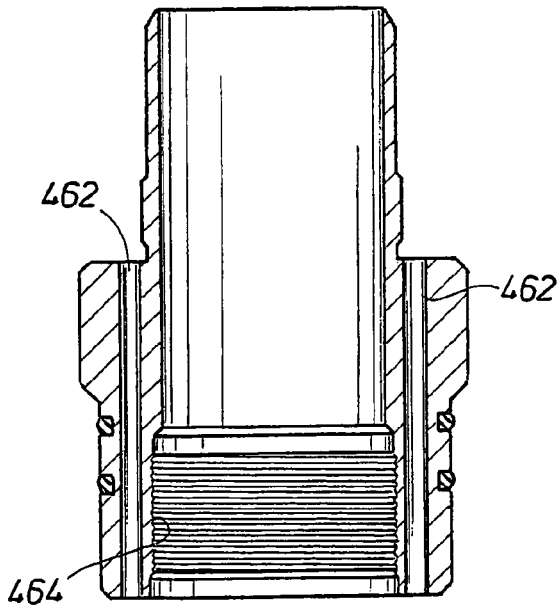
FIG. 16B is a section view taken along line 16B-16B of FIG. 16 illustrating two longitudinal channels and two annular isolation seals.

FIGS. 16, 16A, and 16B show mandrel hanger 450, which is similar to casing mandrel hangers (142, 256, 384) shown in respective FIGS. 9, 11A, 12. Annular seals 454 are located above and below hanger side port 456. It is contemplated that there may be more than one hanger side port 456. Annular seals 454 provide a safety pressure isolation system around hanger side port(s) 456. Without seals 454, hanger side port 456 would be open to annulus pressure during direct hydraulic line installation operations. Hanger side port 456 is in fluid communication with hanger tool port 458 through fluid passageway 464. Alignment slot 452 allows for engagement with alignment pin 304 (not shown). Longitudinal channels 462 allow for fluid communication with the annular space surrounding the tubular (not shown) threadably attached to hanger 450 with threads 464. Casing returns flow comprise fluids that must flow around hanger 450 while it is seated in the wellhead. A problem associated with isolating hanger side port(s) is that a typical hanger is fluted on its exterior for such casing returns flow. Channels 462 internal to hanger replace such flutes, thereby allowing for seals 454 to isolate hanger side port(s) 456.

Figure 17:
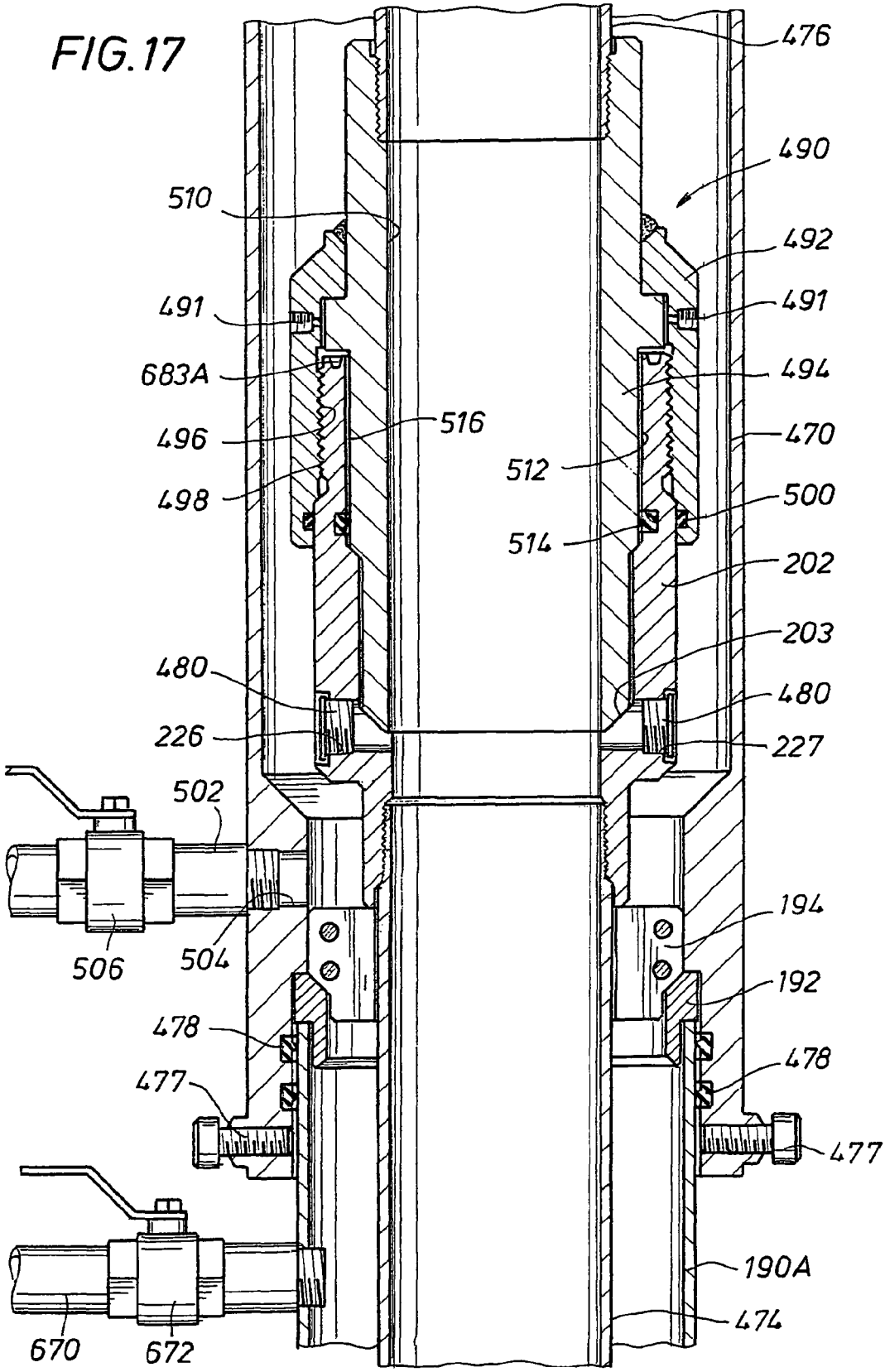
FIG. 17 is a partial section elevational view of a diverter housing mounted with a wellbore tubular, a landing ring on the wellbore tubular, a support ring on the landing ring, and an overshot running tool within the diverter housing with a wellhead thereon coupled with a wellhead tubular.

Turning to FIG. 17, first or diverter housing 470 is mounted on wellbore tubular 190A with lockdown bolts 477 and sealed with annular seals 478. Wellbore tubular 190A may be a 16 inch (40.6 cm) diameter conductor casing. However, other tubulars and sizes are contemplated. Conduit 670 with valve 672 is attached with tubular 190A. Conduit 502 with valve 506 is attached with bore 504 in housing 470. It is contemplated that there may be only one conduit (502, 670). It is also contemplated that one of conduits (502, 670) may be plugged. The top of overshot running tool 490 is threadably attached with running tool tubular 476. Overshot running tool 490 is also threadably coupled with casing head 202. One or more threads 496 on the interior surface of collar 492 of overshot running tool 490 are engaged with one or more threads 498 on the exterior surface of casing head 202.

Annular seal 500 on the interior surface of collar 492 seals with the exterior surface of casing head 202. Collar 492 is attached with body 494 of overshot running tool 490. Collar 492 may be welded to body 494. Other methods of attachment are contemplated. It is contemplated that collar 492 and body 494 may be substantially cylindrical in shape. Collar 492 and body 494 protect and cover groove 683A and thread 498 from cement and debris resulting from operations, as well as contact damage during movement. As shown in FIG. 10, annular seal 683 may be placed in groove 683A after running tool 490 is removed. Also, rim 206 may be threadably attached with thread 498 after running tool 490 is removed.

Returning to FIG. 17, collar 492 inside diameter is attached to and extends around a portion of the exterior surface 516 of body 494. The thicknesses of collar 492 and body 494 may not be uniform. Wellhead tubular 474 is threadably attached with casing head 202. Wellhead tubular 474 may be a surface casing. Concentric support ring 194 is positioned with wellhead tubular 474, and rests on landing ring 192. Casing head 202 rests on support ring 194. Flush plugs 480 are in the threaded bores (226, 227) of casing head 202. The longitudinal bore interior surface 510 of body 494 of overshot running tool 490 may be substantially even or flush with the interior surfaces of tubulars (474, 476). Exterior surface 516 of body 494 of overshot running tool 490 covers substantially all of the longitudinal bore interior surface 512 of casing head 202 and is sealed with annular seal 514 in casing head 202, thereby protecting it during cementing and drilling operations. Shoulder 203 in casing head 202 is also protected. It is contemplated that an annular seal may be in body 494 to seal the two surfaces (512, 516). Test ports 491 in collar 492 allow for pressure testing of the threaded connection with casing head 202 prior to moving casing head 202 thru the diverter housing 470. As can now be understood, overshot running tool 490 is contemplated for moving and/or operations with single bowl casing head 202.

Figure 18:
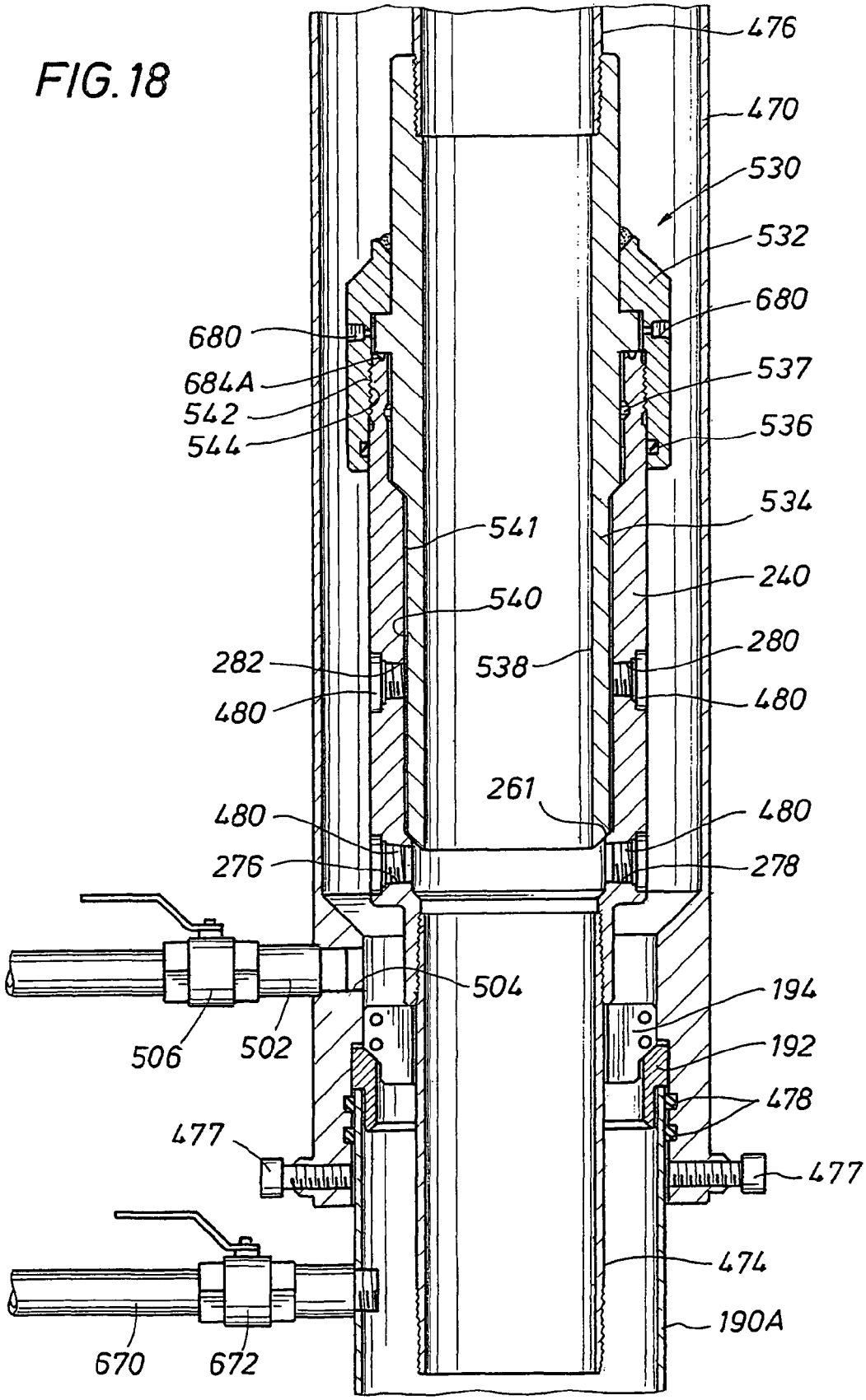
FIG. 18 is a partial section elevational view of a diverter housing similar to the one shown in FIG. 17 mounted with a wellbore tubular, a landing ring on the wellbore tubular, a support ring on the landing ring, and an overshot running tool within the diverter housing with a monolithic multi-bowl wellhead thereon coupled with a wellhead tubular.

FIG. 18 is similar to FIG. 17, except FIG. 18 shows an alternative embodiment casing head 240 and overshot running tool 530. Although casing head 240 is shown, casing head 370 may be similarly moved with overshot running tool 530. Overshot running tool 530 is contemplated for moving and/or operations with a monolithic multi-bowl wellhead (240, 370). Casing head 240 is threadably attached with overshot running tool 530. Thread 542 on the interior surface of collar 532 of overshot running tool 530 are engaged with thread 544 on the exterior surface of casing head 240. Annular seal 536 on the interior surface of collar 532 seals with the exterior surface of casing head 240. Annular seal 537 seals exterior surface 541 of body 534 of overshot running tool 530 and longitudinal bore interior surface 540 of casing head 240.

Collar 532 is attached with body 534 of overshot running tool 530. Collar 532 and body 534 protect and cover groove 684A and thread 544 from cement and debris resulting from operations, as well as contact damage during movement. As shown in FIG. 11, annular seal 684 may be placed in groove 684A after running tool 530 is removed. Also, rim 266 may be threadably attached with thread 544 after running tool 530 is removed. Returning to FIG. 18, collar 532 may be welded to body 534. Other methods are contemplated. It is contemplated that collar 532 and body 534 may be substantially cylindrical in shape. The thicknesses of collar 532 and body 534 may not be uniform. Flush plugs 480 are in the threaded bores (276, 278, 280, 282) of casing head 240. The longitudinal bore interior surface 538 of body 534 of overshot running tool 530 may be substantially even or flush with the interior surfaces of tubulars (474, 476). Exterior surface 541 of body 534 of overshot running tool 530 covers substantially all of the longitudinal bore interior surface 540 of casing head 240, which protects it during cementing and drilling operations. Shoulder 261 in casing head 240 is also protected. Test ports 680 in collar 532 allow for pressure testing of the connection with casing head 240 prior to moving casing head 240 thru the diverter housing 470.

Figure 18A:
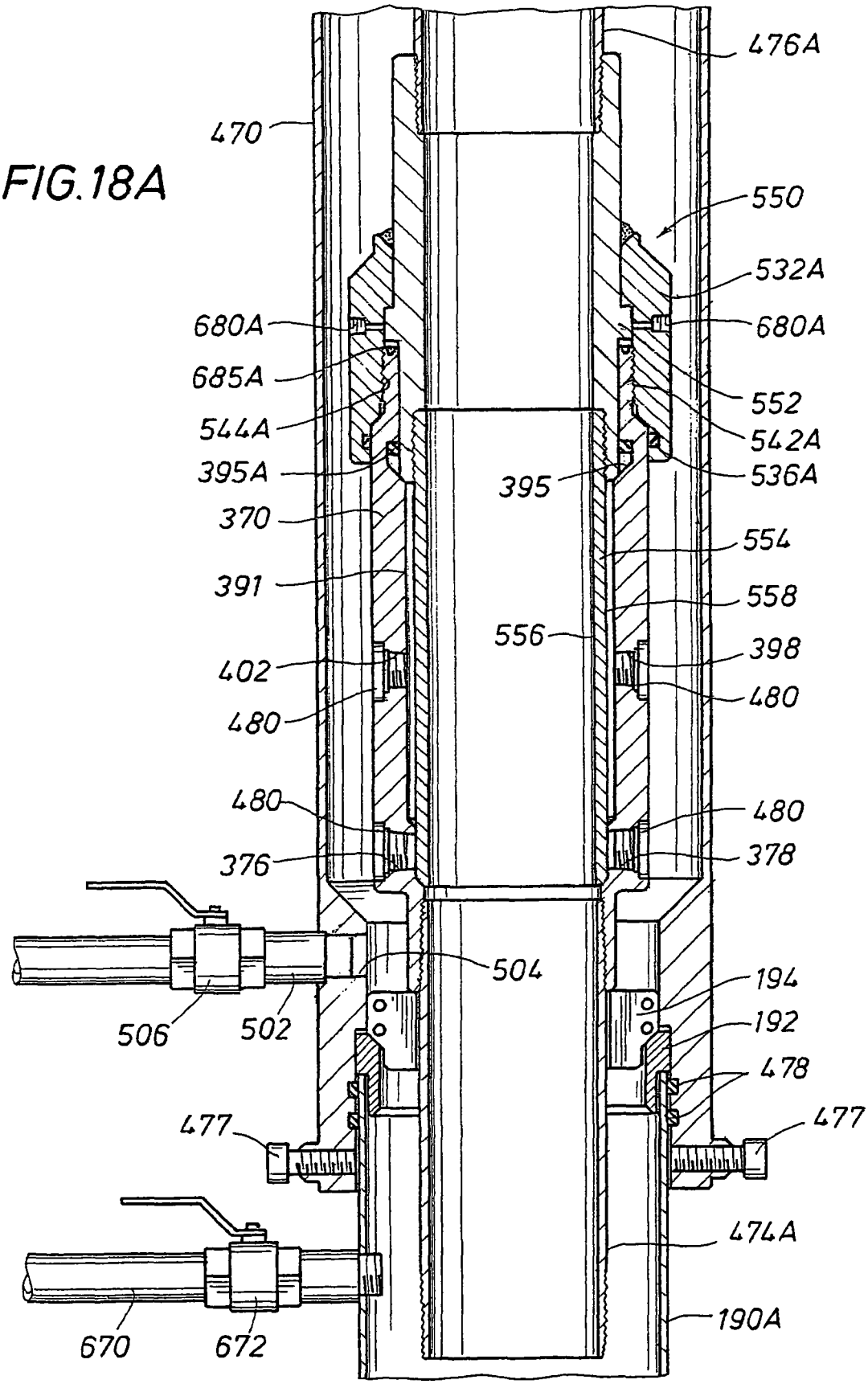
FIG. 18A is a view similar to FIG. 18, except with an alternative embodiment of the overshot running tool and monolithic multi-bowl wellhead.

Turning to FIG. 18A, alternative embodiment casing head 370 is positioned with another alternative embodiment overshot running tool 550. Again, although casing head 370 is shown, casing head 240 may be similarly moved with overshot running tool 550. Thread 542A on the interior surface of collar 532A of overshot running tool 550 are engaged with thread 544A on the exterior surface of casing head 370. Annular seal 536A on the interior surface of collar 532A seals with the exterior surface of casing head 370. Annular seal 395A in groove 395 seals the exterior surface of body 552 of overshot running tool 550 and longitudinal bore interior surface 391 of casing head 370.

The top of extension 554 and the bottom of body 552 of overshot running tool 550 are threadably attached. It is contemplated that extension 554 and body 552 may be substantially cylindrical in shape. The thicknesses of collar 532A and body 552 may not be uniform. It is contemplated that extension 554 may be a tubular, such as a section of casing substantially the same size as tubulars (474A, 476A). However, other sizes are contemplated as well. The longitudinal bore interior surface 556 of extension 554 of overshot running tool 550 may be substantially flush with the interior surfaces of tubulars (474A, 476A). Exterior surface 558 of extension 554 of overshot running tool 550 covers substantially all of the longitudinal bore interior surface 391 of casing head 370, which protects it during cementing and drilling operations. Thread 542A on collar 532A protect thread 544A on casing head 370. Collar 532A and body 552 protect and cover annular groove 685A from cement and debris resulting from operations, as well as contact damage during movement. As shown in FIG. 12, annular seal 685 may be placed in groove 685A after running tool 550 is removed. It is contemplated that a seal may be monolithic with casing head (202, 240, 370). Also, rim 266A may be threadably attached with threads 544A after running tool 550 is removed.

Returning to FIG. 18A, test ports 680A in collar 532A allow for pressure testing of the connection with casing head 370 prior to moving casing head 370 thru the diverter housing 470. It is contemplated that extension 554 may be a shorter length than that shown in FIG. 18A, and single bowl casing head 202 positioned with an overshot running tool like tool 550, but with a shorter length of extension 554. The length of extension 554 may be selected to cover substantially all of the interior surface 512 of casing head 202, as it does for casing head 370 in FIG. 18A. As can now be understood, different length extensions 554 may be threadably attached with body 552 to fit different length and diameter size wellheads (202, 240, 370).

As can now be understood from FIGS. 17-18A, all protrusions from casing head (202, 240, 370), such as rim (206, 266, 266A), alignment pin housing 300, retainer pin housings 640, and flange 150 have not been installed or have been removed, which allows casing head (202, 240, 370) to move thru a smaller interior diameter diverter housing 470 than would otherwise be possible. Also, the exterior surface of casing head (202, 240, 370) is substantially uniform, which further enables casing head (202, 240, 370) in moving thru small interior diameter diverter housings 470. It is contemplated that wellhead (202, 240, 370) may preferably be moved thru a 16 inch (40.6 cm) diameter or larger diverter housing. However, smaller diameter diverter housings are also contemplated. As can also now be understood from FIGS. 17-18A, overshot running tool (490, 530, 550) protects the thread (498, 544, 544A) on the exterior surface of casing head (202, 240, 370) during movement and operations. Overshot running tool (490, 530, 550) also protects casing head (202, 240, 370) upper ring gasket groove (683A, 684A, 685A) and/or annular seals (683, 684, 685).

Figure 19:
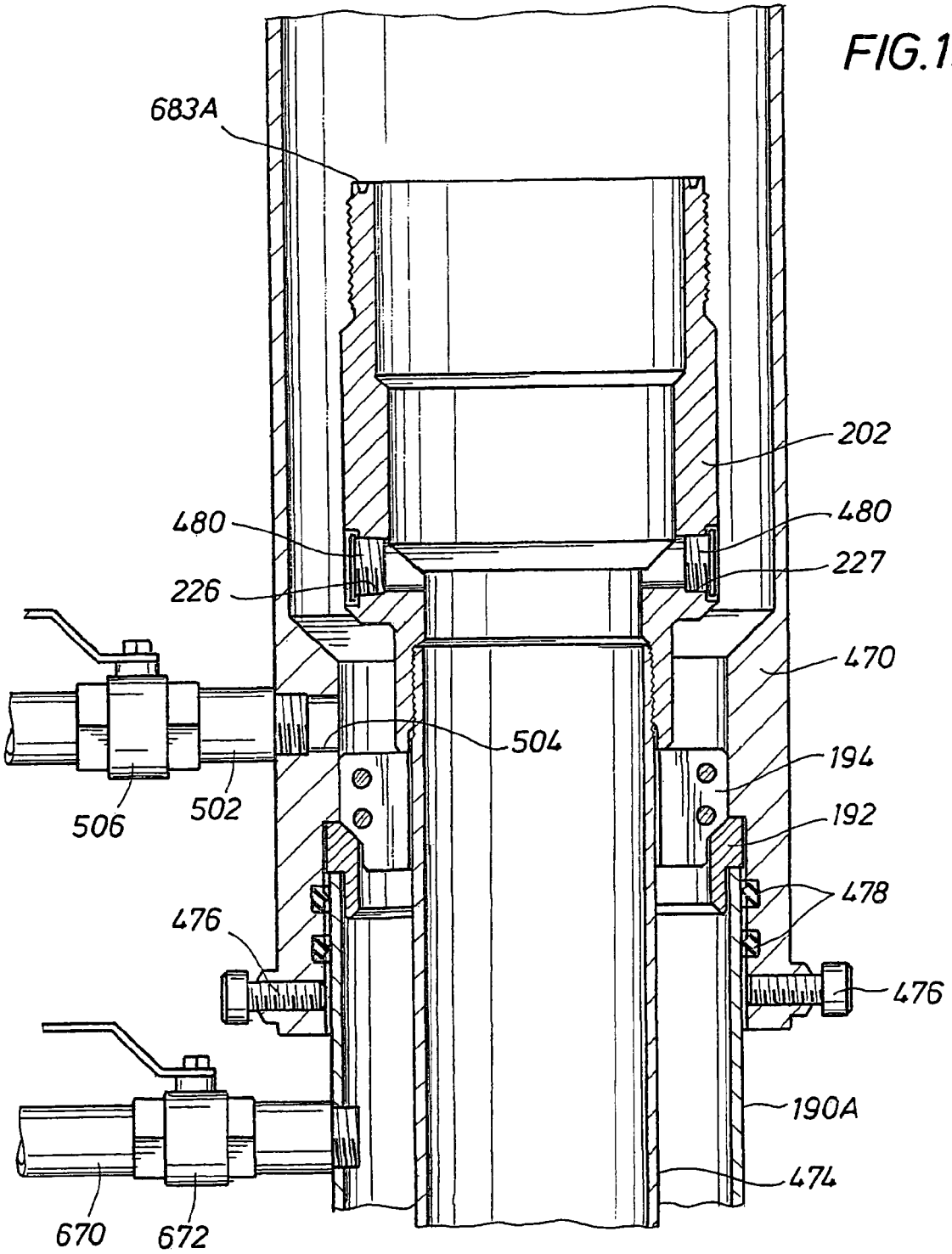
FIG. 19 is a view similar to FIG. 17, except the overshot running tool is uncoupled from the wellhead and removed.
Figure 20:
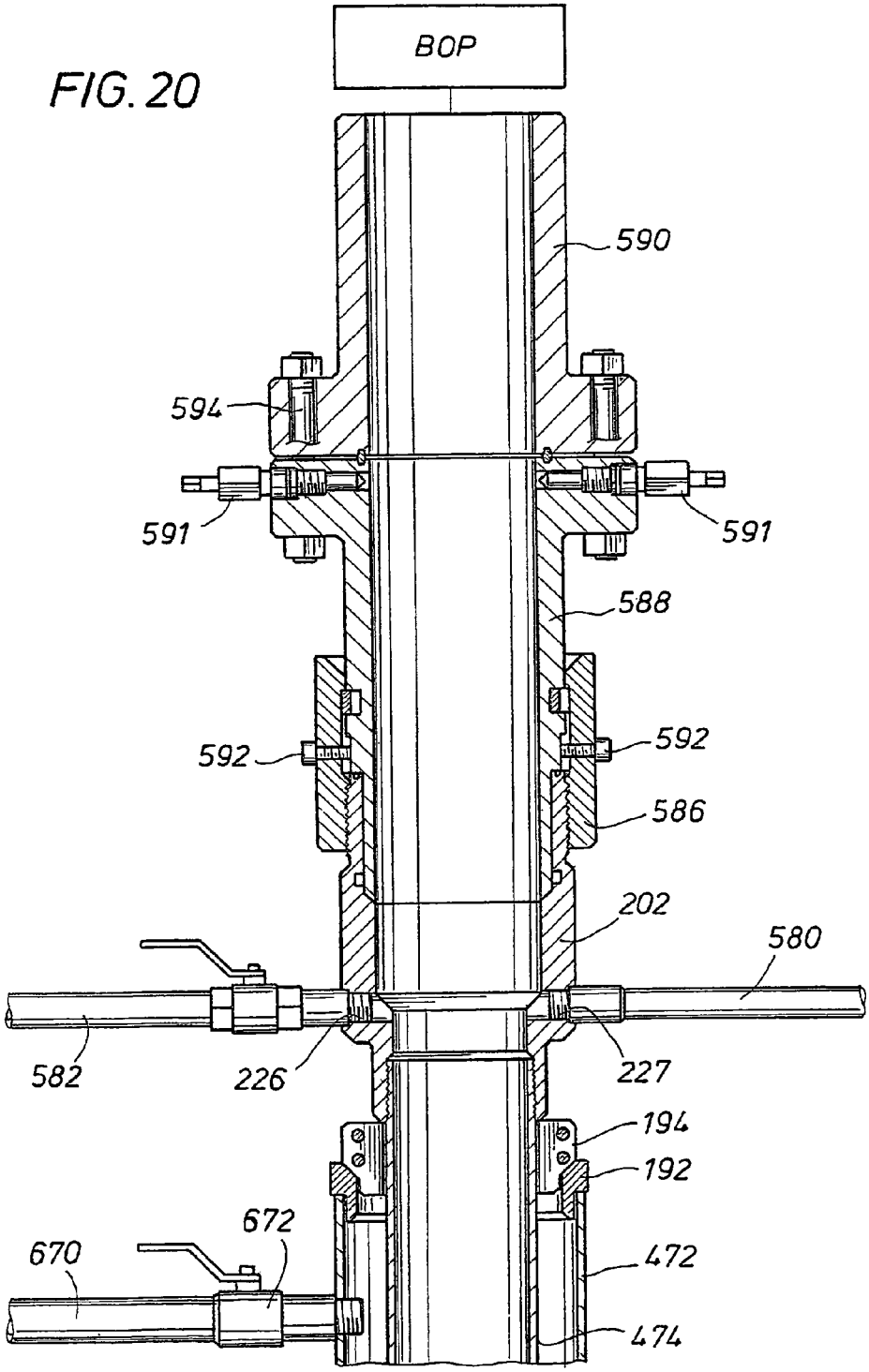
FIG. 20 is a partial section elevational view of a landing ring on a wellbore tubular, a support ring on the landing ring, a wellhead over the support ring with a wellhead tubular extending therefrom, a BOP adapter housing with lockdown screws coupled with the wellhead with a coupling ring, and a rimmed tubular over the BOP adapter housing.

FIG. 19 is similar to FIG. 17 except with overshot running tool 490 removed. Turning to FIG. 20, diverter housing 470 has been removed. Conduits (580, 582) are threadably attached with respective threaded bores (227, 226) of casing head 202. Coupling ring 586 couples BOP adapter housing 588 with casing head 202. Coupling or lockdown screws 592 are in the extended position and tightened on BOP adapter housing 588. Retainer pins 591 in BOP adapter housing 588 have been retracted. Rimmed tubular 590 is bolted with bolts 594 to BOP adapter housing 588. It is contemplated that a BOP may be attached with rimmed tubular 590.

Figure 21:
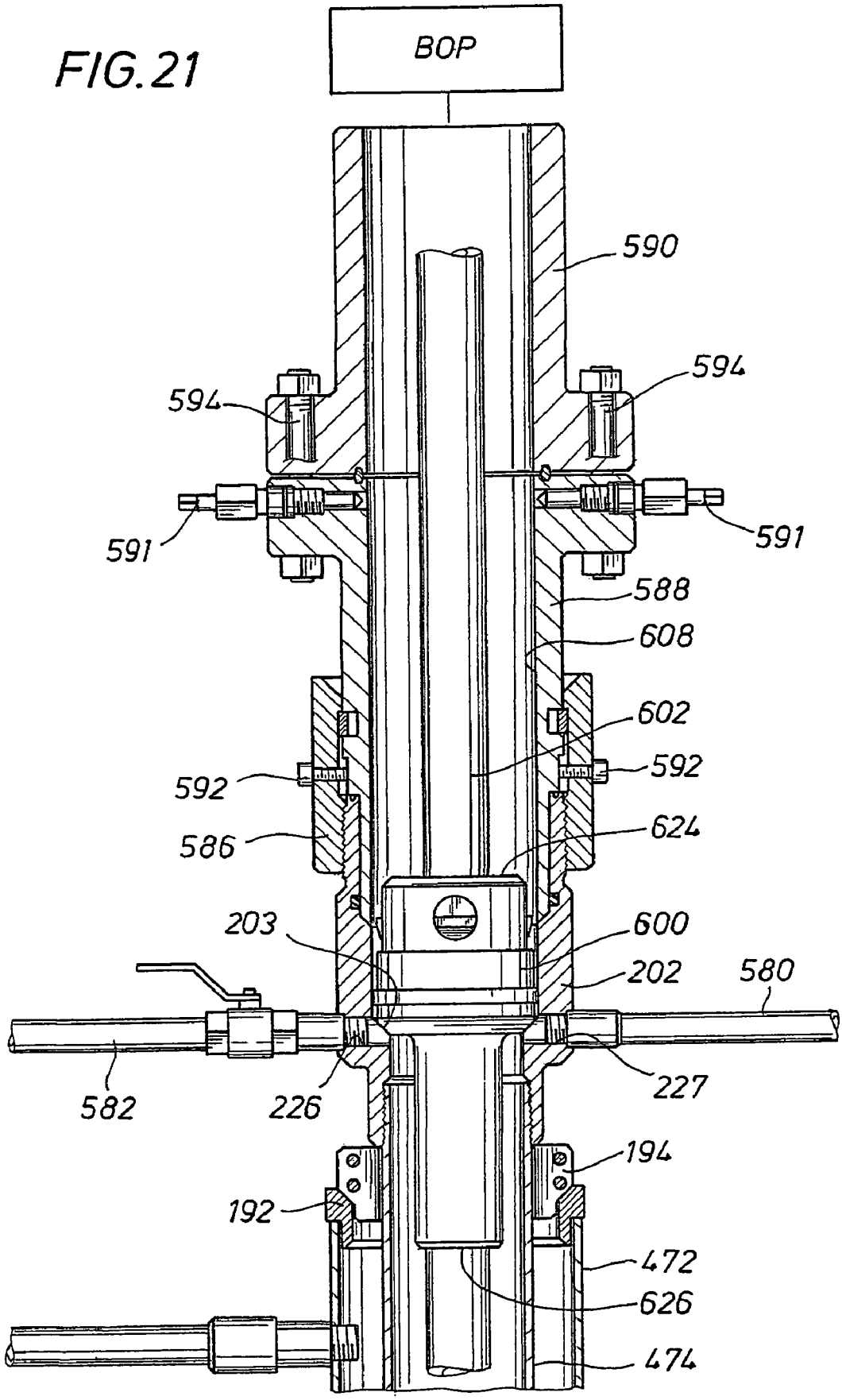
FIG. 21 is a view similar to FIG. 20, except that a combination running tool is in the bore of the wellhead.

In FIG. 21, combination running tool 600 has been coupled with tubular 602 and inserted from the surface through longitudinal bore 608 and into casing head 202 where it rests on internal shoulder 203 of casing head 202. Combination running tool 600 is shown in more detail in FIG. 24. Comparing FIGS. 21 and 24, in FIG. 21 end 624 of combination running tool 600 is above end 626, as combination running tool 600 is rotated 180° from its orientation shown in FIG. 24. Returning to FIG. 21, it is contemplated that coupling screws 592 may be retracted when combination running tool 600 is in the position shown in FIG. 21. It is contemplated that when combination running tool 600 is in the position shown, the BOP may be closed on tubular 602 and the BOP tested. As can now be understood, combination running tool 600 acts as a test plug when used as shown in FIG. 21.

Figure 22:
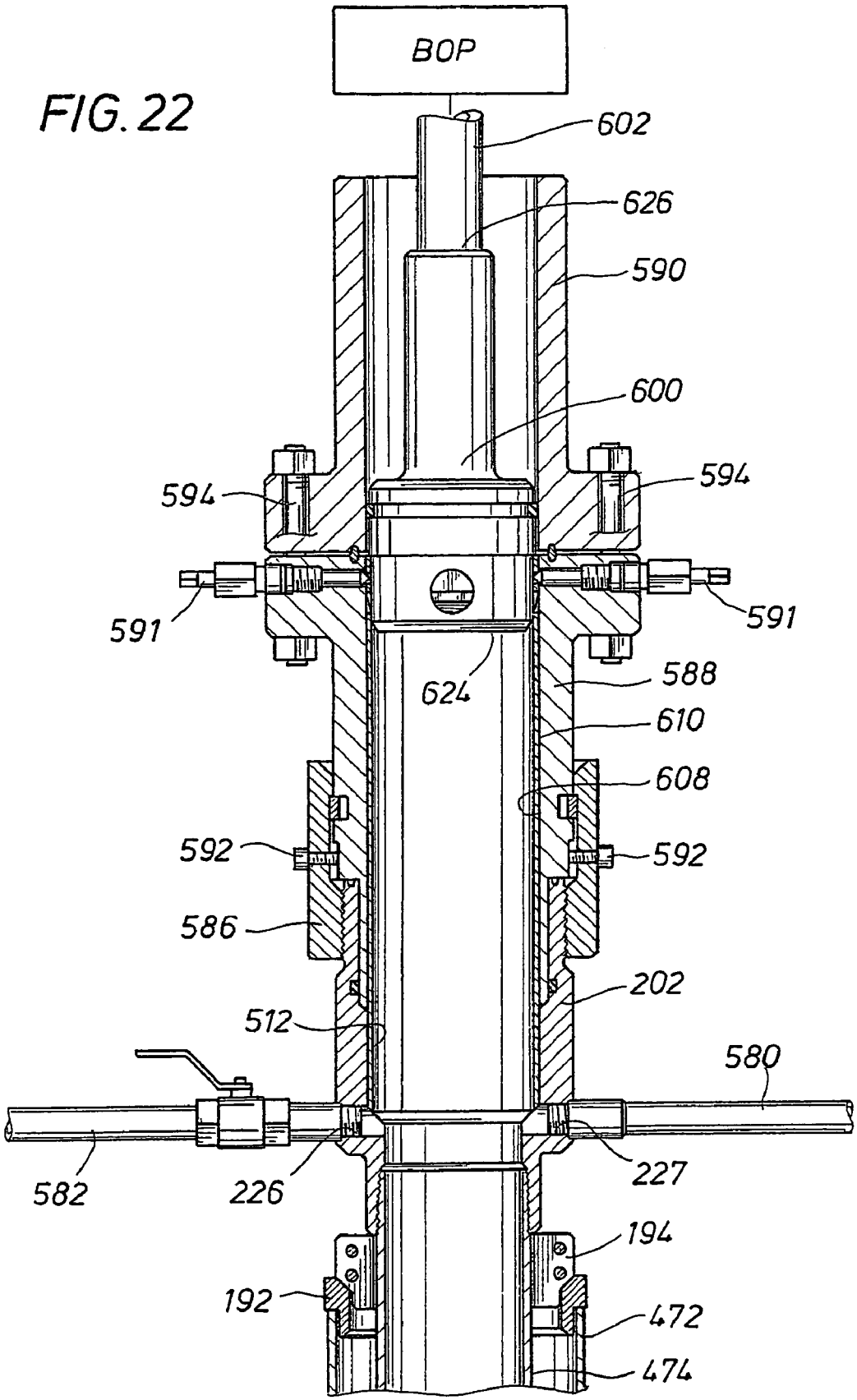
FIG. 22 is a similar to FIG. 21, except that the combination running tool has been rotated 180° and coupled with a protective sleeve that has been placed in the bore of the BOP adapter housing, and the lockdown screws are in the extended position for holding the protective sleeve.

FIG. 22 shows combination running tool 600 from FIG. 21 with end 626 higher than end 624. Combination running tool 600 in FIG. 22 has been rotated 180° from its orientation in FIG. 21. Combination running tool 600 as shown in FIG. 22 is in the same orientation as it is shown in FIG. 24. To go from FIGS. 21 to 22, combination running tool 600 may be removed up through longitudinal bore 608, uncoupled from tubular 602, rotated 180°, coupled with tubular 602, and reinserted into longitudinal bore 608. Returning to FIG. 22, end 626 of combination running tool 600 is coupled with tubular 602. Wear bushing or protective sleeve 610 is coupled with combination running tool 600 near end 624 and positioned in longitudinal bore 608. Protective sleeve 610 is shown in more detail in FIGS. 23 and 23A, and combination running tool 600 and its mechanism used to attach with protective sleeve 610 is shown in more detail in FIG. 24.

Returning to FIG. 22, retainer pins 591 are extended through BOP adapter housing 588 to engage sleeve 610. Coupling screws 592 are tightened on BOP adapter housing 588. Combination running tool 600 may be rotated in a horizontal plane and separated from sleeve 610, and the tool 600 extracted from the longitudinal bore 608, leaving the sleeve 610 in place. Drilling operation may then proceed with protective sleeve 610 preventing cement, sand, rock and debris from contacting the interior surface 512 of casing head 202 and the interior surface of BOP adapter housing 588. As can now be understood, combination running tool 600 may be used both as a test plug as shown in FIG. 21, and to run and retrieve protective sleeve 610 as shown in FIG. 22. Although casing head 202 is shown in FIGS. 20-22, it is contemplated that any embodiment of casing head (202, 240, 370) may be similarly positioned.

Turning to FIG. 23, protective sleeve 610 has pin openings 614 for insertion of one end of retainer pins 591 as shown in FIG. 22. In FIG. 23, sleeve 610 also has dog openings 612 for insertion of dogs 622 of combination running tool 600, as shown in FIG. 24. FIG. 23A shows the angled surface or edge 613 of dog openings 612 that allow for detachment of dogs 622 when tool 600 is removed and sleeve 610 left in place. Turning to FIG. 24, both ends (624, 626) of combination running tool 600 have respective threaded bores (620, 618) for coupling with tubulars as shown in FIGS. 21-22. In FIG. 24, annular seal 616 seals with longitudinal bore 608 when combination running tool 600 is inserted as shown in FIG. 21. Dogs 622 engage dog openings 612 of sleeve 610 when the sleeve 610 is being positioned or retrieved in longitudinal bore 608.

Figure 25A:
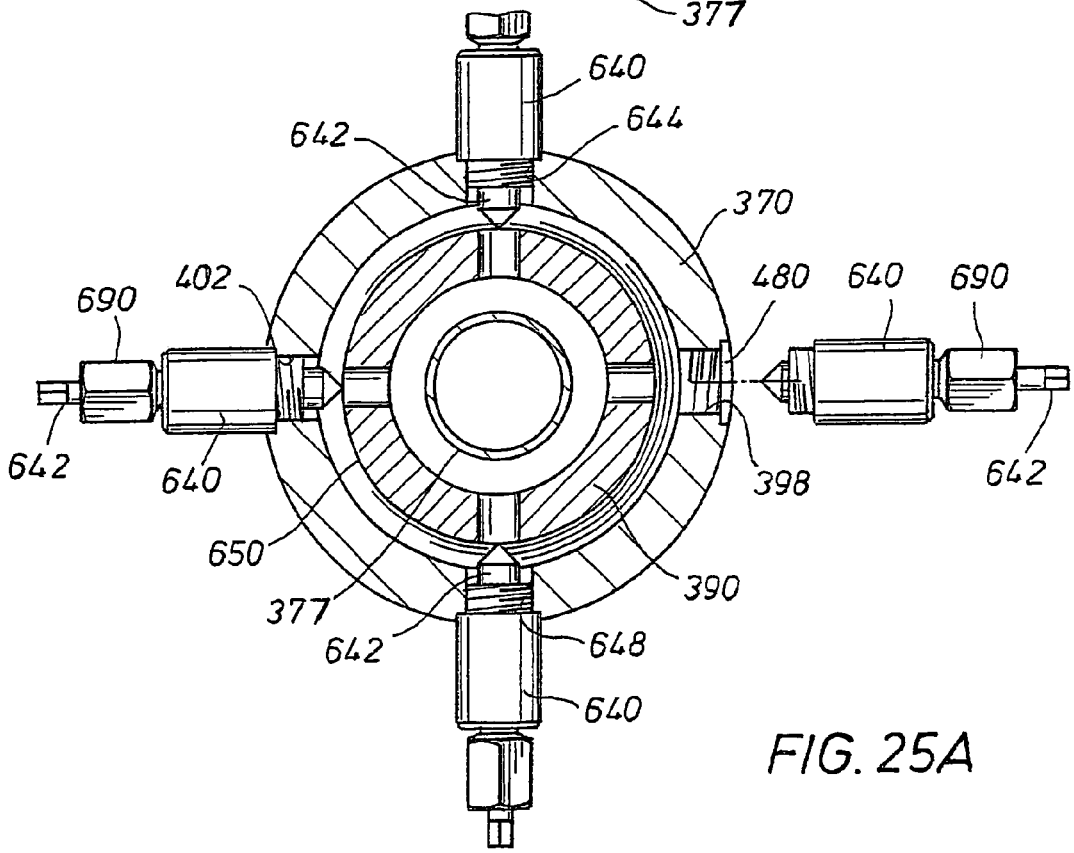
FIG. 25A is a section view taken along line 25A-25A of FIG. 25 illustrating three retainer pin housings with respective retainer pins therein coupled with three threaded bores in the wellhead, the retainer pins are in an extended position in a bushing groove in the support pack-off bushing, a flush plug in a fourth threaded bore, and a retainer pin housing with retainer pin aligned for coupling with the fourth threaded bore.

FIGS. 25 and 25A show casing head 370 from FIG. 12 before conduits (371, 374, 396, 400) are coupled with respective threaded bores (376, 378, 398, 402). Although casing head 370 is shown, casing head 240 may be so positioned. Flush plugs 480 are positioned in threaded bores (376, 378, 398). Plugs 480 prevent cement, fluid, sand, rock and debris from entering threaded bores (376, 378, 398, 402, 644, 648) when casing head 370 is moved thru diverter housing 470 as shown in FIG. 18 and when operations are conducted with overshot running tool (490, 530, 550) in place, such as cementing and drilling. Returning to FIGS. 25 and 25A, retainer pin housings 640 may be coupled with threaded bores (398, 402, 644, 648) after plugs 480 are removed. Retainer pin housings 640 and threaded bores (398, 402, 644, 648) may be coupled using line pipe or sealing threads, which unlike V-type threads, are tapered threads that are designed for sealing against high internal pressures. As shown in better detail in FIG. 27, which is discussed below, packing nut 690 may be connected to retainer pin housing 640 with V-type threads, and retainer pin 642 positioned through packing nut 690. As can now be understood, packing nut 690 and retainer pin 642 is similar to packing nuts (128, 214, 290) and retainer pins (132, 216, 292) of FIGS. 8, 10, and 11, respectively. Returning to FIG. 25, retainer pins 642 may be positioned through housings 640 and threaded bores (398, 402, 644, 648) and with an end extended into annular groove or bushing groove 650 of support pack-off bushing 390. When pins 642 are extended into groove 650, they prevents upward movement of support pack-off bushing 390 and hangers (384, 386, 392) during operations. Although four (4) retainer pins 642 and housings 640 are shown, other amounts are contemplated. An enlarged view of retainer pin 642 and housing 640 is shown in FIG. 27.

FIG. 26 shows alignment pin housing 300 on the right side threadably attached with threaded bore 342 in casing head 240. One end of alignment pin 304 is shown in alignment slot 346 of mandrel hanger 256. On the left side, sealing flanges (150, 150A) are attached to the outer surface of casing head 240. Side hydraulic lines (152, 152A) extend through respective flange openings (660, 660A) and respective access openings or side bores (360, 360A) in casing head 240 and are coupled with respective hanger side ports (352, 352A) of mandrel hanger 256. As can now be understood, side hydraulic line 152 may be used to open a downhole deployment valve or other downhole tool, and side hydraulic line 152A may be used to close the same downhole deployment valve or other downhole tool. Although flanges (150, 150A) and side hydraulic lines (152, 152A) are shown in FIG. 26 with casing head 240, they may be positioned with any embodiment of casing head (202, 240, 370).

Figure 27:
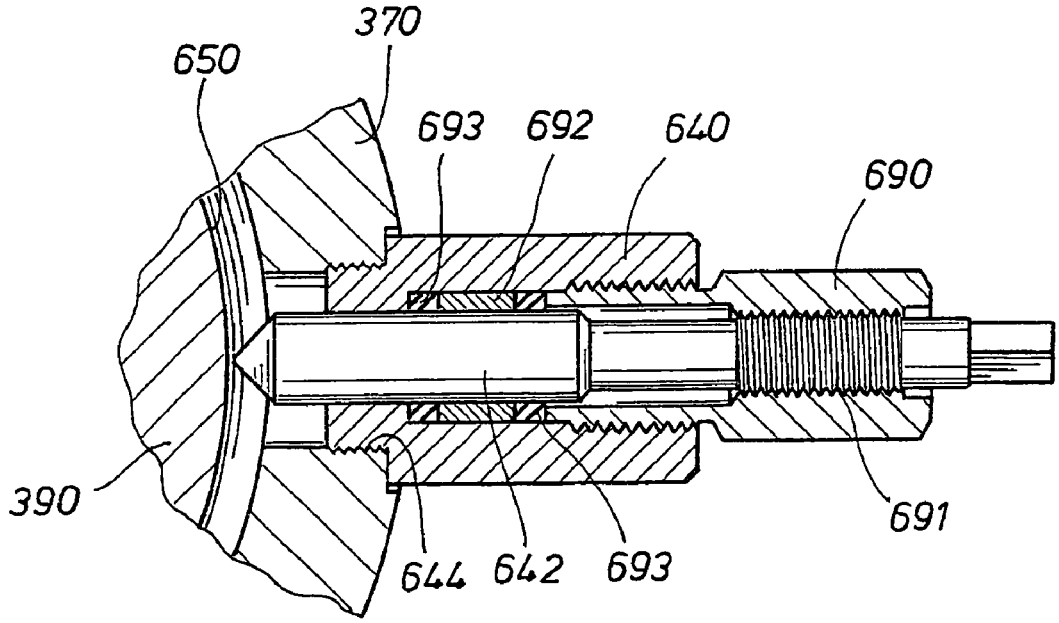
FIG. 27 is an enlarged section partial plan view of another removable protrusion, such as a retainer pin housing with a retainer pin therein as shown in FIGS. 25 and 25A coupled with a threaded bore in a wellhead, and the retainer pin in the extended position with a bushing groove of a support pack-off bushing.

FIG. 27 shows an enlarged view of retainer pin 642 and retainer pin housing 640 as shown in FIG. 25A with one end of retainer pin 642 extended into groove 650 of support pack-off bushing 390. Packing nut 690 is threadably attached with housing 640. Threads 691 on pin 642 allow pin 642 to be moved through threaded bore 644. Seal 692 and spacer rings 693 are within housing 640.

Method of Use

As shown in FIGS. 17, 18 and 18A, following the initial drilling of the wellbore, wellbore tubular 190A is positioned in the wellbore and may be cemented in place. Wellbore tubular 190A may be a conductor casing. After determining the desired elevation for the top of the casing head (202, 240, 370) in relation to ground level, the top of wellbore tubular 190A may be cut to achieve that elevation. Landing ring 192 may be positioned on the top of wellbore tubular 190A, and diverter housing 470 positioned on wellbore tubular 190A and bolts 477 tightened. Drilling in the wellbore may then continue for the surface casing, such as wellhead tubular (474, 474A). Flush plugs 480 are positioned in threaded bores (226, 227, 276, 278, 280, 282, 302, 342, 376, 378, 398, 402, 431, 644, 648) and access openings or side bores (324, 360, 360A, 433) in casing head (202, 240, 370). Casing head (202, 240, 370) is threadably coupled with overshot running tool (490, 530, 550), respectively. One end of running tool tubular (476, 476A) is coupled with the top of overshot running tool (490, 530, 550), and one end of wellhead tubular (474, 474A) is coupled with the bottom of casing head (202, 240, 370).

Support ring (194, 286) is tightened with respective bolts (410, 414) and scrub screws 412 onto wellhead tubular (474, 474A) at the bottom of casing head (202, 240, 370). Eccentric support ring 286 may be necessary if the longitudinal axis of wellhead tubular (474, 474A) is not in alignment the vertical longitudinal axis of the wellbore. The connection between overshot running tool (490, 530, 550) and casing head (202, 240, 370) may be pressure tested using test ports (491, 680, 680A) in overshot running tool (490, 530, 550). The overshot running tool (490, 530, 550) and casing head (202, 240, 370) assembly is inserted thru the longitudinal bore of the diverter housing 470 until support ring (194, 286) rests on landing ring 192.

As can now be understood, the lack of protrusions on casing head (202, 240, 370), such as rim (206, 266, 266A), alignment pin housing 300, retainer pin housings 640, and flange (150, 150A), allow casing head (202, 240, 370) to move thru a smaller interior diameter diverter housing 470 than would otherwise be possible. Protrusions are also contemplated to include packing nuts (128, 214), support pack-off bushing leads (24, 25), and bull plug housings, such as disclosed in Pub. No. US 2004/0079532. As can also now be understood, the use of support ring (194, 286) eliminates conductor wellheads and extra casing heads, thereby saving time. Cementing of tubular (474, 474A) and further drilling operations may continue with overshot running tool (490, 530, 550) in place, thereby saving time. It is contemplated that a "diesel pill" may immediately precede the cement down through the longitudinal bore of the overshot running tool (490, 530, 550) and tubular (474, 474A). The diesel pill will assist in keeping the water in the cement, and will also precede the cement when it exits up the well between the conductor pipe 190A and tubular (474, 474A), providing a signal for when to shut off the cement. Overshot running tool (490, 530, 550) protects the interior surface (391, 512, 540) of casing heads (202, 240, 370), grooves (683A, 684A, 685A), and exterior threads (496, 544, 544A) from cement, debris and contaminants without the need for a protective sleeve. It is contemplated that seals (683, 684, 685) may also be protected. After tubular (474, 474A) is cemented, overshot running tool (490, 530, 550) may be unthreaded from casing head (202, 240, 370) and removed, leaving casing head (202, 240, 370) in the position as shown in FIG. 19.

Diverter housing 470 may be removed. As shown in FIGS. 10 and 10A, for single bowl casing head 202, flush plugs 480 may be removed from threaded bores (226, 227, 302) and access opening 324. Conduits (222, 223) may be coupled with respective threaded bores (226, 227). Alignment pin housing 300 with alignment pin 304 may be threadably attached with threaded bore 302, and flange 150 may be attached to casing head 202 in alignment with access opening or side bore 324. Flange opening 322 may be plugged for pressure testing. Two sealing flanges (150, 150A), as shown in FIG. 26, may be attached if there are two side bores (360, 360A). Also, side bore 324 may be threaded if a bull plug housing, such as disclosed in Pub. No. US 2004/0079532, is desired instead of a bolted flange.

As shown in FIGS. 12, 15, 25 and 25A, for a monolithic multi-bowl casing head 370, plugs 480 may be removed from threaded bores (376, 378, 398, 402, 431, 644, 648) and access opening 433. Conduits (371, 375) may be coupled with respective threaded bores (376, 378). Alignment pin housing 300 with alignment pin 304 may be threadably attached with threaded bore 431, and flange 150 may be attached to casing head 370 in alignment with access opening or bore 433. Flange opening 322 may be plugged for pressure testing. Two sealing flanges (150, 150A), as shown in FIG. 26, may be attached if there are two bores (360, 360A). Also, side bore 324 may be threaded if a bull plug housing, such as disclosed in Pub. No. US 2004/0079532, is desired instead of a bolted flange. As shown in FIGS. 25 and 25A, retainer pin housings 640 with retainer pins 642 may be coupled with threaded bores (398, 402, 644, 648). The same method described above may be used for casing head 240.

After cementing and/or further drilling, the overshot running tool may be removed. As shown in FIG. 20, BOP adapter housing 588 and BOP may then be coupled with casing head (202, 240, 370) using coupling ring 586. As shown in FIG. 21, combination running tool 600 may be inserted in the longitudinal bore and the BOP and casing head (202, 240, 370) may be pressure tested. As can now be understood, the BOP adapter housing may be made up to the BOP system in a relatively quick manner thereby allowing drilling to commence as soon as the BOP is tested. A mandrel hanger (256, 384) or slip hanger (204, 386) may be coupled with a tubular or tubular string, such as tool tubular 198 in FIGS. 10 and 10A. It is contemplated that a downhole deployment valve or other downhole hydraulic tool may be coupled to the opposite end of the tubular or tubular string. As shown in FIGS. 10A, 11A, 15, and 15A, one end of hanger tool hydraulic line 154 may be coupled with hanger tool port (318, 354, 436), and the other end coupled with the downhole deployment valve or other downhole hydraulic tool.

As shown in FIG. 10, if single bowl casing head 202 is used, then one hanger 204 supporting tool tubular 198 may be moved down through the top of and positioned within the casing head 202. Tool tubular 198 may be production casing. Although slip hanger 204 is shown, a mandrel hanger, such as hanger 256 shown in FIG. 11, may be used. It is contemplated that the BOP does not have to be removed, thereby saving time. As shown in FIG. 10A, alignment pin 304 may be extended through threaded bore 302 before hanger (204, 256) is moved through casing head 202. Hanger (204, 256) may need to be rotated about a horizontal plane so that the end of alignment pin 304 may rest in alignment slot 306 and hanger (204, 256) seated on shoulder 203 in casing head 202. As shown in FIGS. 11, 11A, 12 and 12A, if multi-bowl casing head (240, 370) is used, then a first mandrel hanger (256, 384, 706) or slip hanger 386 supporting tool tubular (244, 374, 720) may be positioned within the casing head (240, 370) in similar fashion.

As shown in FIGS. 10A, 11A and 15, after hanger side port (316, 352, 434) is aligned with side bore (324, 360, 433) in casing head (202, 240, 370) through the use of alignment pin 304, side hydraulic line 152 may be positioned through flange opening 322 and side bore (324, 360, 433) and coupled with hanger side port (316, 352, 434). It is also contemplated that flange 150 may be removed for such installation. More than one sealing flange (150, 150A) may be necessary, as shown in FIG. 26, for multiple side bores (360, 360A) and side hydraulic lines (152, 152A). The downhole deployment valve or other downhole hydraulic tool may be then be used in further drilling operations. As shown in FIG. 10, if casing head 202 is used, then rim 206 may be coupled with casing head 202. If additional smaller diameter tubulars are needed, then other wellhead components, such as a casing spool or tubing head, may be added over casing head 202 to the wellhead system.

As shown in FIGS. 11, 11A, 12 and 12A, for multi-bowl casing head (240, 370), if additional smaller diameter tubulars are needed, support pack-off bushing (258, 390, 390A, 704) may be positioned over first hanger (256, 384, 386, 706). As shown in FIGS. 25 and 25A, retainer pins 642 may be extended into bushing groove 650 of support pack-off bushing (390, 390A) to hold it in place during installation and pressure situations. As shown in FIGS. 11, 11A, and 12, a second hanger, such as slip hanger (264, 392), may be coupled with second hanger tubular (245, 377) and moved through the top of casing head (240, 370) and positioned over support pack-off bushing (258, 390). As shown in FIG. 12A, the second hanger may be a mandrel tubing hanger 702. The BOP does not have to be removed. As can now be understood, this may eliminate the need for an additional wellhead component, such as a casing spool or tubing head. For example, if second hanger tubular (245, 377, 708) is production casing or tubing, then the need for a tubing head is eliminated. Since the wellhead system does not have to be disassembled to add a second hanger, pressure testing of the wellhead may be eliminated, saving valuable rig time.

Alternatively, rather than coupling second hanger tubular (245, 377) with slip hanger (264, 392) above the wellhead system and moving the assembly down into the wellhead, second hanger tubular (245, 377) may be brought up through the bottom of casing head (240, 370) and coupled with slip hanger (264, 392) and slip hanger (264, 392) seated in casing head (240, 370), such as when a liner may be run to the surface from downhole. Rim (266, 266A) may be coupled with casing head (240, 370) for further assembly of the wellhead system above casing head (240, 370). Retainer pin housings 640 may be removed from casing head (240, 370) and replaced with conduits (260, 262, 396, 400).

As can now be understood, the method of use of a multi-bowl casing head may include positioning a wellbore tubular in the wellbore, cutting the top of the wellbore tubular at the desired elevation for placement of a casing head, and securing a landing ring on top of the wellbore tubular. A diverter housing may then be mounted on the wellbore tubular, and drilling continued in the wellbore. The top of the casing head is threadably coupled with an overshot running tool and the bottom of the casing head may be attached with a wellhead tubular, and a support ring attached onto the wellhead tubular. After pressure testing of the connection between the overshot running tool and the casing head, the wellhead assembly, without protrusions, may be moved down thru the longitudinal bore of the diverter housing until the support ring rests on the landing ring. After cementing and/or drilling in the wellbore, the overshot running tool and the diverter housing are removed. After removing the preferable flush plugs from the casing head, protrusions may be threadably coupled with the wellhead, such as an alignment pin housing, sealing flanges, rims and/or retainer pin housings.

A BOP adapter housing and BOP may be attached with the casing head, and pressure testing of the casing head and BOP accomplished using a combination running tool. The combination running tool may also be used to place and remove a protective sleeve. A first hanger may be coupled with one end of a first hanger tubular, and a downhole deployment valve attached to the other end of the tubular. Tool hydraulic lines may be coupled between the first hanger and the downhole deployment valve. One end of an alignment pin may be inserted through the alignment pin housing to position the first hanger in the casing head. When the first hanger is moved down into the casing head, the first hanger may be rotated as necessary to fit around the end of the alignment pin. Side hydraulic lines may be inserted from outside the casing head and coupled with the first hanger. The downhole deployment valve may be employed in further drilling operations as necessary.

If another tubular is needed, a support pack-off bushing may be placed over the first hanger in the casing head. Retainer pins may be inserted through retainer pin housings to hold the support pack-off bushing in place. A second hanger may be coupled with a second hanger tubular, and the second hanger moved into the casing head and positioned on the support pack-off bushing. Again, the downhole deployment valve may be used in further drilling operations as necessary. The retainer pin housings may be removed and replaced with conduits, and a rim threadably coupled with the top of the casing head. A seal may be placed in a groove at the top of the casing head for sealing with other wellhead components, such as a tubing head as necessary. If desired, rather than inserting the second tubular down through the casing head from above, the second tubular may be brought up from the wellbore through the bottom of the casing head and attached with the second hanger either above or in the casing head.

The foregoing disclosure and description of the invention are illustrative and explanatory thereof, and various changes in the details of the illustrated apparatus and system, and the construction and the method of operation may be made without departing from the spirit of the invention.

We claim:

1. A method for assembling a wellhead system, comprising the steps of:

positioning a first housing with a wellbore tubular extending into a wellbore;

coupling a wellhead having a first side bore with a wellhead tubular;

moving said wellhead into said first housing;

positioning said wellhead with said wellbore tubular;

removing said first housing; and coupling a second housing with said wellhead first side bore.

2. The method of claim 1, wherein said wellhead second housing is threadably coupled to communicate with said wellhead first side bore.

3. The method of claim 1 further comprising an alignment pin, wherein said second housing supporting said alignment pin.

4. The method of claim 1 further comprising a retainer pin, wherein said second housing supporting said retainer pin.

5. The method of claim 1, wherein said second housing comprises a flange having an opening, and further comprising the step of aligning said flange opening with said wellhead first side bore.

6. The method of claim 1, wherein said wellhead having an exterior surface including a thread, and further comprising the step of threading a rim with said wellhead exterior surface thread.

7. The method of claim 1, wherein the step of moving said wellhead comprises lowering an overshot running tool.

8. The method of claim 1, further comprising the step of:

positioning a blowout preventer with said wellhead.

9. The method of claim 8, further comprising the step of:

coupling a blowout preventer adapter housing with said wellhead.

10. The method of claim 1, further comprising the steps of:

positioning a hydraulically operated tool with a tool tubular;

coupling a first hanger with said tool tubular, wherein said first hanger comprises a first hanger side port in fluid communication with a first hanger tool port;

coupling a first tool hydraulic line between said hydraulically operated tool and said first hanger tool port;

moving said first hanger into said wellhead; and aligning said first hanger side port with said wellhead first side bore.

11. The method of claim 10, wherein said wellhead has a second side bore, and further comprising the steps of coupling a third housing with said wellhead second side bore, and moving one end of an alignment pin through said wellhead second side bore.

12. The method of claim 11, wherein said first hanger comprises an alignment slot, and further comprising the step of positioning said alignment slot to receive one end of said alignment pin.

13. The method of claim 10, further comprising the step of coupling a first side hydraulic line with said first hanger side port through said wellhead first side bore.

14. The method of claim 10, wherein said hydraulically operated tool is a downhole deployment valve.

15. The method of claim 10, wherein said first hanger is a mandrel hanger.

16. The method of claim 10, wherein said first hanger is a slip hanger.

17. The method of claim 1, wherein said wellhead comprises a single bowl wellhead.

18. The method of claim 1, wherein said wellhead comprises a multi-bowl wellhead.

19. The method of claim 18, wherein said wellhead is monolithic.

20. The method of claim 18, wherein said wellhead comprises a casing head coupled with a casing spool.

21. The method of claim 1, wherein said first housing is a diverter housing.

22. The method of claim 13, further comprising the steps of:

positioning a support pack-off bushing in said wellhead above said first hanger;

coupling a second hanger with a second hanger tubular;

moving said second hanger into said wellhead; and positioning said second hanger in said wellhead above said support pack-off bushing.

23. The method of claim 22, wherein said second hanger is a slip hanger.

24. The method of claim 22, wherein said second hanger is a mandrel hanger.

25. The method of claim 22, further comprising the step of moving the top end of a second hanger tubular up into the wellhead before the step of coupling the second hanger with the second hanger tubular.

26. The method of claim 22, wherein the wellhead has a second side bore, and further comprising the step of:

coupling a third housing with said wellhead second side bore.

27. The method of claim 26, wherein said third housing is threadably coupled to communicate with said wellhead second side bore.

28. The method of claim 27 further comprising a retainer pin, wherein said third housing supports said retainer pin.

29. The method of claim 28, wherein said support pack-off bushing having a groove, and further comprising the step of:

moving one end of said retainer pin through said wellhead second side bore and into said bushing groove.

30. A wellhead system for use with a wellbore, comprising:

a wellhead tubular;

a wellbore tubular extending into the wellbore;

a casing head having a side bore and directly coupled with said wellhead tubular;

a split support ring to block movement of said casing head, said wellbore tubular supports said split support ring; and a first housing configured for being threadably coupled with said casing head side bore after said casing head is supported by said wellbore tubular.

31. The wellhead system of claim 30, wherein said casing head having an exterior surface comprising a thread, and further comprising:

a rim threadly coupled with said casing head exterior surface thread.

32. The wellhead system of claim 30 further comprising an alignment pin, wherein said first housing supports said alignment pin.

33. The wellhead system of claim 30 further comprising a retainer pin, wherein said first housing supports said retainer pin.

34. The wellhead system of claim 30, wherein said first housing comprises a flange having an opening aligned with said casing head side bore.

35. The wellhead system of claim 30, further comprising:

a tool tubular;

a hydraulically operated tool positioned with said tool tubular;

a casing hanger coupled with said tool tubular, wherein said casing hanger having a hanger side port in fluid communication with a hanger tool port;

a tool hydraulic line coupled between said hanger tool port and said hydraulically operated tool; and said hanger positioned in said casing head.

36. The wellhead system of claim 30 wherein said split support ring is eccentric.

37. A method for positioning a wellhead with a wellbore, comprising the steps of:

releasably positioning a diverter housing with a wellbore tubular extending into a wellbore;

coupling a wellhead having a side bore independent of a protrusion with a wellhead tubular;

moving said wellhead into said diverter housing;

positioning said wellhead with said wellbore tubular;

removing said diverter housing; and coupling a protrusion with said wellhead side bore.

38. The method of claim 37, wherein said protrusion is threadably coupled with said wellhead side bore to communicate with said wellhead side bore.

39. The method of claim 37 further comprising an alignment pin, wherein said protrusion supporting said alignment pin.

40. The method of claim 37 further comprising a retainer pin, wherein said protrusion supporting said retainer pin.

41. The method of claim 37, wherein said protrusion comprises a flange having an opening, and further comprising the step of aligning said flange opening with said wellhead side bore.

42. The method of claim 37, wherein said wellhead exterior surface including a thread, and further comprising the step of threading a rim with said wellhead exterior surface thread.

43. The method of claim 37, wherein said wellhead sized for positioning at least two casing hangers.

44. The method of claim 37, wherein said wellhead comprises a single bowl wellhead.

45. The method of claim 37, further comprising the steps of:

positioning a hydraulically operated tool with a tool tubular;

coupling a hanger with said tool tubular, wherein said hanger comprises a hanger side port in fluid communication with a hanger tool port;

coupling a tool hydraulic line between said hydraulically operated tool and said hanger tool port;

moving said hanger into said wellhead; and aligning said hanger side port with said wellhead side bore.

46. A wellhead system for use with a wellbore, comprising:

a wellhead tubular;

a wellbore tubular extending into the wellbore;

a casing head having a side bore and directly coupled with said wellhead tubular;

a first housing configured for being threadably coupled with said casing head side bore;

said casing head coupled with said wellbore tubular; and a diverter housing, wherein said casing head configured to be disposed in said diverter housing while drilling operations are conducted therethrough independent of said first housing threadably coupled with said casing head.

* * * * *